US005683853A

United States Patent [19]

Makuta et al.

[11] Patent Number: 5,683,853

[45] Date of Patent: Nov. 4, 1997

[54] SILVER HALIDE COLOR PHOTOGRAPHIC MATERIAL

[75] Inventors: Toshiyuki Makuta; Koki Nakamura; Kiyoshi Takeuchi, all of Kanagawa, Japan

[73] Assignee: Fuji Photo Film Co., Ltd., Kanagawa, Japan

[21] Appl. No.: 604,243

[22] Filed: Feb. 21, 1996

[30] Foreign Application Priority Data

Feb. 21, 1995 [JP] Japan ..... 7-055173

[51] Int. Cl.[6] ..... G03C 1/06

[52] U.S. Cl. ..... 430/264; 430/598; 430/551; 430/558; 430/505

[58] Field of Search ..... 430/505, 264, 430/379, 407, 409, 410, 551, 558, 598

[56] References Cited

U.S. PATENT DOCUMENTS

| | | | |
|---|---|---|---|
| 4,060,418 | 11/1977 | Waxman et al. | 428/411 |
| 4,762,775 | 8/1988 | Ogawa et al. | 430/558 |
| 4,824,774 | 4/1989 | Inoue et al. | 430/264 |
| 4,917,994 | 4/1990 | Martinez et al. | 430/523 |
| 5,164,288 | 11/1992 | Nelson et al. | 430/558 |
| 5,217,857 | 6/1993 | Hayashi | 430/556 |
| 5,229,248 | 7/1993 | Sanpei et al. | 430/598 |
| 5,336,592 | 8/1994 | Chino et al. | 430/621 |

FOREIGN PATENT DOCUMENTS

| | | |
|---|---|---|
| 0283041 | 9/1988 | European Pat. Off. . |
| A1 0545491 | 11/1992 | European Pat. Off. . |
| A1 0565165 | 3/1993 | European Pat. Off. . |

*Primary Examiner*—Geraldine Letscher

*Attorney, Agent, or Firm*—Sughrue, Mion, Zinn, Macpeak & Seas, PLLC

[57] ABSTRACT

A silver halide color photographic material is disclosed, which comprises a support having thereon at least one silver halide emulsion layer, wherein the emulsion layer contains at least one silver halide emulsion layer, wherein said emulsion layer contains at least one dye-forming coupler and at least one reducing agent for coloring represented by the following formula (I), and further the film pH of said silver halide color photographic material is 6.5 or less:

$$R^{11}—NH—NH—X—R^{12} \quad (I)$$

wherein $R^{11}$ represents an aryl group, or a heterocyclic group; $R^{12}$ represents an alkyl group, an alkenyl group, an alkynyl group, an aryl group or a heterocyclic group; X represents $—SO_2—$, —CO—, —COCO—, —CO—O—, $—CO—N(R^{13})—$, —COCO—O—, $—COCO—N(R^{13})—$ or $—SO_2—N(R^{13})—$; where $R^{13}$ represents a hydrogen atom or a group described for $R^{12}$.

16 Claims, No Drawings

SILVER HALIDE COLOR PHOTOGRAPHIC MATERIAL

FIELD OF THE INVENTION

The present invention relates to a color photographic technique and, in particular, to a silver halide color photographic material which is excellent in environmental protection and safety, further, suitable for simplified rapid processing, and to a method for forming a color image.

BACKGROUND OF THE INVENTION

In a color photographic material, usually, by color developing the exposed photographic material, the oxidized p-phenylenediamine derivatives and couplers are reacted and images are formed. In this method, colors are reproduced by a subtracting color process, and to reproduce blue, green and red colors, yellow, magenta and cyan color images which are complementary relationship, respectively, are formed.

Color development is achieved by immersing the exposed color photographic material in an alkali aqueous solution having dissolved therein a p-phenylenediamine derivative (a color developing solution). However, an alkali solution of a p-phenylenediamine derivative is unstable and liable to be deteriorated with the lapse of time, therefore, a color developing solution must be replenished frequently to maintain the stable developing ability. Further, the disposal of the waste color developing solution containing a p-phenylenediamine derivative is troublesome. The disposal of the waste color developing solution discharged in a large amount has been a large problem conjointly with the frequent replenishment. Therefore, the reduced replenishment and the reduced discharge of a color developing solution have been strongly desired.

As one means of effectively reducing replenishment and discharge of a color developing solution, there is a method of incorporating an aromatic primary amine or the precursors thereof in a hydrophilic colloid layer. As such aromatic primary amine developing agents and the precursors thereof capable of incorporation, for example, the compounds disclosed in U.S. Pat. No. 4,060,418 can be cited. However, as these aromatic primary amines and the precursors thereof are unstable, they have a drawback such that stains are generated during storage of an unprocessed photographic material for a long period of time or during color development. Another effective means is the method of incorporating a sulfone hydrazide type compound into a hydrophilic colloid layer as disclosed in EP-A-545491 and EP-A-565165. However, the sulfone hydrazide type compounds disclosed in these patents cannot prevent the generation of stains in a satisfactory level and the improvement has been desired.

SUMMARY OF THE INVENTION

An object of the present invention is to provide a silver halide color photographic material which is capable of processing with reduced replenishment and discharge, stain is not generated by storage of an unprocessed photographic material for a long period of time, and excellent in coloring ability (color development performance).

The present inventors have found that the above object of the present invention can be attained by the following.

(1) A silver halide color photographic material comprising a support having thereon at least one silver halide emulsion layer, wherein said emulsion layer contains at least one dye-forming coupler and at least one reducing agent for coloring represented by the following formula (I), and further the film pH of said silver halide color photographic material is 6.5 or less:

$$R^{11}—NH—NH—X—R^{12} \quad (I)$$

wherein $R^{11}$ represents a substituted or unsubstituted aryl group, or a substituted or unsubstituted heterocyclic group; $R^{12}$ represents a substituted or unsubstituted alkyl group, a substituted or unsubstituted alkenyl group, a substituted or unsubstituted alkynyl group, a substituted or unsubstituted aryl group or a substituted or unsubstituted heterocyclic group; X represents $—SO_2—$, —CO—, —COCO—, —CO—O—, $—CO—N(R_{13})—$, —COCO—O—, $—COCO—N(R_{13})—$ or $—SO_2—N(R^{13})—$; wherein $R^{13}$ represents a hydrogen atom or a group described for $R^{12}$.

(2) The silver halide color photographic material described in (1) above, wherein the reducing agent for coloring represented by the following formula (I) is represented by formula (II):

$$R^{11}—NH—NH—SO_2—R^{12} \quad (II)$$

wherein $R^{11}$ represents a substituted or unsubstituted aryl or a substituted or unsubstituted heterocyclic group; $R^{12}$ represents a substituted or unsubstituted alkyl group, a substituted or unsubstituted alkenyl group, a substituted or unsubstituted alkynyl group, a substituted or unsubstituted aryl group or a substituted or unsubstituted heterocyclic group.

(3) The silver halide color photographic material described in (2) above, wherein the reducing agent for coloring represented by formula (II) is represented by the following formula (III):

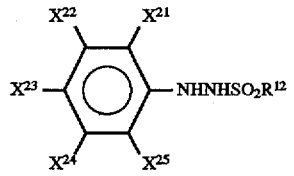

(III)

wherein $R^{12}$ represents an alkyl group or a heterocyclic group; $X^{21}$, $X^{23}$ and $X^{25}$ each represent a hydrogen atom, or a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, or a trifluoromethyl group; $X^{22}$ nd $X^{24}$ each represent a hydrogen atom, or a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, a trifluoromethyl group, a halogen atom, an acyloxy group or an acylthio group, provided that the sum of Hammett's $\sigma_p$ value of $X^{21}$, $X^{23}$ and $X^{25}$ and Hammett's $\sigma_m$ value of $X^{22}$ and $X^{24}$ should be 1.5 or more.

(4) The silver halide color photographic material described in (1), wherein the reducing agent for coloring represented by formula (I) is represented by the following formula (IV):

$$R^{11}—NH—NH—X'—R^{12} \quad (IV)$$

wherein $R^{11}$ represents a substituted or unsubstituted alkyl group or a substituted or unsubstituted heterocyclic group; $R^{12}$ represents a substituted or unsubstituted alkyl group, a substituted or unsubstituted alkenyl group, a substituted or unsubstituted alkynyl group, a substituted or unsubstituted aryl group, or a substituted or unsubstituted heterocyclic group; wherein X' represents —CO—'or —CON($R^{13}$)—, wherein $R^{13}$ represents a hydrogen atom of a group represented by $R^{12}$.

(5) The silver halide color photographic material described in (1), (2), (3) or (4) above, wherein the reducing agent for coloring represented by formula (I), (II), (III) or (IV) is contained in lipophilic fine grains and the average grain size is 0.3 μm or less.

(6) The silver halide color photographic material described in (1), (2), (3), (4) or (5) above, wherein the silver halide photographic material comprises at least three silver halide emulsion layers having different color sensitivities on a support and the total coating amount of silver is from 0.003 g/m$^2$ to 0.3 g/m$^2$.

DETAILED DESCRIPTION OF THE INVENTION

A reducing agent for coloring which is used in the present invention will be described in detail below.

The reducing agent for coloring represented by formula (I) for use in the present invention is a compound, which is different from the hydrazine compound having a nucleating function disclosed in JP-A-64-10233 (the term "JP-A" as used herein refers to a "published unexamined Japanese patent application"), etc., which undergoes, in an alkali solution, an oxidative reaction directly or indirectly with the developing agent oxidized by an exposed silver halide and to be oxidized, and the oxidized product is further reacted with a dye-forming coupler to form a dye.

The reducing agent for coloring represented by formula (I) is described in detail below.

$R^{11}$ represents an aryl group or a heterocyclic group, which may have a substituent.

The aryl group represented by $R^{11}$ is preferably an aryl group having from 6 to 14 carbon atoms, e.g., phenyl and naphthyl. The heterocyclic group represented by $R^{11}$ is preferably a saturated or unsaturated 5-, 6- or 7-membered ring having at least one of nitrogen, oxygen, sulfur and selenium. A benzene ring or a heterocyclic ring may be condensed with them. The heterocyclic ring represented by $R^{11}$ include, e.g., furanyl, thienyl, oxazolyl, thiazolyl, imidazolyl, triazolyl, pyrrolidinyl, benzoxazolyl, benzothiazolyl, pyridyl, pyridazyl, pyrimidinyl, pyrazinyl, triazinyl, quinolinyl, isoquinolinyl, phthalazinyl, quinoxalinyl, quinazolinyl, purinyl, pteridinyl, azepinyl, and benzoxepinyl.

The substituents for $R^{11}$ include an alkyl group, an alkenyl group, an alkynyl group, an aryl group, a heterocyclic group, an alkoxyl group, an aryloxy group, a heterocyclic oxy group, an alkylthio group, an arylthio group, a heterocyclic thio group, an acyloxy group, an acylthio group, an alkoxycarbonyloxy group, an aryloxycarbonyloxy group, a carbamoyloxy group, an alkylsulfonyloxy group, an arylsulfonyloxy group, an amino group, an alkylamino group, an arylamino group, an amido group, an alkoxycarbonylamino group, an aryloxycarbonylamino group, a ureido group, a sulfonamido group, a sulfamoylamino group, an acyl group, an alkoxycarbonyl group, an aryloxycarbonyl group, a carbamoyl group, an acylcarbamoyl group, a carbamoylcarbamoyl group, a sulfonylcarbamoyl group, a sulfamoylcarbamoyl group, an alkylsulfonyl group, an arylsulfonyl group, an alkylsulfinyl group, an arylsulfinyl group, an alkoxysulfonyl group, an aryloxysulfonyl group, a sulfamoyl group, an acylsulfamoyl group, a carbamoylsulfamoyl group, a halogen atom, a nitro group, a cyano group, a carboxyl group, a sulfo group, a phosphono group, a hydroxyl group, a mercapto group, an imido group and azo group.

$R^{12}$ represents an alkyl group, an alkenyl group, an alkynyl group, an aryl group or a heterocyclic group, which may have a substituent.

The alkyl group represented by $R^{12}$ is preferably a straight chain, branched or cyclic alkyl group having from 1 to 16 carbon atoms, e.g., methyl, ethyl, hexyl, dodecyl, 2-octyl, t-butyl, cyclopentyl and cyclooctyl.

The alkenyl group represented by $R^{12}$ is preferably an acyclic or cyclic alkenyl group having from 2 to 16 carbon atoms, e.g., vinyl, 1-octenyl and cyclohexenyl.

The alkynyl group represented by $R^{12}$ is preferably an alkynyl group having from 2 to 16 carbon atoms, e.g., 1-butynyl and phenylethynyl. The aryl group and the heterocyclic group represented by $R^{12}$ include those described for $R^{11}$. The substituents for $R^{12}$ include those described for $R^{11}$.

X preferably represents —$SO_2$—, —CO—, —COCO— or —CO—N($R^{13}$)— and more preferably represents —$SO_2$— or —CO—N($R^{13}$)—. X represents more preferably —CO—N($R^{13}$)—, because a two-equivalent coupler may be used as a coupler which reacts with the compound of formula (I) when X represents —CO—N($R^{13}$)—, and the compound of formula (I) effectively prevents an increase of stain generated by a long storage of unprocessed photographic material.

Further, $R^{11}$ preferably represents a nitrogen-containing heterocyclic group or a group represented by formula (V). In the compound of formula (IV), $R^{11}$ preferably represents a 6-membered nitrogen-containing heterocyclic group or a group represented by formula (V). In the compound of formula (II), $R^{11}$ preferably represents a group represented by formula (V).

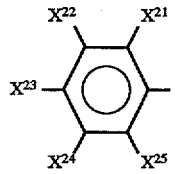

(V)

wherein $X^{21}$, $X^{23}$ and $X^{25}$ each represent a hydrogen atom, or a nitro group, a cyano group, an alkylsulfonyl group, an arylsulfonyl group an alkylsulfinyl group, an arylsulfinyl group, a sulfamoyl group, a carbamoyl group, an alkoxycarbonyl group, an aryloxycarbonyl group, an acyl group, or a trifluoromethyl group; $X^{22}$ and $X^{24}$ each represent a hydrogen atom, or a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, a trifluoromethyl group, a halogen atom, an acyloxy group or an acylthio group, provided that the sum of Hammett's $\sigma_p$ value of $X^{21}$, $X^{23}$ and $X^{25}$ and Hammett's $\sigma_m$ value of $X^{22}$ and $X^{24}$ should be 1.5 or more.

The reducing agent for coloring of the present invention is preferably nondiffusible in the emulsion layer.

Specific examples of the compounds represented by formula (I) are shown below.

I-1
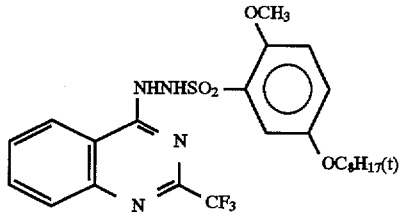
I-2
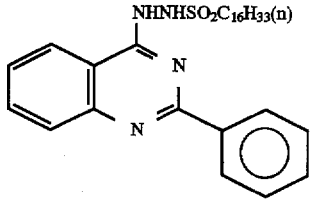
I-3
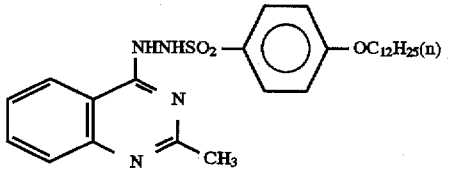
I-4
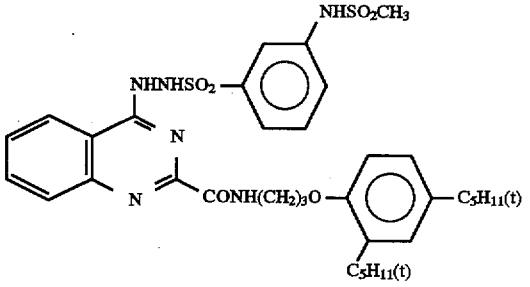
I-5
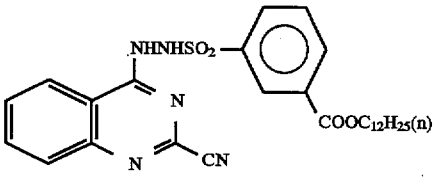
I-6
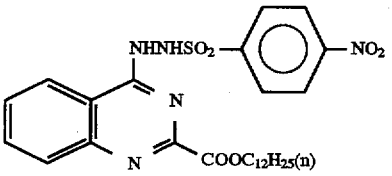
I-7
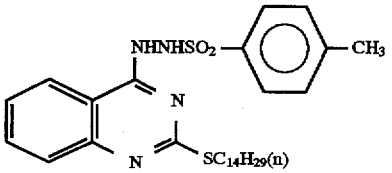
I-8
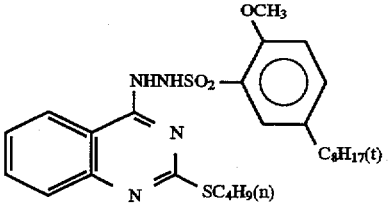

-continued
I-9
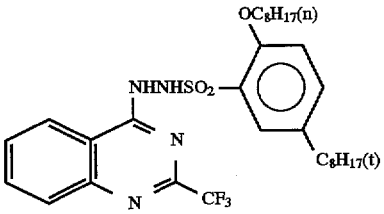
I-10
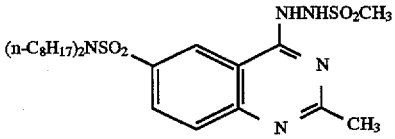
I-11
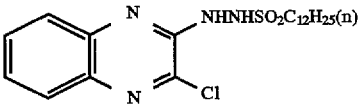
I-12
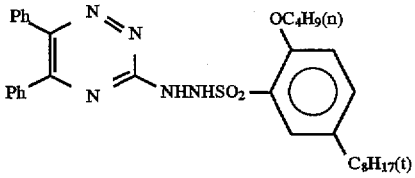
I-13
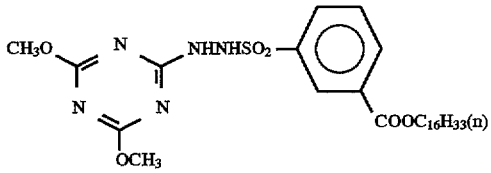
I-14
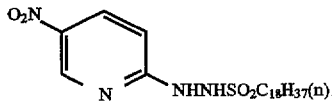
I-15
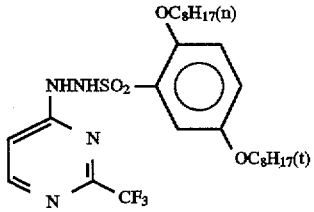
I-16
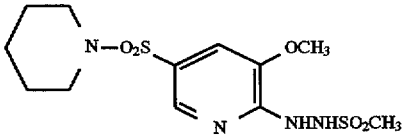
I-17
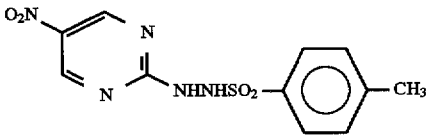

-continued
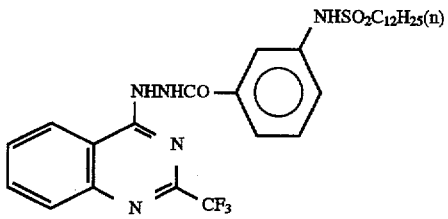
I-18
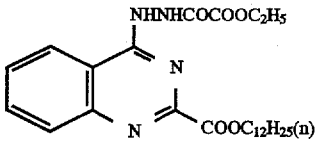
I-19
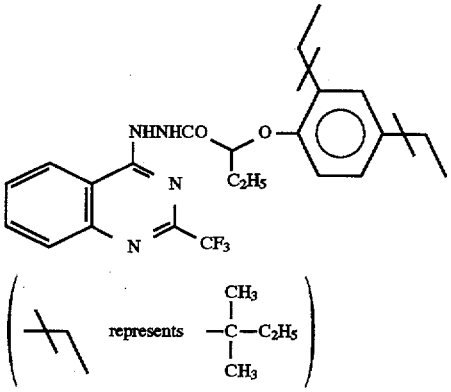
I-20
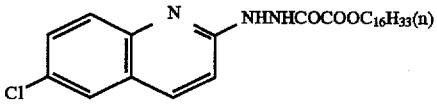
I-21
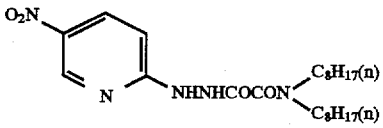
I-22
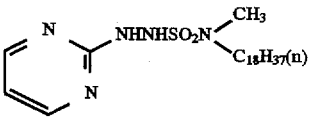
I-23
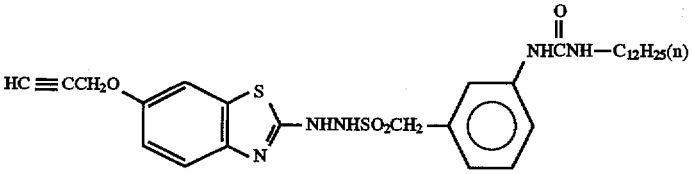
I-24
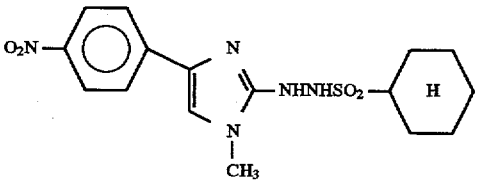
I-25

-continued
I-26
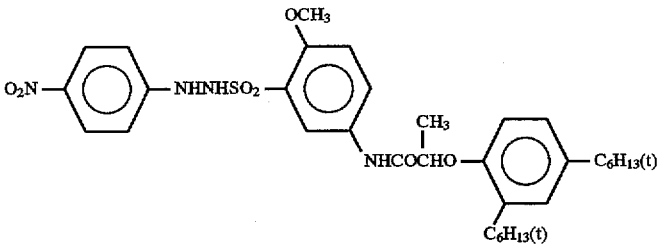
I-27
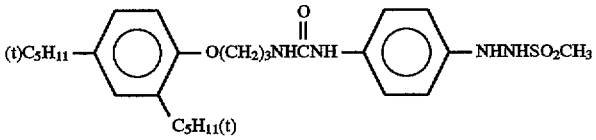
I-28
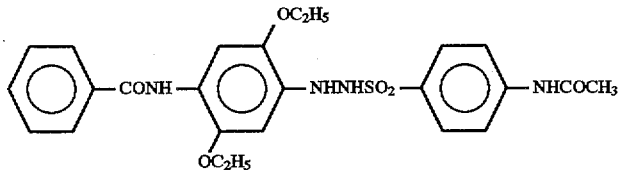
I-29
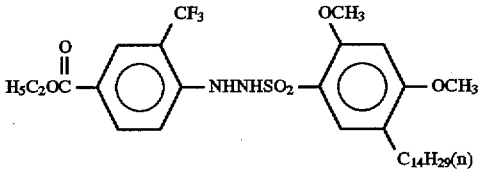
I-30
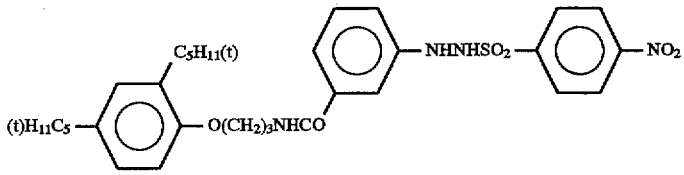
I-31
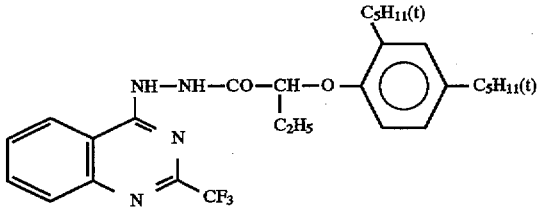
I-32
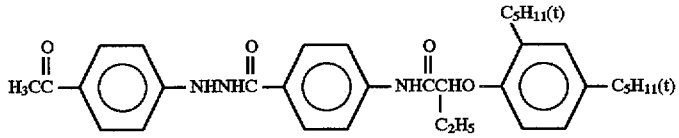
I-33
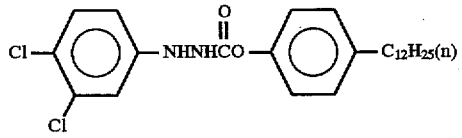
I-34
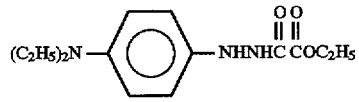

-continued
I-35
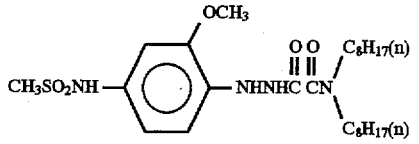
I-36
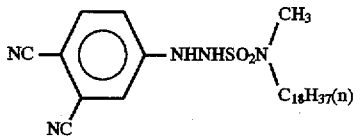
I-37
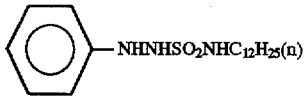
I-38
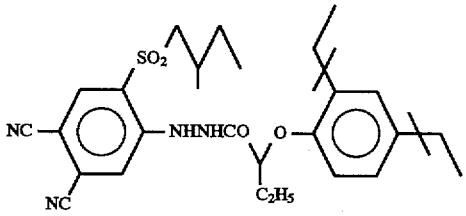
I-39
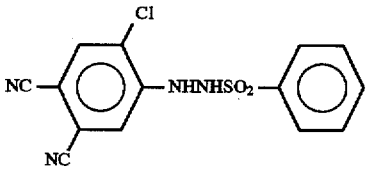
I-40
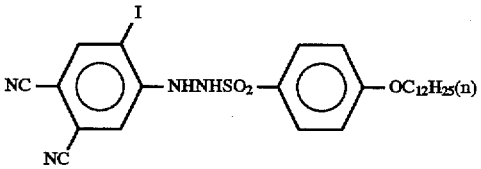
I-41
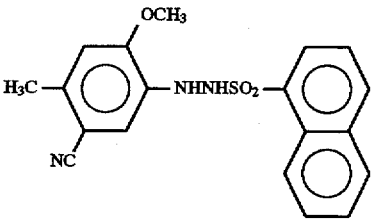
I-42
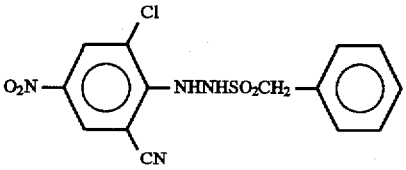
I-43
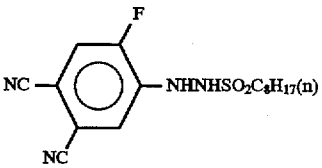

-continued
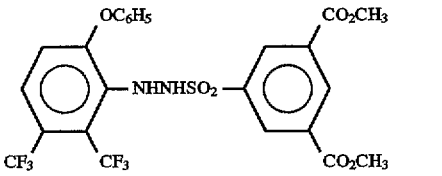
I-44
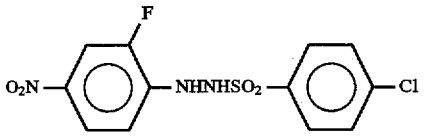
I-45
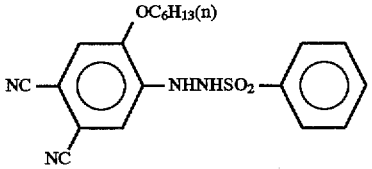
I-46
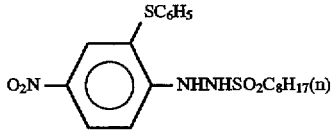
I-47
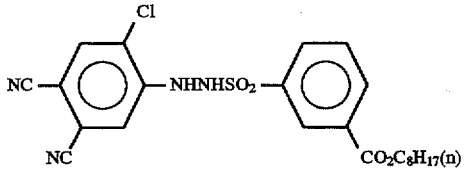
I-48
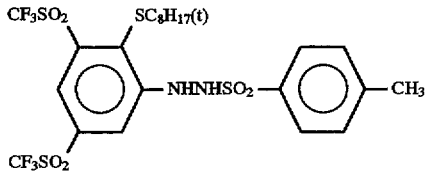
I-49
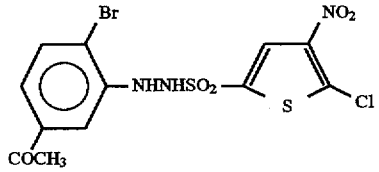
I-50
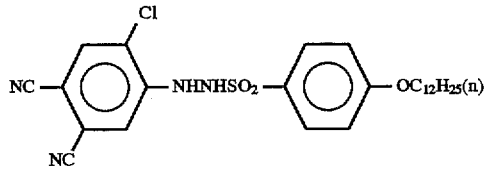
I-51
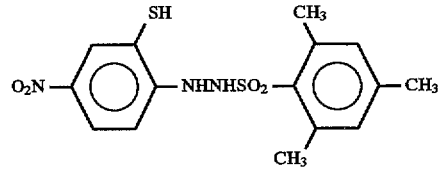
I-52

-continued
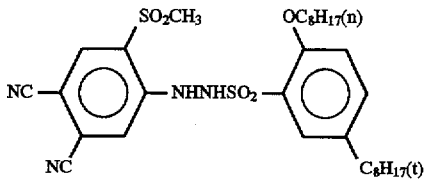
I-53
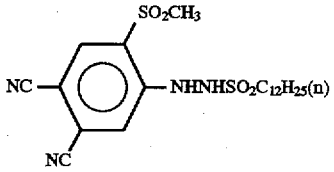
I-54
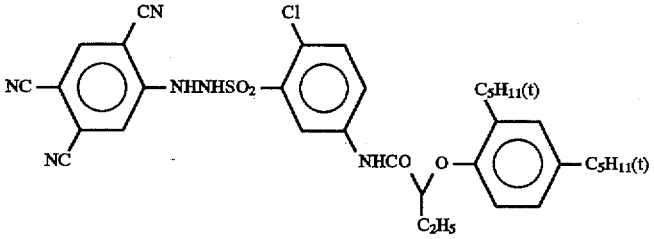
I-55
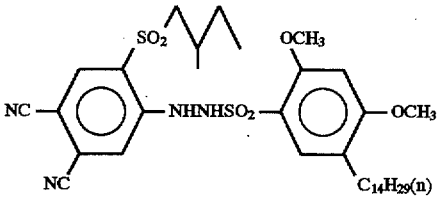
I-56
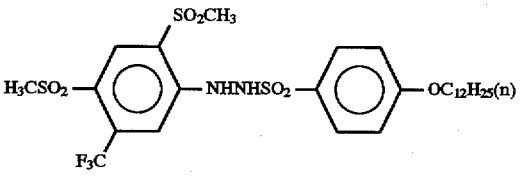
I-57
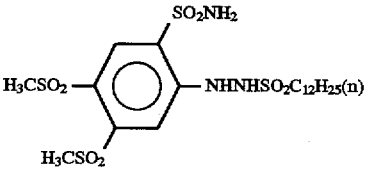
I-58
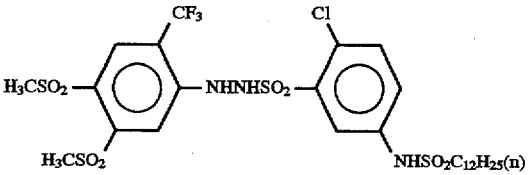
I-59
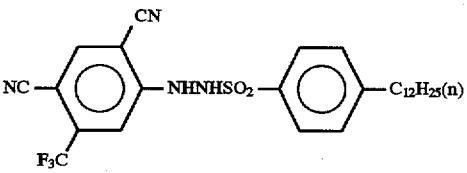
I-60

-continued
I-61
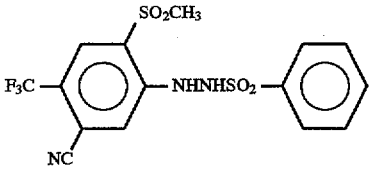
I-62
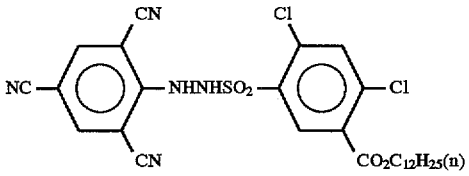
I-63
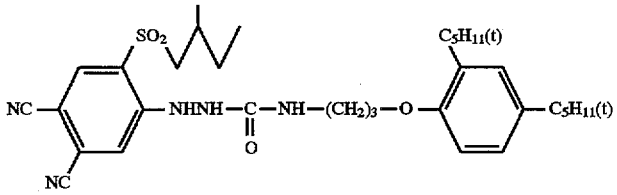
I-64
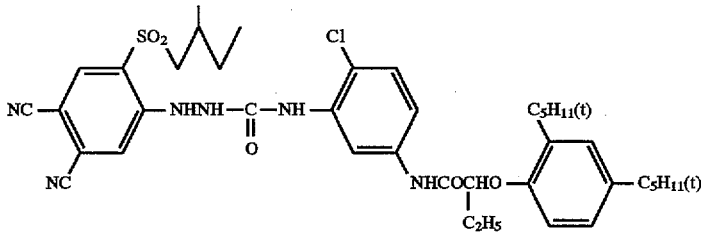
I-65
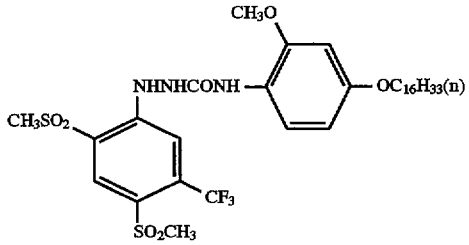
I-66
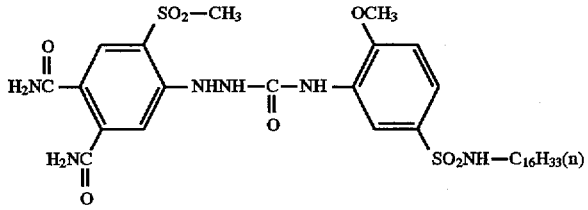
I-67
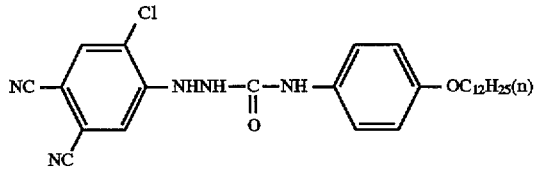

-continued
I-68
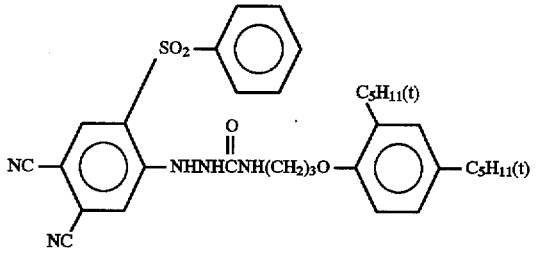
I-69
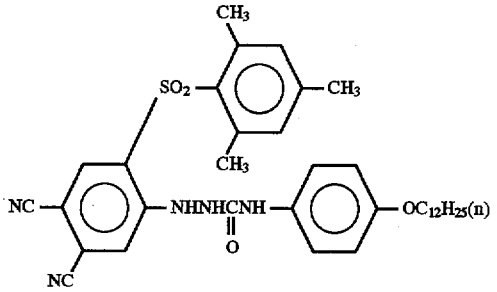
I-70
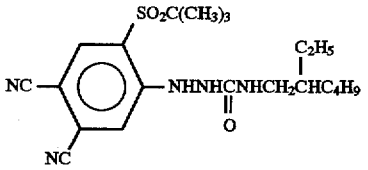
I-71
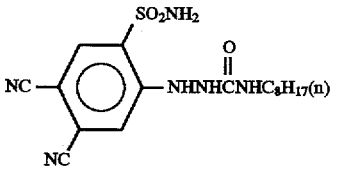
I-72
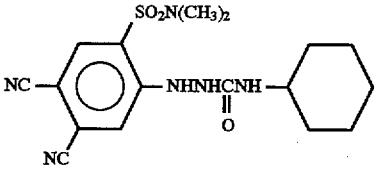
I-73
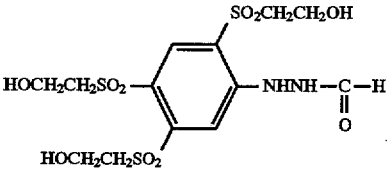
I-74
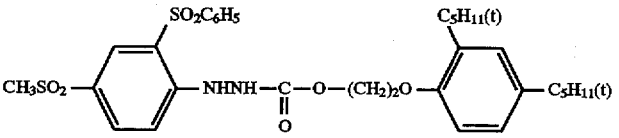
I-75
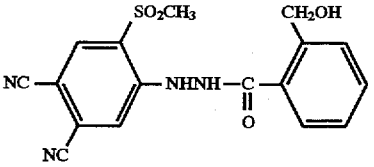

-continued
I-76
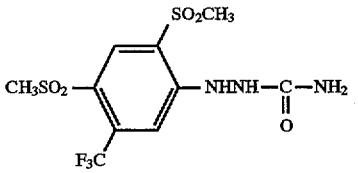
I-77
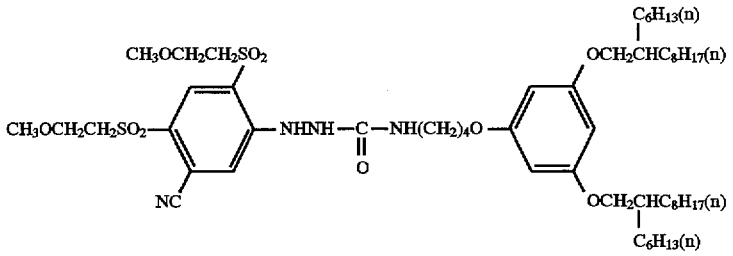
I-78
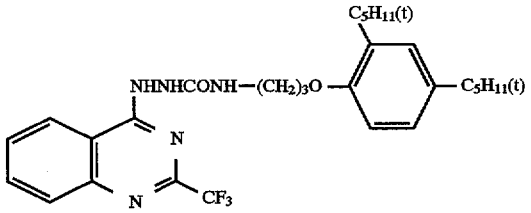
I-79
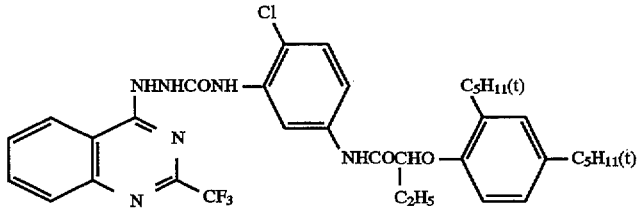
I-80
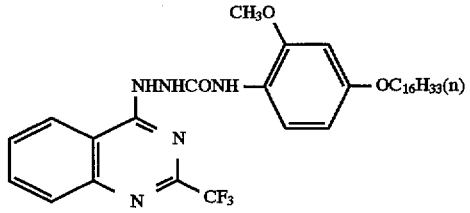
I-81
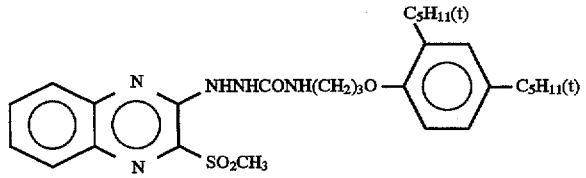
I-82
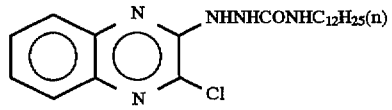
I-83
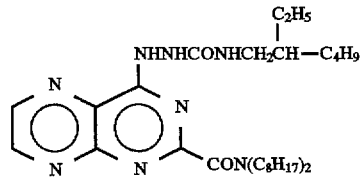

-continued
I-84
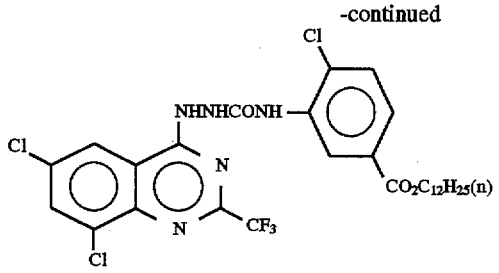
I-85
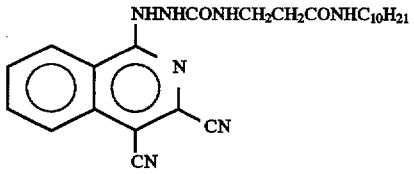
I-86
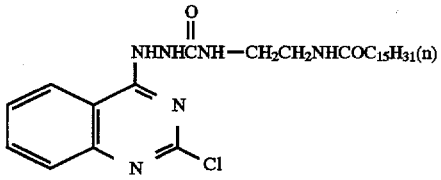
I-87
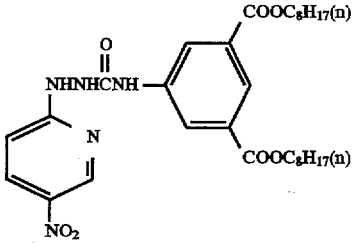
I-88
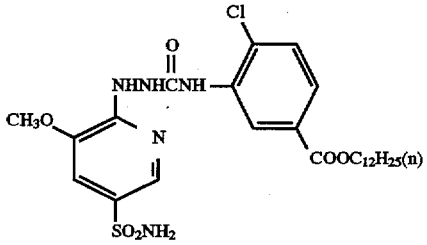
I-89
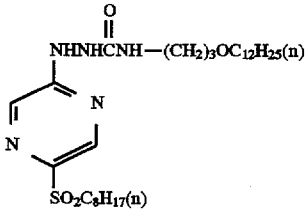
I-90
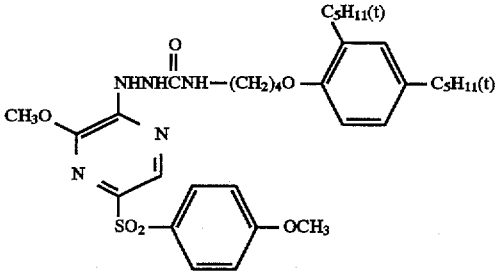

-continued
I-91
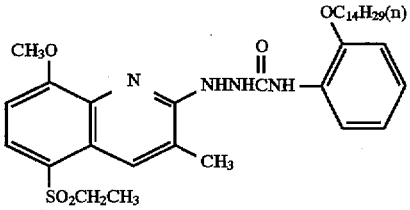
I-92
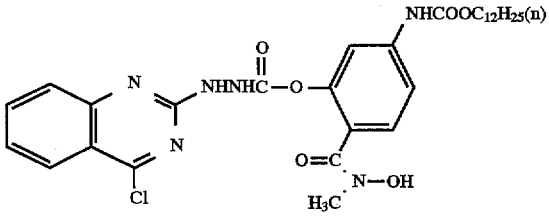
I-93
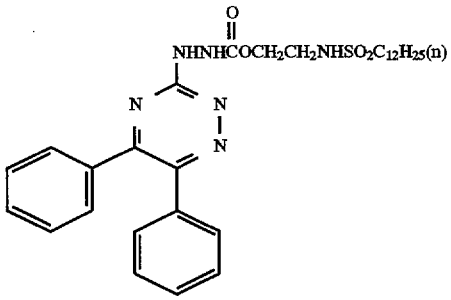
I-94
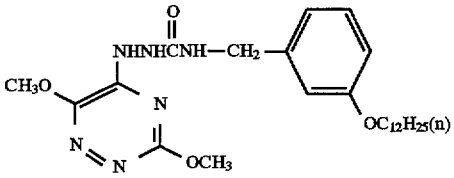
I-95
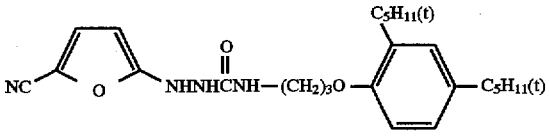
I-96
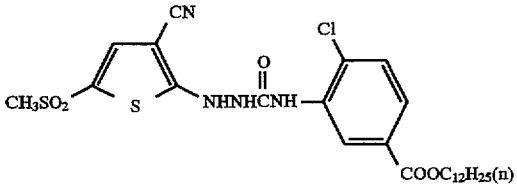
I-97
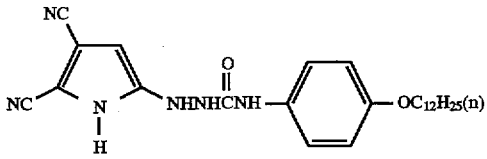
I-98
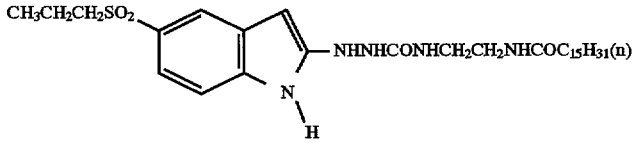

-continued

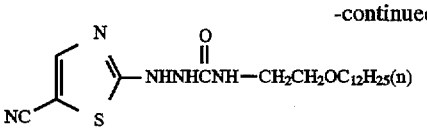

I-99

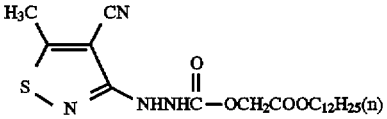

I-100

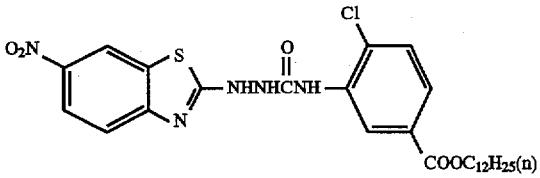

I-101

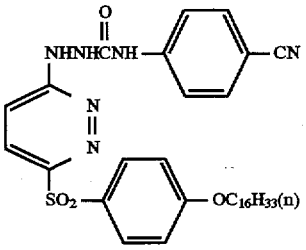

I-102

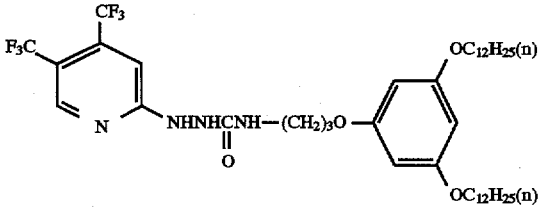

I-103

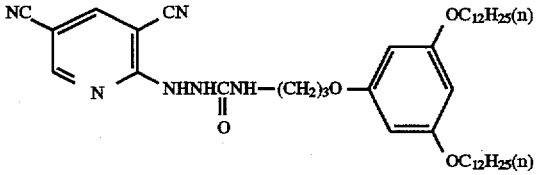

I-104

A part of the compounds represented by formula (I) of the present invention is disclosed, for example, in U.S. Pat. Nos. 2,424,256, 4,481,268, EP-A-565165, and JP-A-61-259249 and can be synthesized according to the methods disclosed therein for the synthesis of other compounds.

In the present invention, a dye-donative compound is a compound (a coupler) which forms a dye upon oxidative coupling reaction with the reducing agent for coloring represented by formula (I). This coupler may be a 4-equivalent coupler or a 2-equivalent coupler, but when the reducing agent for coloring is sulfone hydrazide, a 4-equivalent coupler is preferred. This is because at first, the amino group which is the coupling position of the reducing agent for coloring is protected by a sulfonyl group (substituent X), and if a substituent is present on the coupling position on the coupler site when coupling, the reaction is hindered by steric hindrance, and secondly, because this sulfonyl group is released as sulfinic acid after coupling, the releasable group on the coupling site must be eliminated as a cation, but general 2-equivalent couplers cannot be such a releasable group. Specific examples of 4-equivalent and 2-equivalent couplers are disclosed in detail in T. H. James, *Theory of the Photographic Process,* 4th Ed., pages 291 to 334 and 354 to 361, Macmillan (1977), JP-A-58-12353, JP-A-58-149046, JP-A-58-149047, JP-A-59-11114, JP-A-59-124399, JP-A-59-174835, JP-A-59-231539, JP-A-59-231540, JP-A-60-2951, JP-A-60-14242, JP-A-60-23474 and JP-A-60-66249.

Examples of the couplers which are preferably used in the present invention are enumerated below.

The couplers which are preferably used in the present invention are the compounds having the structures represented by the following formulae (1) to (12). These compounds are generally called active methylene based, pyrazolone based, pyrazoloazole based, phenol based, naphthol based and pyrrolotriazole based couplers, and well known in the art.

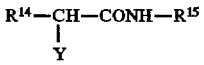

(1)

-continued (2) $R^{14}-CH(Y)-COO-R^{15}$ (3) $R^{14}-CH(Y)-CO-R^{15}$ (4) $R^{14}-CH(Y)-R^{16}$ (5)

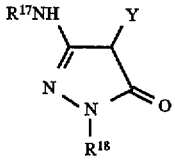

(6)

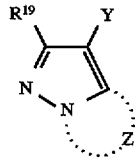

(7)

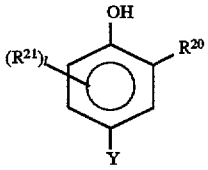

(8)

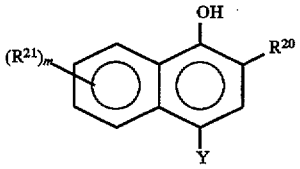

(9)

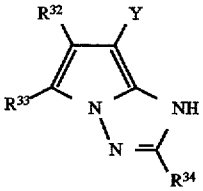

(10)

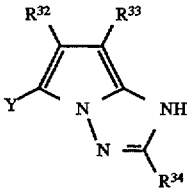

(11)

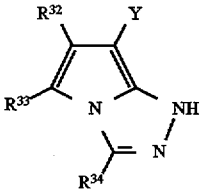

-continued (12)

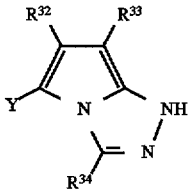

The compounds represented by formulae (1) to (4) are called active methylene based couplers, wherein $R_{14}$ represents an acyl group, a cyano group, a nitro group, an aryl group, a heterocyclic group, an alkoxycarbonyl group, an aryloxycarbonyl group, a carbamoyl group, a sulfamoyl group, an alkylsulfonyl group or an arylsulfonyl group, which may be substituted.

In formulae (1) to (3), $R_{15}$ represents a substituted or unsubstituted alkyl group, a substituted or unsubstituted aryl group or a substituted or unsubstituted heterocyclic group. In formula (4), $R_{16}$ represents a substituted or unsubstituted aryl group or a substituted or unsubstituted heterocyclic group. $R_{14}$, $R_{15}$ and $R_{16}$ may have various substituents, e.g., an alkyl group, an alkenyl group, an alkynyl group, an aryl group, a heterocyclic group, an alkoxyl group, an aryloxy group, a cyano group, a halogen atom, an acylamino group, a sulfonamido group, a carbamoyl group, a sulfamoyl group, an alkoxycarbonyl group, an aryloxycarbonyl group, an alkylamino group, an arylamino group, a hydroxyl group, or a sulfo group. Preferred substituents for $R_{14}$ include an acyl group, a cyano group a carbamoyl group of an alkoxycarbonyl group.

In formulae (1) to (4), Y represents a hydrogen atom or a releasable group upon coupling reaction with the oxidized product of a developing agent. Specific examples of the substituents for Y include a carboxyl group, a formyl group, a halogen atom (e.g., bromine, iodine), a carbamoyl group, a methylene group which has a substituent (such a substituent as an aryl group, a sulfamoyl group, a carbamoyl group, an alkoxyl group, an amino group, a hydroxyl group), an acyl group and a sulfo group. Of these, Y preferably represents a hydrogen atom.

In formulae (1) to (4), $R_{14}$ and $R_{15}$, and $R_{14}$ and $R_{16}$ may be bonded to each other to form a 3- to 7-membered ring.

The compounds represented by formula (5) are called 5-pyrazolone based magenta couplers, and in the formula, $R_{17}$ represents an alkyl group, an aryl group, an acyl group or a carbamoyl group. $R_{18}$ represents a phenyl group, or a phenyl group substituted with at least one of a halogen atom, an alkyl group, a cyano group, an alkoxyl group, an alkoxycarbonyl group and an acylamino group. Y has the same meaning as in formulae (1) to (4).

Of the 5-pyrazolone based magenta couplers represented by formula (5), those in which $R_{17}$ represents an aryl group or an acyl group, $R_{18}$ represents a phenyl group substituted with one or more halogen atoms, and Y represents a hydrogen atom are preferred.

These preferred substituents are described in detail below. $R_{17}$ represents an aryl group such as phenyl, 2-chlorophenyl, 2-methoxyphenyl, 2-chloro-5-tetradecanamidophenyl, 2-chloro-5-(3-octadecenyl-1-succinimido)phenyl, 2-chloro-5-octadecylsulfonamidophenyl or 2-chloro-5-[2-(4-hydroxy-3-t-butylphenoxy)-tetradecanamido]phenyl, or an acyl group such as acetyl, pivaloyl, tetradecanoyl, 2-(2,4-di-t-pentylphenoxy)acetyl, 2-(2,4-di-t-pentylphenoxy) butanoyl, benzoyl, or 3-(2,4-di-t-amylphenoxyacetoazido) benzoyl, and these groups may further have a substituent, e.g., an organic substituent linked via a carbon atom, an oxygen atom, a nitrogen atom or a sulfur atom, or a halogen atom.

$R_{18}$ preferably represents a substituted phenyl such as 2,4,6-trichlorophenyl, 2,5-dichlorophenyl or 2-chlorophenyl.

The compounds represented by formula (6) are called pyrazoloazole based couplers, and in the formula, $R_{19}$ represents a hydrogen atom or a substituent. Z represents a nonmetallic atomic group necessary to form a 5-membered azole ring containing from 2 to 4 nitrogen atoms, and the azole ring may have a substituent (including a condensed ring). Y has the same meaning as in formulae (1) to (4).

Of the pyrazoloazole based couplers represented by formula (6), in view of the absorption characteristics of a colored dye, the imidazo[1,2-b]pyrazoles disclosed in U.S. Pat. No. 4,500,630, the pyrazolo[1,5-b][1,2,4]triazoles disclosed in U.S. Pat. No. 4,540,654, and the pyrazolo[5,1-c]-[1,2,4]triazoles disclosed in U.S. Pat. No. 3,725,067 are preferred and, above all, in view of light fastness, the pyrazolo[1,5-b][1,2,4]triazoles is preferred.

Details of the substituents of the azole ring represented by the substituent $R_{19}$, Y and Z are disclosed, for example, in U.S. Pat. No. 4,540,654, the second column, line 41 to the eighth column, line 27. Preferred examples include the pyrazoloazole coupler in which a branched alkyl group is directly bonded to the 2-, 3- or 6-position of the pyrazolotriazole group as disclosed in JP-A-61-65245, the pyrazoloazole coupler having a sulfonamido group in the molecule disclosed in JP-A-61-65245, the pyrazoloazole coupler having an alkoxyphenylsulfonamido ballast group as disclosed in JP-A-61-147254, the pyrazolotriazole coupler having an alkoxy group or an aryloxy group at the 6-position as disclosed in JP-A-62-209457 and JP-A-63-307453, and the pyrazolotriazole coupler having a carbonamido group in the molecule as disclosed in JP-A-2-201443.

The compounds represented by formulae (7) and (8) are called phenol based couplers and naphthol based couplers, respectively, and in the formulae $R_{20}$ represents a hydrogen atom or a group selected from $—CONHR_{22}—$, $—SO_2NR_{22}R_{23}$, $—NHSO_2R_{22}$, $—NHCOR_{22}$, $—NHCONR_{22}R_{23}$, and $—NHSO_2NR_{22}R_{23}$, wherein $R_{22}$ and $R_{23}$ represent a hydrogen atom or a substituent. In formulae (7) and (8), $R_{21}$ represents a substituent, l represents an integer of 0, 1 or 2, and m represents an integer of 0, 1, 2, 3 or 4. Y has the same meaning as in formulae (1) to (4). The substituents for $R_{21}$ to $R_{23}$ are the same as those described as the substituents for $R_{14}$ to $R_{16}$.

As the preferred examples of the phenol based couplers represented by formula (7), there can be cited the 2-alkylamino-5-alkylphenol based couplers disclosed in U.S. Pat. Nos. 2,369,929, 2,801,171, 2,772,162, 2,895,826 and 3,772,002; the 2,5-diacylaminophenol based couplers disclosed in U.S. Pat. Nos. 2,772,162, 3,758,308, 4,126,396, 4,334,011, 4,327,173, West German Patent 3,329,729, and JP-A-59-166956; and the 2-phenylureido-5-acylaminophenol based couplers disclosed in U.S. Pat. Nos. 3,446,622, 4,333,999, 4,451,559, and 4,427,767.

As the preferred examples of the naphthol based couplers represented by formula (8), there can be cited the 2-carbamoyl-1-naphthol based couplers disclosed in U.S. Pat. Nos. 2,474,293, 4,052,212, 4,146,396, 4,228,233, and 4,296,200; and the 2-carbamoyl-5-amido-1-naphthol based couplers disclosed in U.S. Pat. Nos. 4,690,889.

The compounds represented by formulae (9) to (12) are called pyrrolotriazole couplers, and in the formulae, $R_{32}$, $R_{33}$ and $R_{34}$ represent a hydrogen atom or a substituent. Y has the same meaning as in formulae (1) to (4). The substituents for $R_{32}$, $R_{33}$ and $R_{34}$ are the same as those described as the substituents for $R_{14}$ to $R_{16}$. As the preferred examples of the pyrrolotriazole based couplers represented by formulae (9) to (12), there can be cited the couplers as disclosed in EP-A-488248, EP-A-491197 and EP-A-545300, in which at least one of $R_{32}$ and $R_{33}$ represents an electron attractive group.

In addition to the above, couplers having the structures such as condensed ring phenol, imidazole, pyrrole, 3-hydroxypyridine, active methylene, methine, a 5,5-condensed heterocyclic ring, and a 5,6-condensed heterocyclic ring can be used.

As the condensed phenol based couplers, the couplers disclosed in U.S. Pat. Nos. 4,327,173, 4,564,586 and 4,904,575 can be used.

As the imidazole based couplers, the couplers disclosed in U.S. Pat. Nos. 4,818,672 and 5,051,347 can be used.

As the pyrrole based couplers, the couplers disclosed in JP-A-4-188137 and JP-A-4-190347 can be used.

As the 3-hydroxypyridine based couplers, the couplers disclosed in JP-A-1-315736 can be used.

As the active methylene and methine type couplers, the couplers disclosed in U.S. Pat. Nos. 5,104,783 and 5,162,196 can be used.

As the 5,5-condensed heterocyclic ring based couplers, the pyrrolopyrazole based couplers disclosed in U.S. Pat. No. 5,164,289, and the pyrroloimidazole based couplers disclosed in JP-A-4-174429 can be used.

As the 5,6-condensed heterocyclic ring based couplers, the pyrazolopyrimidine based couplers disclosed in U.S. Pat. No. 4,950,585, and the pyrrolotriazine based couplers disclosed in EP 556700 can be used.

As well as the above couplers, the couplers disclosed in West German Patents 3,819,051A, 3,823,049A, U.S. Pat. Nos. 4,840,883, 5,024,930, 5,051,347, 4,481,268, EP-A-304856, EP 329036, EP-A-354549, EP-A-374781, EP-A-379110, EP-A-386930, JP-A-63-141055, JP-A-64-32260, JP-A-64-32261, JP-A-2-297547, JP-A-2-44340, JP-A-2-110555, JP-A-3-7938, JP-A-3-160440, JP-A-3-172839, JP-A-4-172447, JP-A-4-179949, JP-A-4-182645, JP-A-4-184437, JP-A-4-188138, JP-A-4-188139, JP-A-4-194847, JP-A-4-204532, JP-A-4-204731 and JP-A-4-204732 can also be used.

Specific examples of the couplers which can be used in the present invention are shown below, but the present invention is not limited thereto.

C-1

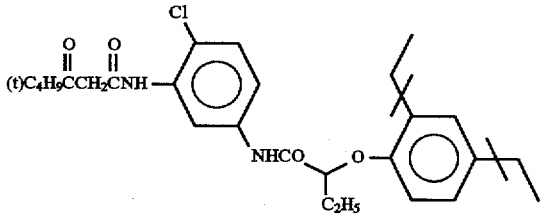

-continued
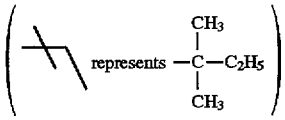
C-2
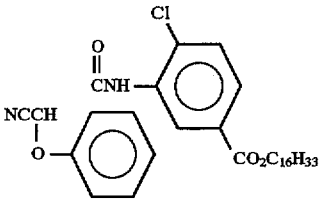
C-3
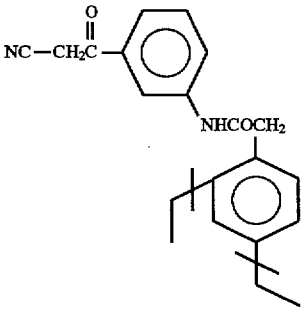
C-4
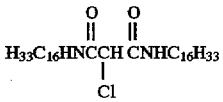
C-5
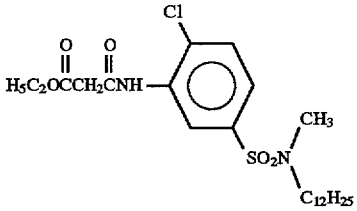
C-6
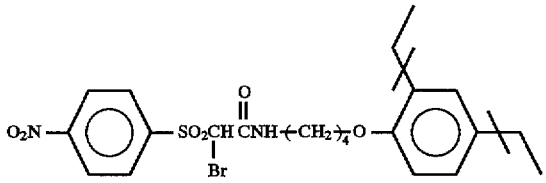
C-7
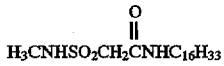
C-8
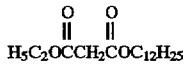
C-9
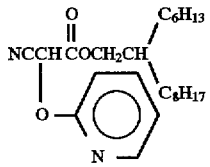
C-10
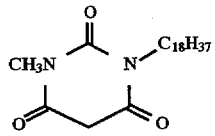

-continued
C-11
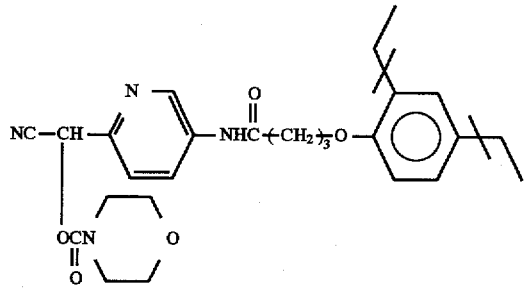
C-12
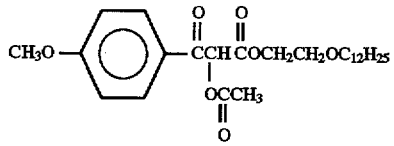
C-13
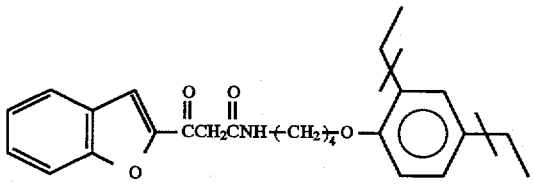
C-14
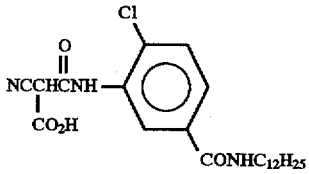
C-15
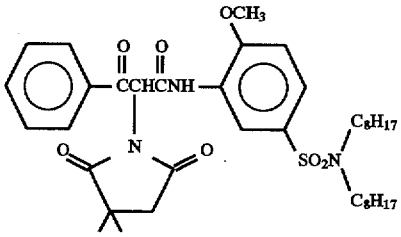
C-16
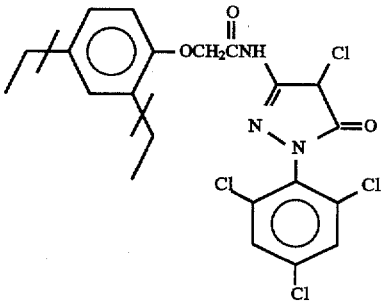

-continued
C-17
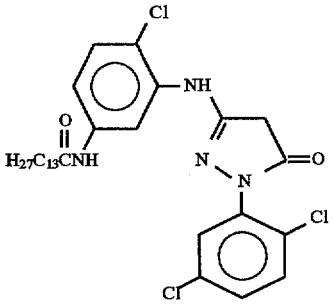
C-18
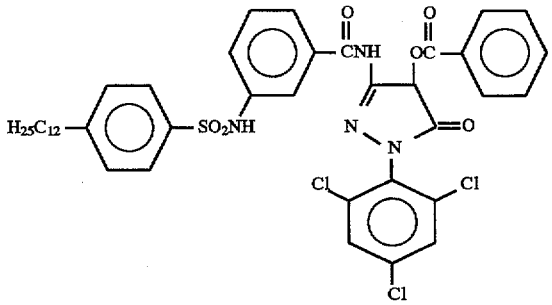
C-19
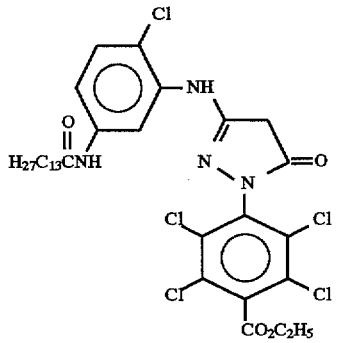
C-20
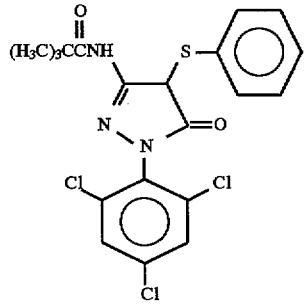
C-21
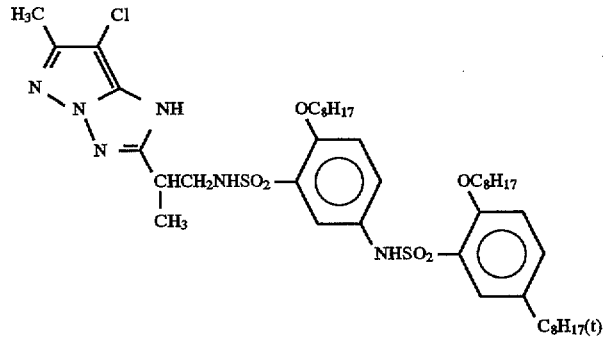

-continued
C-22
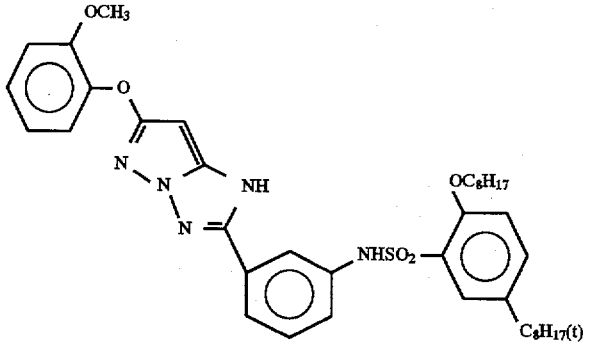
C-23
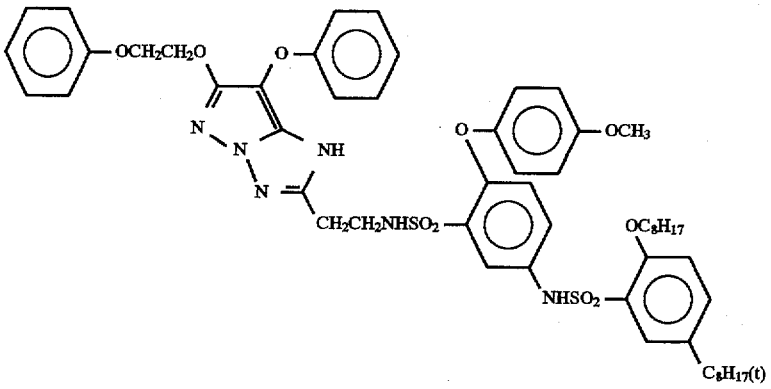
C-24
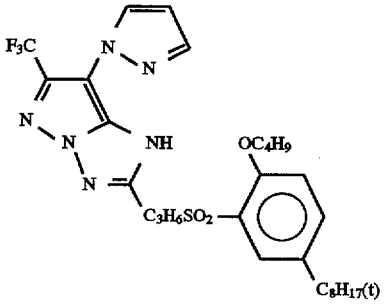
C-25
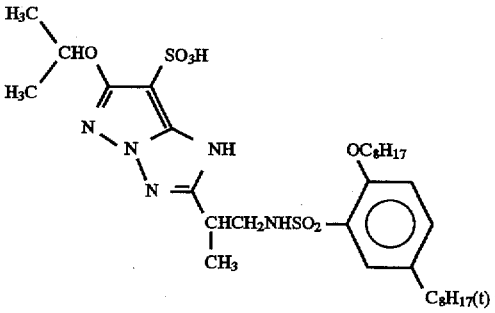
C-26
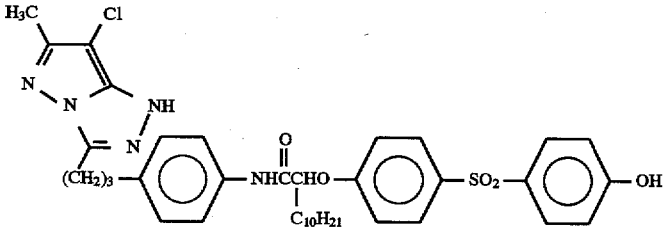

-continued
C-27
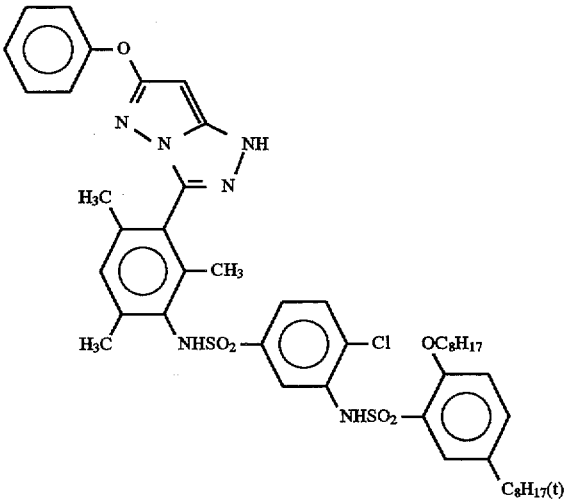
C-28
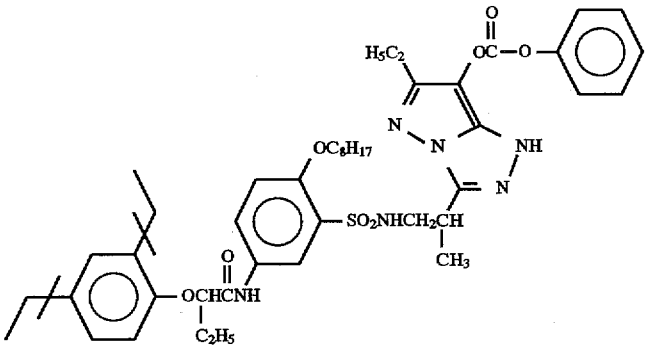
C-29
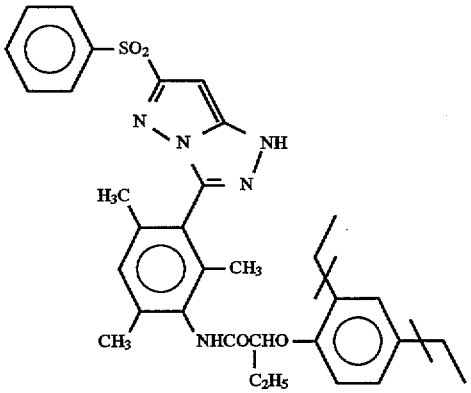
C-30
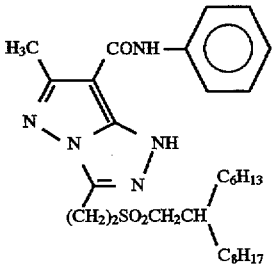

-continued
C-31
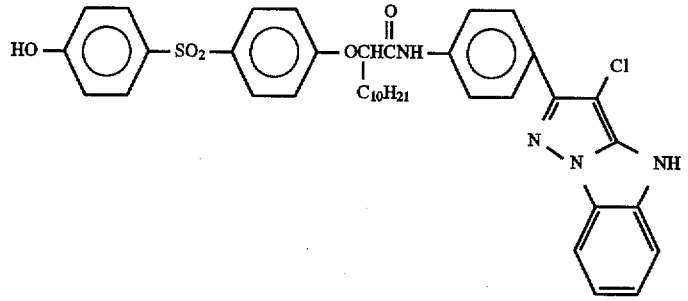
C-32
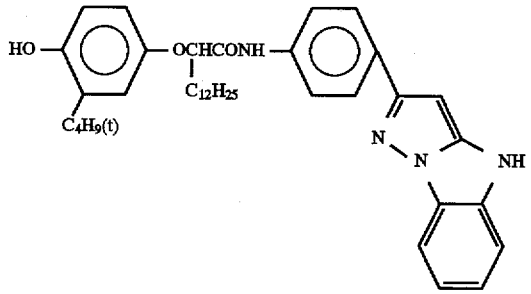
C-33
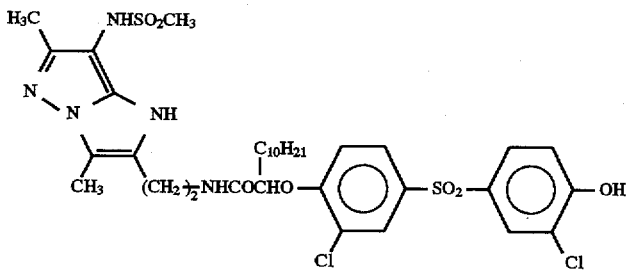
C-34
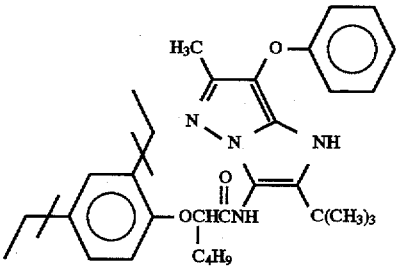
C-35
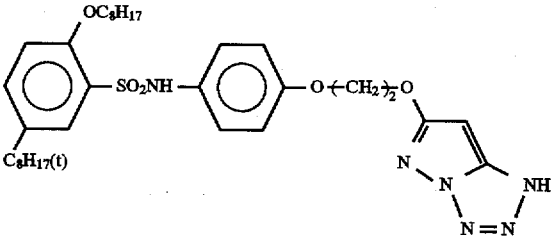
C-36
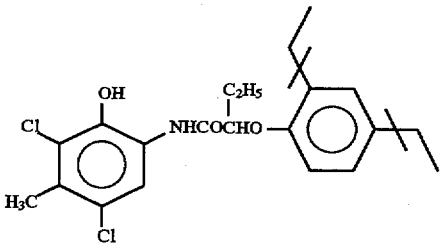

-continued
C-37
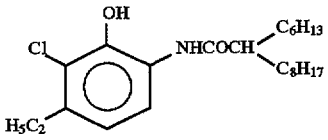
C-38
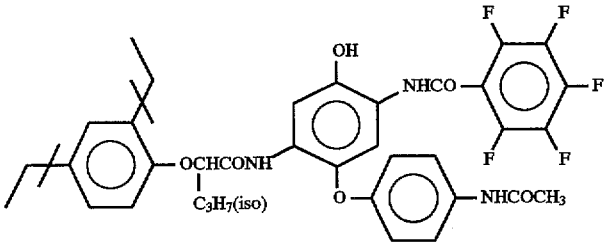
C-39
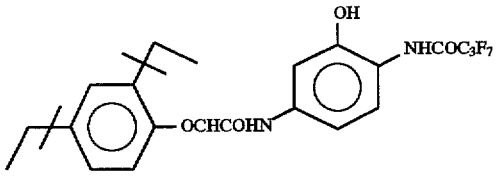
C-40
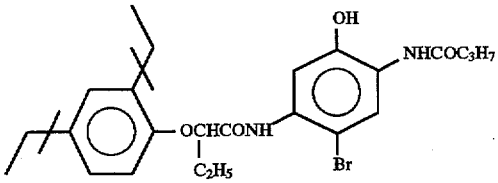
C-41
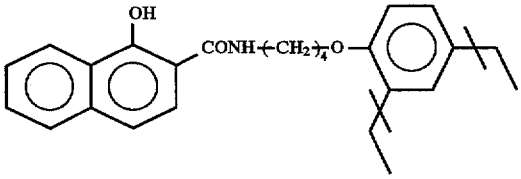
C-42
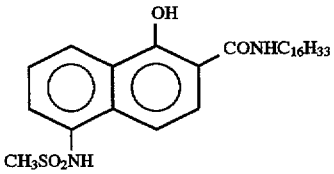
C-43
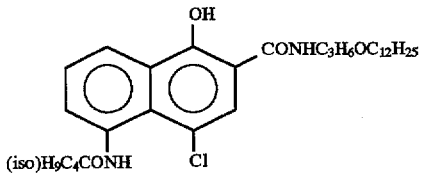
C-44
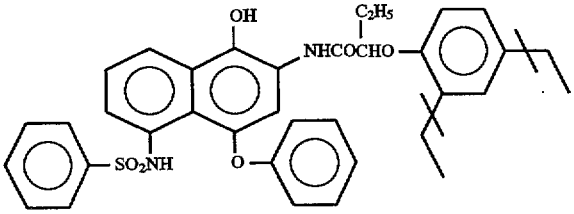

-continued
C-45
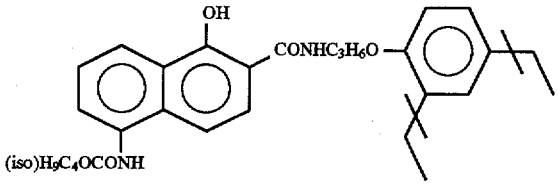
C-46
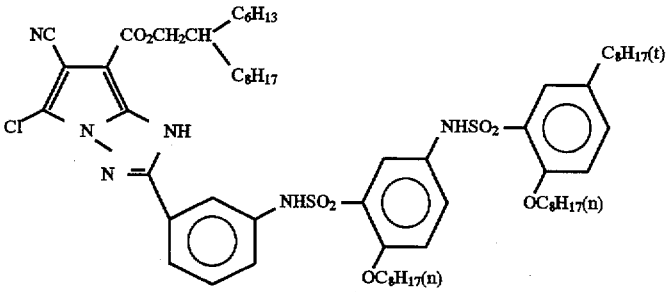
C-47
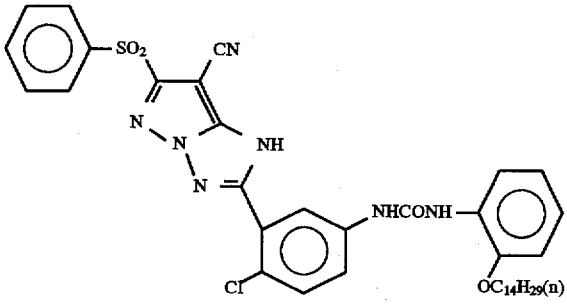
C-48
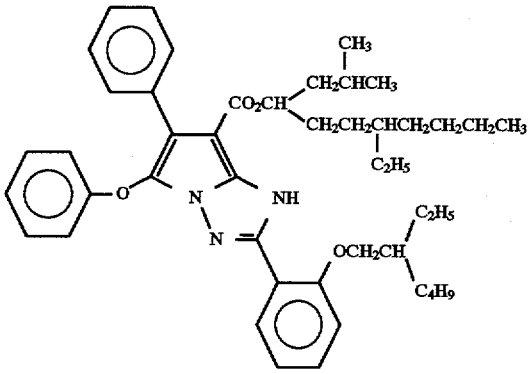
C-49
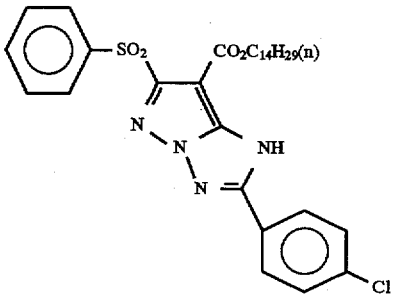

-continued
C-50
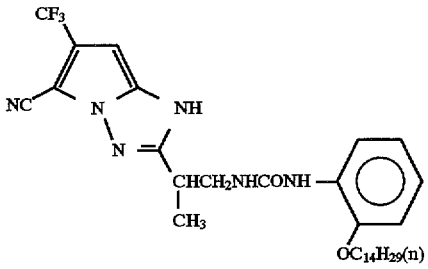
C-51
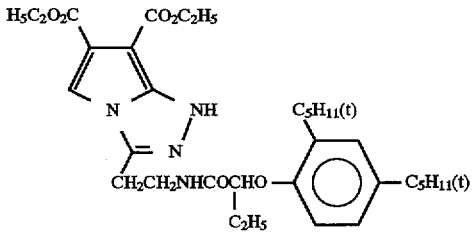
C-52
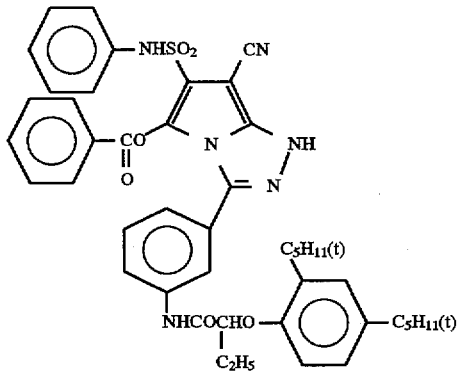
C-53
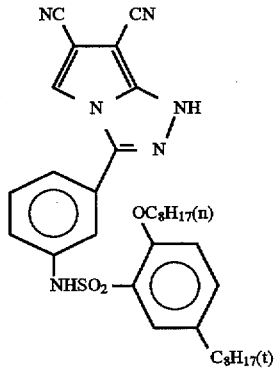

-continued
C-54
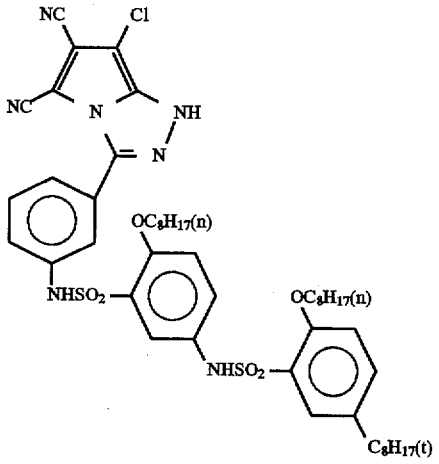
C-55
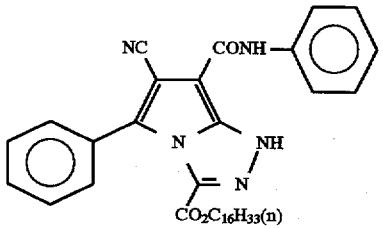
C-56
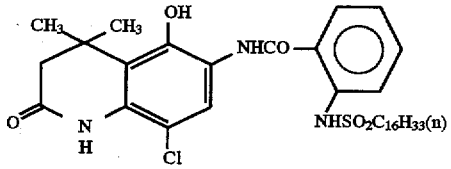
C-57
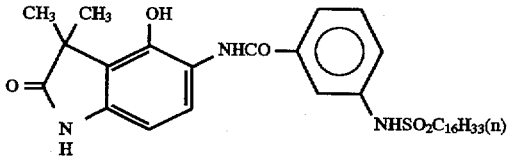
C-58
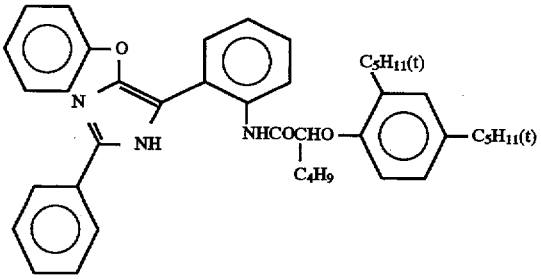
C-59
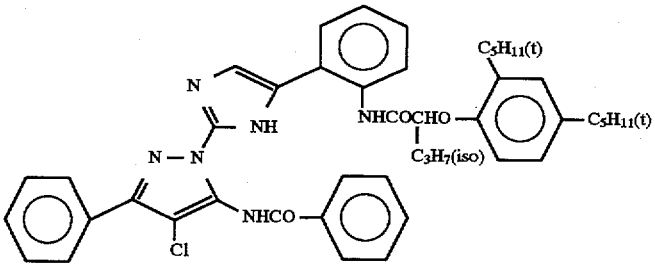

-continued
C-60
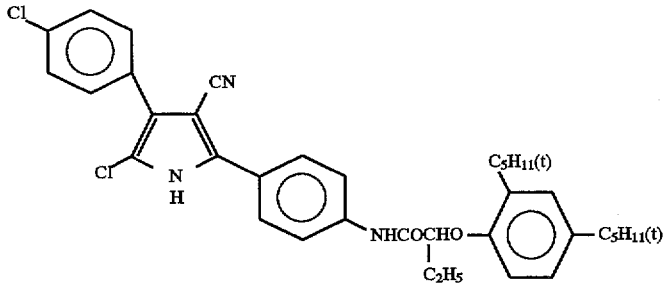
C-61
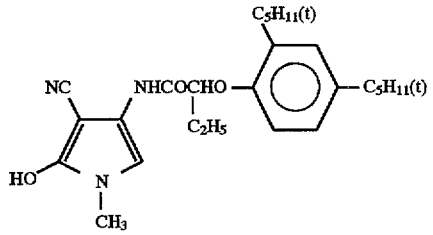
C-62
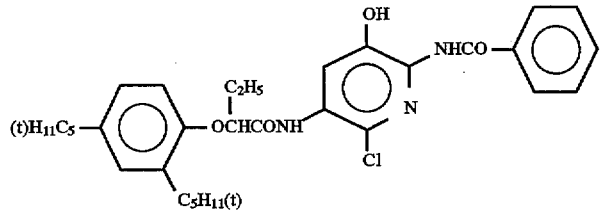
C-63
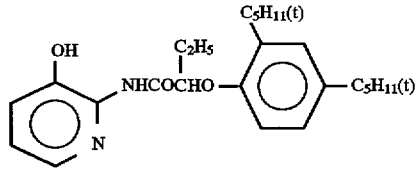
C-64
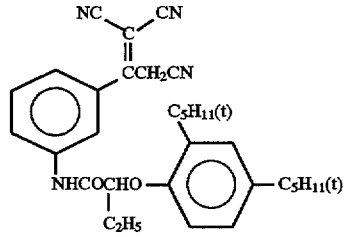
C-65
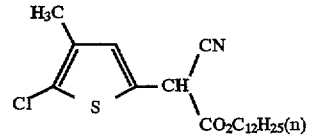
C-66
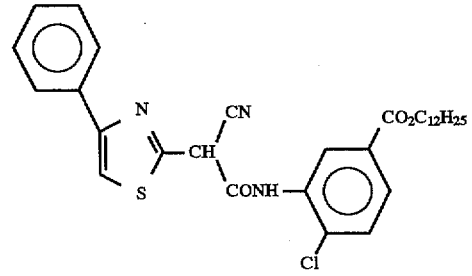

-continued
C-67
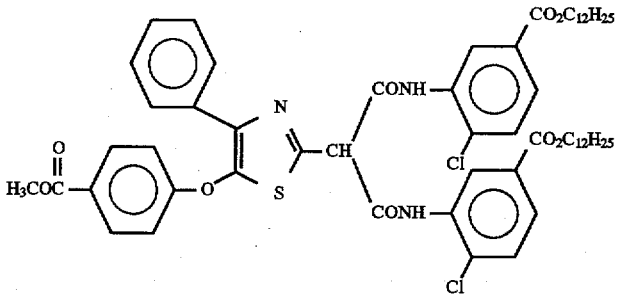
C-68
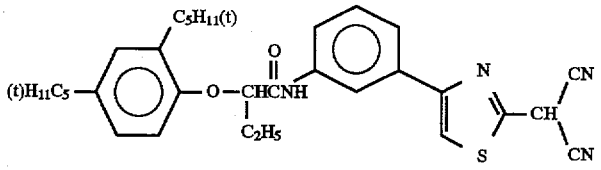
C-69
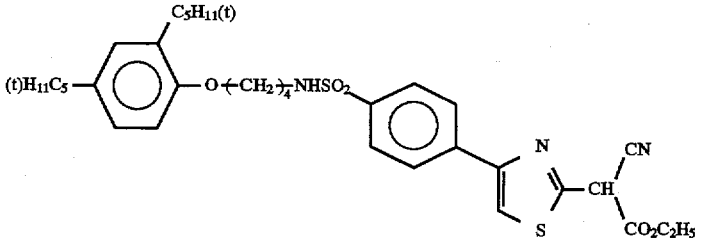
C-70
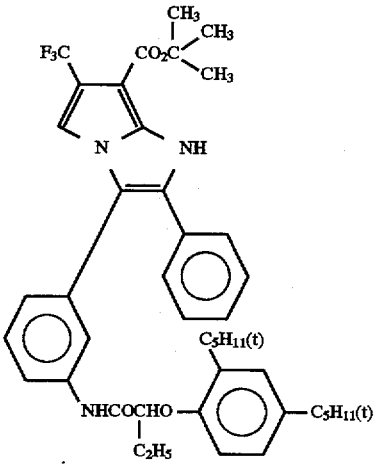
C-71
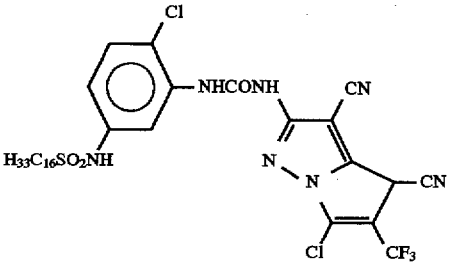

-continued

C-72

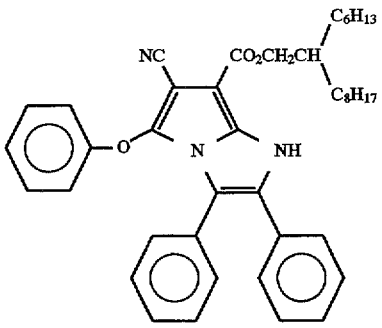

C-73

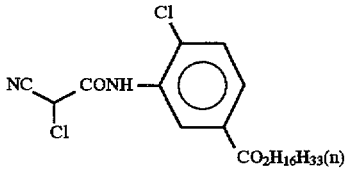

C-74

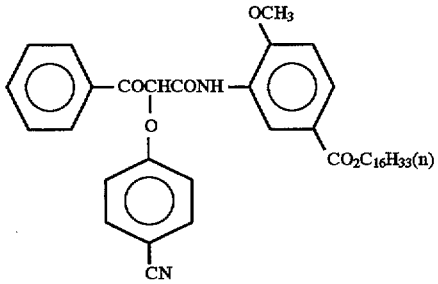

C-75

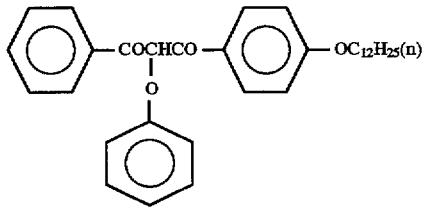

C-76

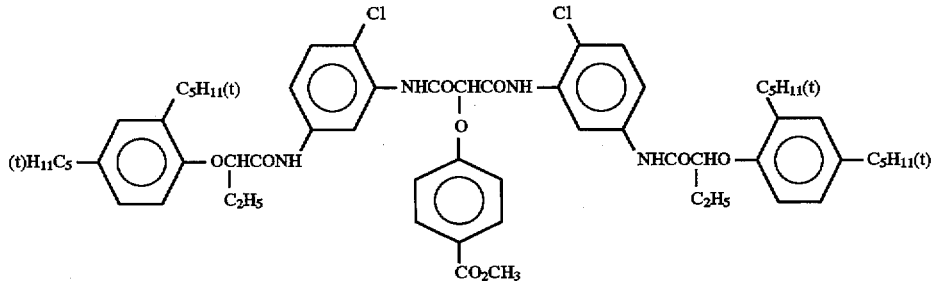

C-77

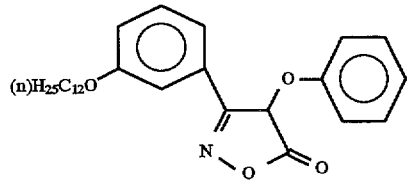

The reducing agent for coloring of the present invention is preferably used, for obtaining sufficient color density, in an amount of 0.01 mmol/$m^2$ to 10 mmol/$m^2$, more preferably from 0.05 mmol/$m^2$ to 5 mmol/$m^2$, and particularly preferably from 0.1 mmol/$m^2$ to 1 mmol/$m^2$, per one coloring layer.

The amount of the coupler in the coloring layer in which the reducing agent for coloring of the present invention is used is preferably from 0.05 to 20 times, more preferably from 0.1 to 10 times, and particularly preferably from 0.2 to 5 times, of the reducing agent for coloring in terms of mol.

The reducing agent for coloring of the present invention and the coupler are preferably included in lipophilic fine grains to be dispersed in a hydrophilic colloid layer. Lipophilic fine grains generally comprise a high boiling point organic solvent, but not essential.

A high boiling point organic solvent for photographic additives such as the reducing agent for coloring of the present invention, cyan, magenta and yellow couplers is a compound having a melting point of 100° C. or less and a boiling point of 140° C. or more and water-immiscible, and any solvents in which these additives are soluble can be used. The melting point of the high boiling point organic solvent is preferably 80° C. or less. The boiling point of the high boiling point organic solvent is preferably 160° C. or more, more preferably 170° C. or more.

Details of these high boiling point organic solvents are disclosed in JP-A-62-215272, from page 137, right lower column to page 144, right upper column.

Further, the reducing agent for coloring, cyan, magenta and yellow couplers can be used by impregnating into a loadable latex polymer (e.g., those disclosed in U.S. Pat. No. 4,203,716) in the presence or absence of the above high boiling point organic solvent, or by dissolving with a water-insoluble and organic solvent-soluble polymer and can be emulsified dispersed in a hydrophilic colloid aqueous solution.

Preferably the homopolymers or copolymers disclosed in U.S. Pat. No. 4,857,449, from 7th column to 15th column, or WO 88/00723, from pages 12 to 30 are used, and the use of methacrylate based or acrylamide based polymer, in particular, acrylamide based polymer, is more preferred in view of the color image stability.

When the reducing agent for coloring represented by formula (I) and a coupler are incorporated into the same layer, stain is generated due to dye formation by the storage of the unprocessed material for a long period of time. This stain due to dye formation is not generated when the reducing agent for coloring represented by formula (I) or a coupler is used singly, and this is generated only when the reducing agent for coloring and a coupler is used in the same layer. This stain can be largely reduced with suppressing the film pH 6.5 or less. Further, the system in which images can be obtained by oxidative coupling reaction of the reducing agent for coloring of the present invention with a coupler which are included in a photographic material is rapid in development progress and super rapid processing becomes feasible compared with the conventional system in which images are obtained by the coupling reaction of a p-phenylenediamine derivative with a coupler in a processing solution. However, when the film pH is suppressed 3 or less, the initial development progress delays, and the advantage of the photographic material of the present invention of being applicable to rapid processing cannot be put to practical use. Accordingly, in the present invention, the film pH is 6.5 or less from the viewpoint of reducing stain but it is preferably from 3 to 6.5 in view of development progress, more preferably from 3 to 6, and particularly preferably from 4 to 5.5.

"The film pH of the silver halide color photographic material of the present invention" used herein means the pH of all the photographic constitutional layers obtained by coating a coating solution on a support, therefore, the film pH does not necessarily coincide with the pH of the coating solution. The film pH can be measured according to the following method disclosed in JP-A-61-245153. That is, (1) 0.05 cc of pure water is dripped on the surface of a photographic material on which a silver halide emulsion is coated, then (2) after leaving it as it is for 3 minutes, the film pH is measured using a film pH measuring electrode (GS-165F manufactured by Toa Denpa Co.). The film pH can be adjusted using acid (e.g., sulfuric acid, citric acid) or alkali (e.g., sodium hydroxide, potassium hydroxide). There is no limitation of addition method of these acid or alkali, but it is easy to conduct the adjustment during preparation of a coating solution. Further, acid or alkali may be added to any coating solution of photographic constitutional layers, and may be added to a single layer or a plurality of layers.

There is no particular limitation on the average grain size of the lipophilic fine grains containing the reducing agent for coloring of the present invention, but when the film pH is within the range of the present invention, if the average grain size is 0.3 μm or less, generation of stain with the long term storage can be improved. Accordingly, the average grain size of the lipophilic fine grains is preferably from 0.05 μm to 0.3 μm, more preferably from 0.05 μm to 0.2 μm.

In general, the average grain size of the lipophilic fine grains can be reduced by various methods such as the selection of the kinds of surfactants, increasing the amount of surfactants, increasing the viscosity of a hydrophilic colloid solution, reducing the viscosity of the lipophilic organic layers by the combined use of a low boiling point organic solvent or the like, heightening a shearing force such as increasing revolution of stirring blades of an emulsifying apparatus, or lengthening the emulsification time.

The grain size of lipophilic fine grains can be measured using, for example, a device such as a Nanosizer manufactured by Coalter Co., England.

The silver halide grains for use in the present invention include silver bromide, silver chloride, silver iodide, silver chlorobromide, silver chloroiodide, silver iodobromide and silver chloroiodobromide. Other silver salt, for example, silver thiocyanate, silver sulfide, silver selenide, silver carbonate, silver phosphate, or organic acid silver salt may be contained as separate grains or as a part of silver halide grains. When speedup of development and desilvering (bleaching, fixing and bleach-fixing) processes is desired, silver halide grains of a high silver chloride content is preferably used. Further, when a moderate development inhibition is desired, it is preferred to contain silver iodide. The desired content of silver iodide is varied according to the kinds of photographic materials. For example, in the case of photographic materials for X-ray, from 0.1 to 15 mol %, in graphic arts and micro photographic materials, from 0.1 to 5 mol % are respectively preferred ranges. In photographic materials for photographing represented by color negative films, silver halide grains preferably contain from 1 to 30 mol % of silver iodide, more preferably from 5 to 20 mol %, and particularly preferably from 8 to 15 mol %. Incorporation of silver chloride into silver iodobromide grains is preferred to alleviate lattice distortion.

On the other hand, photographic materials for printing represented by a color paper which require rapid and large amount of processing does not preferably contain silver iodide, or if contain, 1 mol % or less is preferred. An infrared-sensitive photographic material sometimes preferably contain about 3 mol % or less for the stability of sensitivity of the photogdraphic material.

In a photographic material for printing, pure silver chloride emulsion or high silver chloride emulsion comprising 95 mol % or more of silver chloride and the remainder of silver bromide (silver iodide is 1 mol % or less) is preferably used.

The silver halide emulsion of the present invention preferably has halide composition distribution or structure within the grains. Representative examples are the core/shell type grains the surface and the inside of which have different halide compositions or the double structure grains as disclosed in JP-B-43-13162 (the term "JP-B" as used herein refers to an "examined Japanese patent publication"), JP-A-61-215540, JP-A-60-222845, JP-A-60-143331 and JP-A-61-75337. Also, not a mere double structure but the triple structure as disclosed in JP-A-60-2 22844 or more multilayer structure can be used, or the silver halide having different composition can be laminated on the surface of double structural grains.

To obtain grains having the halide structure within grains, grains having not only surrounding structure but also a so-called conjugated structure can be prepared. Such grains are disclosed in JP-A-59-133540, JP-A-58-108526, EP-A-199290, JP-B-58-24772 and JP-A-59-16254. It is preferred that guest crystal having different halide composition from the composition of the host crystal is formed in conjugation with the edges, corners or faces of the host crystal. Such conjucational crystal can be formed on the host crystal of a uniform halide composition or a core/shell type structure.

In the conjugated structure, combination of silver halide with silver halide is of course possible but silver salt compounds not having a rock salt structure such as silver thiocyanate and silver carbonate can be combined with silver halide to form conjugated structure. Further, a non-silver salt compound such as lead oxide can also be used if conjugated structure can be formed.

In the case of silver iodobromide grains and the like having such a structure, it is preferred that the core part has higher silver iodide content than the shell part. On the contrary, in some case, it is preferred that the core part has lower silver iodide content than the shell part. Similarly, with respect to grains having conjugated structure, the host crystal may have high silver iodide content and the guest crystal may have relatively low silver iodide content, or the host crystal may have low silver iodide content and the guest crystal may have high silver iodide content. Further, the boundary between different halide compositions of grains having such a structure may be clear or may be unclear. Also, the boundary may be made of a continuous change in composition positively.

In the case of mixed crystals of two or more silver halide grains or grains having a structure, it is important to control halide composition distribution among grains. The method of measuring halide composition distribution is disclosed in JP-A-60-254032. It is desirable that the distribution of halide compositions among grains is uniform. In particular, emulsion of high uniformity having deviation coefficient of 20% or less is preferred. Another preferred mode is that there is a correlation between grain size and halide composition. As an example, there is a case in which there is a correlation such that the larger the grain size, the higher is the iodide content or, on the contrary, the smaller the grain size, the smaller is the iodide content. According to the purpose, the reverse correlation or the correlation in other halide composition can be selected. For this purpose, it is preferred that two or more emulsions having different compositions are mixed.

It is important to control the halide composition of a neighborhood of a grain surface. Increasing the content of silver iodide or silver chloride of a neighborhood of a grain surface changes the adsorbing ability of a dye and developing speed, therefore, can be selected according to the purpose. When the halide composition of a neighborhood of a grain surface is changed, either structure of surrounding the entire grain or of attaching to only a part of grain can be selected. For example, there are cases of changing the halide composition of only one plane of tetradecahedral grain having (100) face and (111) face or changing one plane of a primary plane and a side plane of a tabular grain.

The silver halide grains for use in the present invention can be selected according to purposes from regular crystals not containing twin plane, or examples explained in Nihon Shashin Gakkai compiled, *Fundamentals of Photographic Industry, Silver Salt Photography*, p. 163 (Corona Publishing Co.), for example, single twin crystal having one twin crystal plane, parallel multiple twin crystal having two or more parallel twin crystals, or non-parallel multiple twin crystal having two or more non-parallel twin crystals. Further, the example of mixing grains having different forms are disclosed in U.S. Pat. No. 4,865,964 and this method can be selected, if necessary. In the case of regular crystals, cubic grains having (100) faces, octahedral grains having (111) faces, the dodecahedral grains having (110) faces disclosed in JP-B-55-42737 and JP-A-60-222842. Further, the (h11) face grains represented by (211), the (hh1) face grains represented by (331), the (hk0) face grains represented by (210), and the (hk1) face grains represented by (321) disclosed in *Journal of Imaging Science*, Vol. 30, page 247, 1986, can be selected according to the purpose, although the preparation requires contrivances. Grains having two faces or more coexisting in one grain, such as tetradecahedral grains having (100) face and (111) face coexisting in one grain, grains having (100) face and (110) face coexisting or grains having (111) face and (110) face coexisting, can be selected according to purposes.

The value obtained by dividing the diameter corresponding to the circle of a projected area with the thickness of a grain is called an aspect ratio and this value regulates the form of a tabular grain. Tabular grains having an aspect ratio of 1 or more can be used in the present invention. Tabular grains can be prepared according to the methods disclosed in Cleve, *Photographic Theory and Practice*, page 131 (1930), Gutoff, *Photographic Science and Engineering*, Vol. 14, pages 248 to 257 (1970), U.S. Pat. Nos. 4,434,226, 4,414,310, 4,433,048, 4,439,520 and British Patent 2,112,157. When using tabular grains, there are advantages such as a covering power is heightened and a color sensitizing effect by a sensitizing dye is increased and details are disclosed in the aforementioned U.S. Pat. No. 4,434,226. The average aspect ratio of 80% or more of the entire projected area of grains is preferably 1 or more and less than 100, more preferably 2 or more and less than 20, and particularly preferably 3 or more and less than 10. Triangular, hexagonal and circular forms can be selected as the form of tabular grains. The equilateral hexagonal form disclosed in U.S. Pat. No. 4,797,354 is a preferred form.

The diameter corresponding to the circle of a projected area is often used as the grain size of tabular grains, and grains having the average size of 0.6 μm or less as disclosed in U.S. Pat. No. 4,748,106 are preferred for obtaining high quality image. Also, the emulsion having a narrow grain size distribution as disclosed in U.S. Pat. No. 4,775,617 is also preferred. As the form of a tabular grain, limiting the thickness of a grain preferably 0.5 μm or less, more preferably 0.3 μm or less, is preferred to increase the sharpness. Further, the emulsion of a uniform thickness having a variation coefficient of the thickness of grains of 30% or less is preferably used. Moreover, the grains whose thickness and the distance between planes of twin planes are regulated as disclosed in JP-A-63-163451 are also preferably used.

In the case of tabular grains, dislocation lines can be observed using a transmission type electron microscope. It is preferred to select grains not containing dislocation line at all, grains containing several dislocation lines or grains containing many dislocation lines according to the purpose. In addition, selection of a dislocation line is optional such as a dislocation line introduced linearly in the specific direction of crystal orientation of a grain or a curved dislocation line, further, a dislocation line can be selectively introduced such as to introduce entirely in a grain, or at only a specific part of a grain, e.g., at only a fringe part. The introduction of a dislocation line is preferred not only into tabular grains but also into regular crystal grains or irregular crystal grains such as pebble-like grains. Also in such a case, it is preferred to limit the place of introduction to a specific part such as an apex or edge.

The silver halide emulsion for use in the present invention may be subjected to the treatment to make a grain rounded in shape as disclosed in EP-B-96727 and EP-B-64412 or may be surface reformed as disclosed in West German Patent 2,306,447C2 and JP-A-60-221320.

A grain surface is, in general, flat, but in some case, making a surface irregular intendedly is preferred. A part of the crystal disclosed in JP-A-58-106532 and JP-A-60-221320, e.g., a grain having a hole in the apex or in the center of the face, or the ruffled grain disclosed in U.S. Pat. No. 4,643,966 are examples thereof.

The grain size of the emulsion for use in the present invention can be evaluated by the diameter corresponding to the circle of a projected area measured with an electron microscope, the diameter corresponding to the sphere of a grain volume calculated from the projected area and the grain thickness, or the diameter corresponding to the sphere of a grain volume calculated by the coal tar counter method. Grains can be selected from fine grains of 0.05 μm or less as a sphere corresponding diameter to large grains of exceeding 10 μm. Grains having a grain size of from 0.1 μm to 3 μm can be preferably used as light-sensitive silver halide grains in the present invention.

Grains having a sphere corresponding diameter of preferably 0.5 μm or less, more preferably 0.2 μm or less are preferred for intensification processing described later.

Emulsions for use in the present invention may be either of a polydisperse emulsion having a broad grain size distribution or a monodisperse emulsion having a narrow grain size distribution, and can be selected according to the purpose. As a criterion of grain size distribution, a variation coefficient of the diameter corresponding to the circle of a projected area of a grain or the diameter corresponding to the sphere of a grain volume is used in some case. In many cases, the use of a monodisperse emulsion is preferred and emulsions having a variation coefficient of 25% or less, more preferably 20% or less, and still more preferably 15% or less are preferably used.

For the purpose of obtaining satisfactory gradation, in the emulsion layers having substantially the same color sensitivity, two or more monodisperse silver halide emulsions having different grain sizes can be mixed in the same layer or can be multilayer coated as separate layers. Further, two or more polydisperse silver halide emulsions, or a monodisperse emulsion and a polydisperse emulsion, can be mixed or multilayer coated in combination.

The photographic emulsion for use in the present invention can be prepared according to the methods disclosed, for example, in P. Glafkides, *Chimie et Physique Photographique*, Paul Montel (1967), G. F. Duffin, *Photographic Emulsion Chemistry*, Focal Press (1966), V. L. Zelikman, et al., *Making and Coating Photographic Emulsion*, Focal Press (1964), and so on. That is, any process, such as an acid process, a neutral process, and an ammoniacal process, can be used. Also, as methods for reacting a soluble silver salt with a soluble halide, a single jet method, a double jet method, and a combination of them are known and any of these methods can be used. A method in which silver halide grains are formed in the excessive silver ion (a so-called reverse mixing method) can also be used. Further, a so-called controlled double jet method, which is one form of a double jet method, in which the pAg of the liquid phase in which the silver halide is formed is maintained constant, can also be used. According to this method, a silver halide emulsion having a regular crystal form and substantially a uniform grain size distribution can be obtained.

The methods of adding silver halide grains in the state of previously formed precipitation to a reaction vessel of emulsion preparation as disclosed in U.S. Pat. Nos. 4,334,012, 4,301,241 and 4,150,994 are preferably used in some case. Such a precipitate can be used as a seed crystal and also useful when supplying as silver halide for grain growth. In the latter case, the addition of an emulsion having a small grain size is preferred, and the method of addition can be selected from the way of adding all at a time, dividing to several parts and adding in several times or adding continuously over a long period of time. Further, addition of grains having various halide compositions is effective in some case.

The methods of converting the major portion or only a small portion of a halide composition of a silver halide grain by a conversion method are disclosed in U.S. Pat. Nos. 3,477,852, 4,142,900, EP 273429, EP 273430 and German Patent Publication (Laid-Open) 3,819,241 and they are effective grain formation methods. A soluble halide solution or silver halide grains can be added to convert silver halide grains to more hardly soluble silver salts. The method of conversion can be selected from the way of converting all at a time, dividing to several parts and converting in several times or continuously converting over a long period of time.

Other than the method of grain formation by adding a soluble silver salt and a soluble halide at a constant concentration and constant flow rate, the methods of grain formation with changing the concentration or flow rate disclosed in British Patent 1,469,480, U.S. Pat. Nos. 3,650,757 and 4,242,445 are preferred methods. By increasing the concentration or flow rate, the amount of silver halide to be supplied can be varied with the first order function, or the second order functions of the addition time. Further, if necessary, it is preferred in some case that the amount of silver halide to be supplied is reduced. Moreover, when several kinds of soluble silver salts having different compositions of solutions are added or several kinds of soluble halides having different compositions of solutions are added, the addition method of increasing one and decreasing the other is also effective.

A mixing method for reacting the solution of a soluble silver salt with a soluble halide can be selected from the methods disclosed in U.S. Pat. Nos. 2,996,287, 3,342,605, 3,415,650, 3,785,737, West German Patents 2,556,885 and 2,555,364.

A silver halide solvent is useful for accelerating ripening. For example, it is known that an excessive amount of halogen ion is added to a reaction vessel to accelerate ripening. Other ripening agents can also be used. All the amount of such a ripening agent can be mixed in a dispersion medium in a reaction vessel before addition of silver and halide, or can be added to a reaction vessel at the same time with the addition of halide, a silver salt or a deflocculant. Alternatively, a ripening agent can be added independently at the addition stage of halide and a silver salt.

Examples of silver halide solvents include ammonia, thiocyanates (potassium thiocyanate, ammonium thiocyanate), organic thioether compounds (e.g., the compounds disclosed in U.S. Pat. Nos. 3,574,628, 3,021,215, 3,057,724, 3,038,805, 4,276,374, 4,297,439, 3,704,130, 4,782,013, JP-A-57-104926), thione compounds (e.g., the tetra-substituted thiourea disclosed in JP-A-53-82408, JP-A-55-77737, U.S. Pat. No. 4,221,863, the compounds disclosed in JP-A-53-144319), the mercapto compounds capable of accelerating the growth of silver halide grains disclosed in JP-A-57-202531, amine compounds (e.g., disclosed in JP-A-54-100717), etc.

Gelatin is preferably used as a protective colloid at the time of preparation of the emulsion of the present invention and as a binder for other hydrophilic colloid layer, but other hydrophilic colloids can also be used.

Examples thereof include proteins such as gelatin derivatives, graft polymers of gelatin and other high polymers, albumin and casein; sugar derivatives such as cellulose derivatives such as hydroxyethyl cellulose, carboxymethyl cellulose, and cellulose sulfate, sodium alginate, and starch derivatives; and various kinds of synthetic hydrophilic high polymers of homopolymers or copolymers such as polyvinyl alcohol, partially acetalated polyvinyl alcohol, poly-N-vinyl pyrrolidone, polyacrylic acid, polymethacrylic acid, polyacrylamide, polyvinylimidazole, and polyvinylpyrazole.

Acid-processed gelatin and the enzyme-processed gelatin disclosed in *Bull. Soc. Sci. Photo. Japan*, No. 16, p. 30 (1966) can be used as well as lime-processed gelatin, and hydrolyzed product and enzyme decomposed product of gelatin can also be used. The low molecular weight gelatin disclosed in JP-A-1-158426 is preferably used for the preparation of tabular grains. Further, low calcium gelatin having a calcium content of 800 ppm or less, more preferably 200 ppm or less is preferably used. It is also preferred to add the antibacterial agents as disclosed in JP-A-63-271247 to prevent various molds or bacteria which proliferate in a hydrophilic colloid layer and deteriorate images.

The emulsion of the present invention is preferably washed for the purpose of desalting and dispersed in newly prepared protective colloid. The washing temperature can be selected according to the purpose but is preferably from 5° to 50° C. The pH at washing time can also be selected according to the purpose but is preferably from 2 to 10, more preferably from 3 to 8. The pAg at washing time can also be selected according to the purpose but is preferably from 5 to 10. The washing method can be selected from among a noodle washing method, a dialysis method using a semipermeable membrane, a centrifugal separation method, a coagulation precipitation method, and an ion exchange method. In the case of a coagulation precipitation method, a washing method can be selected from among a method using sulfate, a method using an organic solvent, a method using a water-soluble polymer, a method using a gelatin derivative, etc.

Metal ion salt is preferably contained, according to purposes, in the emulsion of the present invention during emulsion preparation, e.g., at the time of grain formation, during desalting stage, during chemical sensitization or before coating. When grains are doped with, the addition is preferably conducted during grain formation, and when modifying the surfaces of grains or using as a chemical sensitizer, it is preferably added after grain formation and before completion of chemical sensitization. A method of doping can be selected such that a grain is entirely doped, only a core part is doped, only a shell part is doped, only an epitaxial part is doped, or only substrate grains are doped. Examples of the metals which can be used include Mg, Ca, Sr, Ba, Al, Sc, Y, LaCr, Mn, Fe, Co, Ni, Cu, Zn, Ga, Ru, Rh, Pd, Re, Os, Ir, Pt, Au, Cd, Hg, Tl, In, Sn, Pb, Bi, etc. These metals can be added if in the form of a salt, such as ammonium salt, acetate, nitrate, sulfate, phosphate, hydroxide salt, or 6-coordination complex salt or 4-coordination complex salt, which can be dissolved at the time of grain formation, for example, $CdBr_2$, $CdCl_2$, $Cd(NO_3)_2$, $Pb(NO_3)_2$, $Pb(CH_3COO)_2$, $K_3[Fe(CN)_6]$, $(NH_4)_4[Fe(CN_6]$, $K_3IrCl_6$, $(NH_4)_3RhCl_6$, $K_4Ru(CN)_6$, etc. A ligand of a coordination compound can be selected from halogen, $H_2O$, $NH_3$, a cyano group, a cyanate group, a thiocyanate group, a nitrosyl group, a thionitrosyl group, an oxo group and a carbonyl group. They may comprise only one kind of a metal compound or may comprise two, three or more metal compounds in combination.

There are cases that a method in which the chalcogen compounds as disclosed in U.S. Pat. No. 3,772,031 are added during the emulsion formation is useful. Cyanide, thiocyanide, selenocyanic acid, carbonate, phosphate and acetate can be present in addition to S, Se and Te.

The silver halide grains for use in the present invention can be subjected to at least one of sulfur sensitization, selenium sensitization, tellurium sensitization (these three kinds of sensitization are generically called chalcogen sensitization), noble metal sensitization and reduction sensitization at an arbitrary stage during silver halide emulsion formation. Two or more sensitizing methods are preferably used in combination. Various types of emulsions can be prepared depending upon the stages when the chemical sensitization is carried out. There are a type in which a chemically sensitized nucleus is buried in the internal part of a grain, a type in which a chemically sensitized nucleus is buried in the shallow part from the surface of a grain, or a type in which a chemically sensitized nucleus is formed on the surface of a grain. It is generally preferred to have at least one chemically sensitized nucleus in the vicinity of the surface of a grain.

Chemical sensitizing methods which can be conducted in the present invention are chalcogen sensitization and noble metal sensitization alone or in combination, and these sensitizing methods can be carried out using active gelatin as disclosed in T. H. James, *The Theory of the Photographic Process*, 4th Ed., Macmillan (1977), pages 67 to 76, and also sensitization can be conducted using sulfur, selenium, tellurium, gold, platinum, palladium, or iridium, or two or more of these sensitizers in combination at pAg of from 5 to 10, pH of from 5 to 8, and temperature of from 30° to 80° C. as disclosed in *Research Disclosure*, Item 12008 (April, 1974), idib., Item 13452 (June, 1975), ibid., Item 307105 (November, 1989), U.S. Pat. Nos. 2,642,361, 3,297,446, 3,772,031, 3,857,711, 3,901,714, 4,266,018 and 3,904,415 and British Patent 1,315,755.

Unstable sulfur compounds are used in sulfur sensitization, and specific examples include known sulfur compounds such as thiosulfate (e.g., hypo), thioureas (e.g., diphenylthiourea, triethylthiourea, allylthiourea), rhodanines, mercapto compounds, thioamides, thiohydantoins, 4-oxo-oxazolidine-2-thiones, disulfides or polysulfides, polythionate, elemental sulfur, and the known sulfur-containing compounds as disclosed in U.S. Pat. Nos. 3,857,711, 4,266,018 and 4,054,457. In many cases, sulfur sensitization is effective when combined with noble metal sensitization.

The amount of the sulfur sensitizer for use in the silver halide grains of the present invention is preferably from $1\times10^{-7}$ to $1\times10^{-3}$ mol, more preferably from $5\times10^{-7}$ to $1\times10^{-4}$ mol, per mol of silver halide.

Unstable selenium compounds are used in sulfur sensitization, for example, the unstable selenium compounds disclosed in U.S. Pat. Nos. 3,297,446 and 3,297,447 can be used. Specific examples thereof include selenium compounds such as colloidal metal selenium, selenoureas (e.g., N,N-dimethyl-selenourea, tetramethylselenourea), seleno ketones (e.g., seleno acetone), selenoamides (e.g., selenoacetamide), selenocarboxylic acids and seleno esters, isoselenocyanates, selenides (e.g., diethylselenide, triphenylphosphine-selenide), selenophosphates (e.g., tri-p-tolylseleno-phosphate). In some case, selenium sensitization is more preferred when used in combination with sulfur sensitization or noble metal sensitization or with both of them.

The amount of the selenium sensitizer for use in the present invention varies depending on the selenium compound to be used, the silver halide grains to be used and chemical sensitization conditions, but is generally from $10^{-8}$ to $1\times10^{-4}$ mol, preferably from $1\times10^{-7}$ to $1\times10^{-5}$ mol or so, per mol of the silver halide.

Tellurium sensitizers for use in the present invention are the compounds disclosed in Canadian Patent 800,958, British Patents 1,295,462, 1,396,696, Japanese Patent Application Nos. 2-333819 and 3-131598. Specific examples thereof include colloidal tellurium, telluroureas (e.g., tetramethyltellurourea, N-carboxyethyl-N',N'-dimethyltellurourea, N,N'-dimethylethylenetellurourea), isotellurocyanates, telluro ketones, telluroamides, tellurohydrazides, telluro esters, phosphinetellurides (e.g., tributylphosphinetelluride, butyldiisopropylphosphinetelluride), and other tellurium compounds (e.g., potassium telluride, potassium tellurocyanate, sodium telluropentathiohate).

The amount of the tellurium sensitizer for use in the present invention is preferably from $1\times10^{-7}$ to $5\times10^{-3}$ mol, more preferably from $5\times10^{-7}$ to $1\times10^{-3}$ mol, per mol of silver halide.

In noble metal sensitization, a noble metal salt such as gold, platinum, palladium and iridium can be used, and particularly preferred are gold sensitization, palladium sensitization, and the combined use of them. In gold sensitization, chloroauric acid, potassium chloroaurate, potassium aurithiocyanate, gold sulfide, gold selenide can be used. The palladium compound means 2-equivalent or 4-equivalent salt of palladium. Preferred palladium compound is represented by $R_2PdX_6$ or $R_2PdX_4$, wherein R represents a hydrogen atom, an alkali metal atom or an ammonium group; and X represents a halogen atom, e.g., chlorine, bromine or iodine.

Specifically, $K_2PdCl_4$, $(NH_4)_2PdCl_6$, $Na_2PdCl_4$, $(NH_4)_2PdCl_4$, $Li_2PdCl_4$, $Na_2PdCl_6$ or $K_2PdBr_4$ is preferred. Further, noble metals such as platinum, palladium, iridium can also be used. A gold compound and a palladium compound are preferably used in combination with thiocyanate or selenocyanate.

Chemical sensitization of the emulsion of the present invention is preferably conducted in combination with gold sensitization. The amount of the gold sensitizer for use in the present invention is preferably from $1\times10^{-7}$ to $1\times10^{-3}$ mol, more preferably from $5\times10^{-7}$ to $5\times10^{-4}$ mol, per mol of silver halide. The amount of the palladium sensitizer for use in the present invention is preferably from $5\times10_{-7}$ to $1\times10^{-3}$ mol per mol of silver halide. The amount of the thiocyanide compound or a selenocyanide compound is preferably from $1\times10^{-6}$ to $5\times10^{-2}$ mol.

The silver halide emulsion is preferably reduction sensitized during grain formation, or after grain formation and before chemical sensitization or during chemical sensitization, or after chemical sensitization.

The method of reduction sensitization can be selected from a method in which a reduction sensitizer is added to a silver halide emulsion, a method in which grains are grown or ripened in the atmosphere of low pAg of from 1 to 7 which is called silver ripening, or a method in which grains are grown or ripened in the atmosphere of high pH of from 8 to 11 which is called high pH ripening. Further, two or more of these methods can be used in combination.

A method of adding a reduction sensitizer is preferred from the point of capable of delicately controlling the level of the reduction sensitization.

Stannous salt, ascorbic acid and derivatives thereof, amines and polyamines, hydrazine and derivatives thereof, formamidinesulfinic acid, silane compounds and borane compounds are well known as a reduction sensitizer. These known reduction sensitizers can be selected and used in the present invention, and two or more of these compounds can also be used in combination. Stannous chloride, aminoiminomethanesulfinic acid (commonly called as thiourea dioxide), dimethylamineborane, ascorbic acid and derivatives thereof are preferred compounds as a reduction sensitizer. As the addition amount of the reduction sensitizer depends upon the production conditions of the emulsion, the addition amount needs to be selected, but $10^{-7}$ to $10^{-3}$ mol per mol of silver halide is preferred.

Chemical sensitization can be conducted in the presence of a so-called auxiliary chemical sensitizer. The compounds known to inhibit fogging during chemical sensitization and to increase sensitivity such as nucleic acid and decomposed product thereof, e.g., azaindene, azapyridazine, azapyrimidine, are used as a useful auxiliary chemical sensitizer. Examples of auxiliary chemical sensitizer reformer are disclosed in U.S. Pat. Nos. 2,131,038, 3,411,914, 3,554,757, JP-A-58-126526 and above described G. F. Duffin, *Photographic Emulsion Chemistry*, pages 138 to 143.

It is preferred to use an oxidizing agent for silver during the production process of the emulsion of the present invention. An oxidizing agent for silver is a compound having a function of acting on metal silver and converting it to a silver ion. In particular, a compound which can convert to a silver ion superminute silver grains by-produced in the course of the formation of silver halide grains and chemical sensitization is effective. The silver ion thus prepared may form hardly water-soluble silver salt such as silver halide, silver sulfide or silver selenide, or may form easily water-soluble silver salt such as silver nitrate. An oxidant for silver may be inorganic or organic. Examples of inorganic oxidizing agents include oxyacid salt, such as ozone, hydrogen peroxide and addition products thereof (e.g., $NaBO_2\cdot H_2O_2\cdot 3H_2O$, $2NaCO_3\cdot 3H_2O_2$, $Na_4P_2O_7\cdot 2H_2O_2$, $2Na_2SO_4\cdot H_2O_2\cdot 2H_2O$), peroxyacid salt (e.g., $K_2S_2O_8$, $K_2C_2O_6$, $K_2P_2O_8$), peroxy complex compound (e.g., $K_2[Ti(O_2)C_2O_4]\cdot 3H_2O$, $4K_2SO_4\cdot Ti(O_2)OH\cdot SO_4\cdot 2H_2O$, $Na_3[VO(O_2)(C_2H_4)_2\cdot 6H_2O]$, permanganate (e.g., $KMnO_4$), and chromate (e.g., $K_2Cr_2O_7$), halogen element such as iodine and bromine, perhalogen acid salt (e.g., potassium periodate), salt of metal of high valency (e.g., potassium hexacyanoferrate(III)), and thiosulfonate.

Further, examples of organic oxidizing agents include quinones such as p-quinone, organic peroxide such as peracetic acid and perbenzoic acid, a compound which releases active halogen (e.g., N-bromosuccinimide, chloramine T, chloramine B).

The oxidizing agents which are preferably used in the present invention are inorganic oxidizing agents such as ozone, hydrogen peroxide and addition products thereof, halogen element, thiosulfonate, and organic oxidizing agents such as quinones. It is preferred to use the above described reduction sensitization in combination with an oxidizing agent for silver. The method of usage can be selected from a method in which an oxidizing agent is used and then reduction sensitization is carried out, an inverse method thereof, or a method in which both are concurred with. These methods can be used either in grain formation process or in chemical sensitization process selectively.

The photographic emulsion for use in the present invention can contain various compounds for preventing fogging during manufacture of the photographic material, during storage, or during photographic processing. That is, many compounds known as antifoggants and stabilizers can be incorporated into the emulsion, for example, azoles, e.g., benzothiazolium salt, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole; mercaptopyrimidines; mercaptotriazines; thioketo compounds, e.g., oxazolinethione; and azaindenes, e.g., triazaindenes, tetraazaindenes (in particular, 4-hydroxy-6-methyl(1,3,3a,7)tetraazaindenes), and pentaazaindenes. For example, the compounds disclosed in U.S. Pat. Nos. 3,954,474, 3,982,947, JP-B-52-28660 can be used. One preferred compound is the compound disclosed in JP-A-63-212932. Antifoggants and stabilizers can be added to the emulsion according to purposes at any time before grain formation, during grain formation, after grain formation, during washing process, at the time of dispersion after washing, before chemical sensitization, during chemical sensitization, after chemical sensitization, and before coating. They are added during emulsion preparation for various purposes of, in addition to their original functions of prevention of fogging and stabilization of photographic performances, controlling crystal habit of grains, decreasing the grain size, reducing the solubility of grains, controlling chemical sensitization, or controlling arrangement of dyes.

As spectral sensitizing dyes which are used in the photographic material of the present invention for spectral sensitization of blue, green and red light regions, for example, the dyes disclosed in F. M. Harmer, *Heterocyclic Compounds—Cyanine Dyes and Related Compounds*, John Wiley & Sons, New York, London (1964) can be cited. Specific examples of the compounds and spectral sensitization methods which are preferably used in the present invention include those disclosed in JP-A-62-215272, from page 22, right upper column to page 38. In addition, the spectral sensitizing dyes disclosed in JP-A-3-123340 are very preferred as red-sensitive spectral sensitizing dyes for silver halide emulsion grains having a high silver chloride content from the point of stability, adsorption strength, and the temperature dependency of exposure, and so on.

For the purpose of effective spectral sensitization in infrared region of the photographic materials of the present invention, the sensitizing dyes disclosed in JP-A-3-15049, from page 12, left upper column to page 21, left lower column, JP-A-3-20730, from page 4, left lower column to page 15, left lower column, EP 420011, from page 4, line 21 to page 6, line 54, EP 420012, from page 4, line 12 to page 10, line 33, EP 443466, and U.S. Pat. 4,975,362, are preferably used.

For the incorporation of these spectral sensitizing dyes into a silver halide emulsion, they may be directly dispersed in the emulsion, or they may be dissolved in a single or mixed solvent of water, methanol, ethanol, propanol, methyl cellosolve, 2,2,3,3-tetrafluoropropanol, etc., and then added to the emulsion. Further, they may be added to the emulsion as an aqueous solution coexisting with acid or base as described in JP-B-44-23389, JP-B-44-27555 and JP-B-57-22089, as an aqueous solution or colloidal dispersion coexisting with a surfactant as disclosed in U.S. Pat. Nos. 3,822,135 and 4,006,025. Moreover, they may be dissolved in a solvent substantially immiscible with water such as phenoxyethanol, etc., then dispersed in water or a hydrophilic colloid and added to the emulsion. Alternatively, they may be directly dispersed in a hydrophilic colloid and the dispersion is added to the emulsion as disclosed in JP-A-53-102733 and JP-A-58-105141. The time of the addition to the emulsion may be at any stage of the preparation of the emulsion known as useful hitherto, that is, before grain formation of silver halide emulsion, during grain formation, immediately after grain formation and before entering washing step, before chemical sensitization, during chemical sensitization, immediately after chemical sensitization until cooling and solidifying the emulsion, or at the time of preparation of a coating solution, and the time can be selected arbitrarily. In general, it is conducted during the period after the completion of chemical sensitization and before coating, however, a method in which spectral sensitizing dyes are added at the same time with the addition of chemical sensitizers and spectral sensitization is carried out simultaneously with chemical sensitization can be employable as disclosed in U.S. Pat. Nos. 3,628,969 and 4,225,666, further, as disclosed in JP-A-58-113928, spectral sensitization can be conducted prior to chemical sensitization, or spectral sensitizing dyes can be added and spectral sensitization can be started before completion of the precipitation formation of the silver halide grains. Still further, as disclosed in U.S. Pat. No. 4,225,666, spectral sensitizing dyes can be divided and added separately, that is, a part of them is added prior to chemical sensitization and the remaining is added after chemical sensitization, therefore, any time during silver halide grain formation is feasible, as well as the methods disclosed in U.S. Pat. No. 4,183,756. The addition of the sensitizing dyes before washing step of the emulsion, or before chemical sensitization is particularly preferred, above all.

The dyes which are used for spectral sensitization include, for example, a cyanine dye, a merocyanine dye, a complex cyanine dye, a complex merocyanine dye, a holopolar cyanine dye, a hemicyanine dye, a styryl dye, and a hemioxonol dye. Particularly useful dyes are dyes belonging to a cyanine dye, a merocyanine dye and a complex merocyanine dye. Nuclei which are usually utilized as basic heterocyclic nuclei in cyanine dyes can be applied to these dyes. For example, a pyrroline nucleus, an oxazoline nucleus, a thiazoline nucleus, a pyrrole nucleus, an oxazole nucleus, a thiazole nucleus, a selenazole nucleus, an imidazole nucleus, a tetrazole nucleus, a pyridine nucleus; the above nuclei to which alicyclic hydrocarbon rings are fused; the above nuclei to which aromatic hydrocarbon rings are fused, that is, an indolenine nucleus, a benzindolenine nucleus, an indole nucleus, a benzoxazole nucleus, a naphthoxazole nucleus, a benzothiazole nucleus, a naphthothiazole nucleus, a benzoselenazole nucleus, a benzimidazole nucleus, and a quinoline nucleus can be applied. These heterocyclic nuclei may be substituted on the carbon atoms.

As a nucleus having a ketomethylene structure, a 5- or 6-membered heterocyclic nucleus such as a pyrazolin-5-one nucleus, a thiohydantoin nucleus, a 2-thiooxazolidine-2,4-dione nucleus, a thiazolidine-2,4-dione nucleus, a rhodanine nucleus, or a thiobarbituric acid nucleus can be applied to a merocyanine dye and a complex merocyanine dye.

These sensitizing dyes may be used alone or may be used in combination. A combination of a sensitizing dye is often used for the purpose of supersensitization. Representative examples thereof are disclosed in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, 4,026,707, British Patents 1,344,281, 1,507,803, JP-B-43-4936, JP-B-53-12375, JP-A-52-110618 and JP-A-52-109925.

Further, dyes which themselves do not show a spectral sensitizing function or materials substantially do not absorb visible light but show supersensitization can be incorporated in the emulsion with sensitizing dyes.

The addition amount of these spectral sensitizing dyes is in a wide range depending on the case, and is preferably from $0.5\times10^{-6}$ to $1.0\times10^{-2}$ mol, more preferably from $1.0\times10^{-6}$ to $5.0\times10^{-3}$ mol, per mol of silver halide.

In the present invention, when using sensitizing dyes having spectral sensitivity, in particular, from the red region to the infrared region, it is preferred to use the compounds disclosed in JP-A-2-157749, from page 13, right lower column to page 22, right lower column in combination. With the use of these compounds, the storage stability and processing stability and supersensitization effect of the photographic material can be improved conspicuously. Above all, the use of the compounds represented by formulae (IV), (V) and (VI) of the same patent in combination is particularly preferred. These compounds are used in an amount of from $0.5\times10^{-5}$ to $5.0\times10^{-2}$ mol, preferably from $5.0\times10^{-5}$ to $5.0\times10^{-3}$ mol, per mol of silver halide, and appropriately from 0.1 times to 10,000 times, preferably from 0.5 times to 5,000 times, to 1 mol of the sensitizing dye.

The photographic material of the present invention can preferably be used, in addition to the printing system using a general negative printer, in digital scanning exposure using monochromatic high density light, such as a gas laser, a light emitting diode, a semiconductor laser, a second harmonic generation light source (SHG) comprising a combination of nonlinear optical crystal with a semiconductor laser or a solid state laser using a semiconductor laser as an excitation light source. It is preferred to use a semiconductor laser, or a second harmonic generation light source (SHG) comprising a combination of nonlinear optical crystal with a semiconductor laser or a solid state laser for obtaining a compact and inexpensive system. It is preferred to use a semiconductor laser to design a particularly compact and inexpensive apparatus having a longer duration of life and high stability, and it is preferred that at least one of exposure light sources should be a semiconductor laser.

When such a scanning exposure light source is used, the spectral sensitivity maximum of the photographic material of the present invention can be set arbitrarily according to the wavelength of the scanning exposure light source which is used. As oscillation wavelength of a laser can be made half using an SHG light source comprising a combination of nonlinear optical crystal with a semiconductor laser or a solid state laser using a semiconductor laser as an excitation light source, blue light and green light can be obtained. Accordingly, it is possible to have the spectral sensitivity maximum of a photographic material in normal three regions of blue, green and red. When a semiconductor laser is used as a light source for making an apparatus inexpensive, high stable and compact, it is preferred that at least two layers have spectral sensitivity maximum in the region of 670 nm or more. This is because emission wavelength region of III-V group system semiconductor laser, which is presently available, inexpensive and stable, is only in the red region and the infrared region. However, oscillation of II-VI group system semiconductor laser in the green and blue regions is confirmed in experimental level, and it is sufficiently expected that such a semiconductor laser shall be available inexpensively and stably according to the development of the manufacturing technology of the semiconductor laser. In such a case, the necessity that at least two layers should have spectral sensitivity maximum in the region of 670 nm or more becomes small.

The time of exposure of silver halide in a photographic material in such a scanning exposure is the time necessary for exposure of a micro area. This micro area is in general used as the minimum unit for controlling the quantity of light from each digital data and which is called a pixel. Therefore, exposure time per pixel is varied according to the size of the pixel. The size of the pixel depends on the density of the pixel and the practical range of the density of the pixel is from 50 to 2,000 dpi. The exposure time is defined as the time necessary to expose the size of the pixel with the density of the pixel being 400 dip, and preferred exposure time is $10^{-4}$ sec or less and more preferably $10^{6}$ sec or less.

A colored layer capable of decoloration by treatment is used in the present invention in combination with water-soluble dyes. A colored layer capable of decoloration by treatment may be directly in contact with an emulsion layer or may be disposed via an interlayer containing processing color mixing preventives such as gelatin and hydroquinone. This colored layer is preferably provided under the emulsion layer (the side of the support) which colors the same elementary color as the colored layer. It is possible to provide all colored layers corresponding to each elementary color separately or to provide only a part of it by selecting optionally. Further, it is possible to provide a colored layer which is colored to correspond with a plurality of elementary color regions. With respect to the optical reflection density of a colored layer, the optical density value in the wavelength of the highest optical density in the wavelength region which is used for exposure (the visible light region of 400 nm to 700 nm in the case of the exposure by usual printer, and the wavelength of the scanning exposure light source in the case of scanning exposure) is preferably from 0.2 to 3.0, more preferably from 0.5 to 2.5, and most preferably from 0.8 to 2.0.

The conventionally known methods can be applied in combination to form a colored layer, for example, a method in which the dyes disclosed in JP-A-2-282244, from page 3, right upper column to page 8, or the dyes disclosed in JP-A-3-7931, page 3, right upper column to page 11, left lower column, are incorporated in the hydrophilic colloidal layer in the form of a solid fine grain dispersion, a method in which anionic dyes are mordanted to cationic polymers, a method in which dyes are adsorbed onto fine grains such as silver halide and fixed in the layer, or a method which uses colloidal silver as disclosed in JP-A-1-239544. With respect to a method of dispersing fine powders of a dye in a solid state, a method in which fine powder dye which is substantially water-insoluble at pH 6 or less but substantially water-soluble at pH 8 or more is included is disclosed in JP-A-2-308244, pages 4 to 13. A method in which anionic dyes are mordanted to cationic polymers is disclosed in JP-A-2-84637, from pages 18 to 26. Methods for preparing colloidal silver as a light absorbing agent are disclosed in U.S. Pat. Nos. 2,688,601 and 3,459,563. Of these methods, a method which includes fine powder dye and a method which uses colloidal silver are preferred.

The total coating amount of silver of the photographic material of the present invention is preferably from 0.003 to 1 g per $m^2$ in terms of silver. The coating amount of silver of each layer is preferably from 0.001 to 0.4 g per one light-sensitive layer. In particular, when the photographic material of the present invention is intensification processed, the amount is preferably from 0.003 to 0.3 g, more preferably from 0.01 to 0.1 g, and particularly preferably from 0.015 to 0.05 g. In this case, the coating amount of one light-sensitive layer is preferably from 0.001 to 0.1 g, more preferably from 0.003 to 0.03 g. In such a photographic material of low silver amount, desilvering process can be omitted, which is very advantageous in view of speedup of processing and reduction of the load of waste solution.

In the present invention, if the coating silver amount of each light-sensitive layer less than 0.001 g, the dissolution of silver salt proceeds and sufficient color density cannot be obtained, and when intensification processed is conducted, if the amount exceeds 0.1 g, $D_{min}$ increases and foams are generated leading to deterioration of images.

Various additives are used in the photographic material of the present invention as described above, and additives other than the above can be used according to purposes.

These additives are disclosed in *Research Disclosure*, Item 17643 (December, 1978), ibid., Item 18716 (November, 1979) and ibid., Item 307105 (November, 1989) in detail, and the related locations of the disclosures are also shown in the table below.

TABLE 1

| Type of Additives | RD 17643 | RD 18716 | RD 307105 |
|---|---|---|---|
| 1. Chemical Sensitizers | page 23 | page 648, right column | page 996 |
| 2. Sensitivity Increasing Agents | — | page 648, right column | — |
| 3. Spectral Sensitizers and Supersensitizers | pages 23–24 | page 648, right column to page 649, right column | page 996, right column to page 998, right column |
| 4. Whitening Agents | page 24 | — | page 998, right column |
| 5. Antifoggants and Stabilizers | pages 24–25 | page 649, right column | page 998, right column to page 1000, right column |
| 6. Light Absorbing Agents, Filter Dyes, and Ultraviolet Absorbing Agents | pages 25–26 | page 649, right column to page 650, left column | page 1003, left column to page 1003, right column |
| 7. Antistaining Agents | page 25, right column | page 650, left to right columns | — |
| 8. Color image Stabilizers | page 25 | | |
| 9. Hardening Agents | page 26 | page 651, left column | page 1004, right column to page 1005, left column |
| 10. Binders | page 26 | page 651, left column | page 1003, right column to page 1004, right column |
| 11. Plasticizers and Lubricants | page 27 | page 650, right column | page 1006, left column to page 1006, right column |
| 12. Coating Aids and Surfactants | pages 26–27 | page 650, right column | page 1005, left column to page 1006, left column |
| 13. Antistatic Agents | page 27 | page 650, right column | page 1006, right column to page 1007, left column |

When the photographic material of the present invention is subjected to printer exposure, it is preferred to use the band stop filter as disclosed in U.S. Pat. No. 4,880,726. Color mixing by light can be excluded and color reproducibility is remarkably improved by this means.

The processing materials and the processing methods for use in the present invention is described in detail below. In the present invention, photographic materials are subjected to development [silver development/(cross) oxidation of a reducing agent incorporated in the material], (desilvering), and washing or stabilizing processes. Further, there is a case where the processing for color intensification such as alkali investment is conducted after washing or stabilizing process.

In the present invention, when a photographic material is developed, a compound which functions as a developing agent for silver halide in a developing solution and/or functions to cross oxidize a reducing agent for coloring incorporated in the photographic material with the oxidized product of a developing agent occurred by silver development can be used. As such a compound, pyrazolidones, dihydroxybenzenes, reductones and p-aminophenols are preferably used, and pyrazolidones are particularly preferably used.

As pyrazolidones, 1-phenyl-3-pyrazolidones are preferred, such as 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-phenyl-5-phenyl-3-pyrazolidone, 1-p-tolyl-4-methyl-4-hydroxymethyl-3-pyrazolidone, 1-p-chlorophenyl-4-methyl-4-hydroxymethyl-3-pyrazolidone, 1-phenyl-2-hydroxymethyl-4,4-dimethyl-3-pyrazolidone, 1-phenyl-2-acetyl-3-pyrazolidone, and 1-phenyl-2-hydroxymethyl-5-phenyl-3-pyrazolidone.

As dihydroxybenzenes, there are hydroquinone, chlorohydroquinone, bromohydroquinone, isopropylhydroquinone, methylhydroquinone, 2,3-dichlorohydroquinone, 2,5-dichloro-hydroquinone, 2,5-dimethylhydroquinone, and potassium hydroquinonemonosulfonate.

As reductones, ascorbic acid and derivatives thereof are preferred, and the compounds disclosed in JP-A-6-148822, from pages 3 to 10 are used, in particular, sodium L-ascorbate and sodium erytholvate are preferred.

As p-aminophenols, there are N-methyl-p-aminophenol, N-(β-hydroxyethyl)-p-aminophenol, N-(4-hydroxyphenyl) glycine, and 2-methyl-p-aminophenol.

These compounds are in general used alone, but the use of two or more in combination is also preferred for heightening development and cross oxidation activities.

The amount used of these compounds in a developing solution is from $2.5\times10^{-4}$ mol/liter to 0.2 mol/liter, preferably from 0.0025 mol/liter to 0.1 mol/liter, more preferably from 0.001 mol/liter to 0.05 mol/liter.

As a preservative for use in the developing solution of the present invention, there are enumerated sodium sulfite, potassium sulfite, lithium sulfite, ammonium sulfite, sodium bisulfite, potassium metabisulfite, sodium formaldehyde bisulfite, and hydroxylamine·sulfate, and they are used in an amount of 0.1 mol/liter or less, preferably, in some case, from 0.001 to 0.02 mol/liter. When a high silver chloride emulsion is used in a photographic material, the amount is 0.001 mol/liter or less, and preferably they are not contained at all, in some case.

In the present invention, an organic preservative is preferably used in place of hydroxylamine and sulfite ion described above.

Organic preservatives herein means general organic compounds which reduce the deterioration speed of the above described developing agent when added to a developing solution. That is, organic preservatives herein means organic compounds which have functions to prevent the aerial oxidation of developing agents and, above all, hydroxylamine derivatives (exclusive of hydroxylamine), hydroxamic acids, hydrazines, hydrazides, phenols, α-hydroxyketones, α-amino-ketones, sugars, monoamines, diamines, polyamines, quaternary ammonium salts, nitroxy radicals, alcohols, oximes, diamide compounds, and condensed ring amines are particularly useful organic preservatives. These organic preservatives are disclosed in JP-A-63-4235, JP-A-63-5341, JP-A-63-30845, JP-A-63-21647, JP-A-63-44655, JP-A-63-46454, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, and JP-B-48-30496. The various metals disclosed in JP-A-57-44148 and JP-A-57-53749, the salicylic acids disclosed in JP-A-59-180588, the alkanolamines disclosed in JP-A-54-3532, the polyethyleneimines disclosed in JP-A-56-94349, and the aromatic polyhydroxy compounds disclosed in U.S. Pat. No. 3,746,544 may be used as preservatives, if necessary. In particular, the addition of the alkanolamines disclosed in JP-A-4-97355, pages 631 to 632 and dialkylhydroxylamines disclosed in the same patent, pages 627 to 630 is preferred. Further, dialkylhydroxylamines and/or hydrazine derivatives and alkanolamine in combination, or α-amino acids such as the dialkylhydroxylamine and glycine disclosed in EP-A-530921 are preferably used.

These compounds are used in an amount of preferably from $1\times10^{-3}$ to $5\times10^{-1}$ mol, more preferably from $1\times10^{-2}$ to $2\times10^{-1}$ mol, per liter of the developing solution.

In the present invention, halogen ions such as a chlorine ion, a bromine ion and an iodine ion are contained in a developing solution. In particular, when a high silver chloride content emulsion is used, a chlorine ion is preferably contained in an amount of from $3.5\times10^{-3}$ to $3.0\times10^{-1}$ mol/liter, more preferably from $1\times10^{-2}$ to $2\times10^{\times1}$ mol/liter, and/or a bromine ion in an amount of from $0.5\times10^{-5}$ to $1.0\times10^{-3}$ mol/liter, more preferably from $3.0\times10^{-5}$ to $5\times10^{-4}$ mol/liter.

Halogen ions may be directly added to a developing solution, alternatively they may be dissolved out from a photographic material to a developing solution during development processing.

When they are directly added to a developing solution, materials which supply halogen ions are respective sodium salt, potassium salt, ammonium salt, lithium salt, magnesium salt, and lithium salt.

When they are dissolved out from the photographic material, they are primarily supplied from the emulsion, but may be supplied from other than the emulsion.

The developing solution for use in the present invention has pH of preferably from 8 to 13, and more preferably from 9 to 12.

The use of various buffers is preferred for maintaining the above pH level. Examples of buffers which can be used include carbonates, phosphates, borates, tetraborates, hydroxybenzoates, glycyl salts, N,N-dimethyl-glycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Since carbonates, phosphates, tetraborates and hydroxybenzoates are excellent in solubility and buffering ability in a high pH range of pH 9.0 or more, and do not adversely affect photographic characteristics when added to a developing solution, the use of these buffer solution is preferred.

Specific examples of these buffers include lithium carbonate, sodium carbonate, potassium carbonate, potassium bicarbonate, tripotassium phosphate, trisodium phosphate, dipotassium phosphate, disodium phosphate, potassium borate, sodium borate, sodium tetraborate, potassium tetraborate, sodium o-hydroxybenzoate (sodium salicylate), and potassium 5-sulfo-2-hydroxybenzoate (potassium 5-sulfosalicylate).

The buffers are added to a developing solution in an amount of preferably 0.05 mol/liter or more, and particularly preferably from 0.1 mol/liter to 0.4 mol/liter.

Various chelating agents can be used in a developing solution as a suspending agent for calcium and magnesium or for improving the stability of a developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, 1,2-diaminopropanetetraacetic acid, glycol ether diaminetetra-acetic acid, ethylenediamine-o-hydroxyphenylacetic acid, 2-phosphonobutane-1,2,4-tricarboxylic acid, 1-hydroxy-ethylidene-1,1-diphosphonic acid, 1,2-dihydroxybenzene-4,6-disulfonic acid, and metal salts of these compounds. These chelating agents may be used in combination of two or more, if necessary.

The addition amount of these chelating agent should be sufficient to mask the metal ions present in the developing solution, and the amount is, for example, from 0.1 g to 10 g or so per liter.

An antifoggant can be contained arbitrarily in the present invention, if desired. Alkali metal halides such as sodium chloride, potassium bromide and potassium iodide, and a nitrogen-containing heterocyclic compound can be used as an antifoggant. Specific examples of nitrogen-containing heterocyclic compounds include, e.g., benzotriazole, 5-nitrobenzotriazole, 5-methylbenzotriazole, 6-nitrobenzimidazole, 5-nitroisoimidazole, 2-thiazolylbenzimidazole, indazole, hydroxyazaindolizine, adenine, 1-phenyl-5-mercaptotetrazole and derivatives thereof.

The addition amount of the nitrogen-containing heterocyclic compound is $1\times10^{-5}$ to $1\times10^{-2}$ mol/liter, preferably from $2.5\times10^{-5}$ to $1\times10^{-3}$ mol/liter.

A developing solution can contain a development accelerator, if necessary. For example, the thioether based compounds disclosed in JP-B-37-16088, JP-B-37-5987, JP-B-38-7826, JP-B-44-12380, JP-B-45-9019 and U.S. Pat. No. 3,813,247, the p-phenylenediamine based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine based compounds disclosed in U.S. Pat. No. Nos. 2,494,903, 3,128,182, 4,230,796, 3,253,919, JP-B-41-11431, U.S. Pat. No. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and imidazoles can be added as a development accelerator, if necessary.

A developing solution preferably contains a whitening agent. In particular, the use of 4,4'-diamino-2,2'-disulfostilbene based compounds is preferred. Specifically, the commercially available compounds which are disclosed in *Dyeing Note,* 19th Ed., pages 165 to 168 and JP-A-4-242943, pages 3 to 7 can be used. The addition amount of these whitening agents is from 0.1 g to 10 g/liter, preferably from 0.5 g to 5 g/liter.

Processing temperature of the developing solution for use in the present invention is from 20° to 50° C., preferably from 30° to 45° C. Processing time is from 5 seconds to 2 minutes, preferably from 10 seconds to 1 minute. A small replenishment rate is preferred, but is usually from 15 to 600 ml, preferably from 25 to 200 ml, and more preferably from 35 to 100 ml, per $m^2$ of the photographic material.

A desilvering process is carried out after development. A desilvering process is carried out as only a fixing process and a bleaching process and a fixing process. When carrying out a bleaching process and a fixing process, a bleaching process and a fixing process may be carried out separately or at the same time (a bleach-fixing process). Moreover, the processing can be carried out in two connected bleach-fixing baths, a fixing process can be carried out before a bleach-fixing process, or a bleaching process can be carried out after a bleach-fixing process.

Further, it is also preferred that a desilvering process is not conducted after development and stabilizing process is conducted to stabilize silver salt and color images.

After development, an image intensifying process (intensification) can be carried out using the peroxide, the halogenous acid, the iodoso compounds and the cobalt(III) complex compounds disclosed in West German Patents (OLS) 1,813,920, 2,044,993, 2,735,262, JP-A-48-9728, JP-A-49-84240, JP-A-49-102314, JP-A-51-53826, JP-A-52-13336 and JP-A-52-73731. For further heightening image intensification, the above described oxidizing agents for image intensification are added to the above described developing solution and development and image intensification can be carried out in a monobath at the same time. In particular, hydrogen peroxide is preferred due to high amplification. Such an image intensification is a preferred processing method from the environmental protection because the silver amount of a photographic material can be largely reduced and, therefore, a bleaching process is unnecessary, and there is no need of discharging silver (and silver salt) by a stabilizing process or the like.

A bleaching agent for use in a bleaching solution and a bleach-fixing solution includes, for example, compounds of polyvalent metals such as iron(III), cobalt(III), chromium (IV) and copper(II); peracids; quinones; and nitro compounds. Representative compounds include iron chloride; ferricyanide; bichromate; organic complex salts of iron(III) (for example, complex salt of iron with aminopolycarboxylic acids, e.g., ethylenediaminetetraacetic acid, diethylenetriaminepentaacetic acid, cyclohexanediaminetetraacetic acid, 1,3-diaminopropanetetraacetic acid, methyliminodiacetic acid, and the complex salt of iron with aminopolycarboxylic acids disclosed in JP-A-4-365036, pages 5 to 17), persulfate; permanganate; bromate; hydrogen peroxide and the eliminated compounds thereof (percarbonic acid and perboric acid); and nitrobenzene. Of these compounds, the use of aminopolycarboxylic acid iron(III) complex salts such as ethylenediaminetetraacetic acid iron(III) complex salts, 1,3-diaminopropanetetraacetic acid iron(III) complex salts, and hydrogen peroxide and persulfate is preferred from the point of providing rapid processing and preventing environmental pollution.

The pH of the bleaching solution or bleach-fixing solution using these aminopolycarboxylic acid iron(III) complex salts is from 3 to 8, preferably from 5 to 7. The pH of the bleaching solution using persulfate and hydrogen peroxide is from 4 to 11, preferably from 5 to 10.

A bleaching solution, a bleach-fixing solution and the prebath thereof can contain a bleaching accelerator, if necessary. Examples of useful bleaching accelerators include the compounds having a mercapto group or a disulfido bond disclosed in U.S. Pat. No. 3,893,856, West German Patent 1,290,812, JP-A-53-95630, and *Research Disclosure*, No. 17129 (July, 1978); the thiazolidine derivatives disclosed in JP-A-50-140129; the thiourea derivatives disclosed in U.S. Pat. No. 3,706,561; the iodides disclosed in JP-A-58-16235; the polyoxyethylene compounds disclosed in West German Patent 2,748,430; the polyamine compounds disclosed in JP-B-45-8836; and bromide ion.

Of these compounds, the compounds having a mercapto group or a disulfido group are preferred because of their excellent accelerating effect. These bleaching accelerators are effective when desilvering a color photographic material for photographing.

With respect to the accelerator for a persulfate bleaching solution, the complex salts of the iron(III) ion with 2-pyridine carboxylic acids or 2,6-pyridine carboxylic acids disclosed in JP-A-6-214365 (corresponding to EP-A-602600) are useful. Further, with respect to the accelerator for hydrogen peroxide bleaching solution, the metal complex salts of organic acids disclosed in JP-B-61-16067 and JP-B-61-19024 are useful.

A bleaching solution or a bleach-fixing solution can contain known additives such as a rehalogenating agent, e.g., ammonium bromide or ammonium chloride; a pH buffer such as ammonium nitrate, acetic acid, boric acid, citric acid or salt thereof, tartaric acid or salt thereof, succinic acid or salt thereof, and imidazole; and a metal corrosion inhibitor such as ammonium sulfate. It is preferred to include organic acids in a bleaching solution and a bleach-fixing solution for inhibiting bleaching stain. Preferred organic acids are compounds having an acid dissociation constant (pKa) of from 2 to 7, and specifically, acetic acid, succinic acid, citric acid and propionic acid are preferred.

As a fixing agent for a fixing solution and a bleach-fixing solution, thiosulfate, thiocyanate, thioureas, large amounts of iodide, and the nitrogen-containing heterocyclic compounds having a sulfido group disclosed in JP-A-4-365037, pages 11 to 21 and JP-A-5-66540, pages 1188 to 1092, mesoionic based compounds and thioether based compounds can be used. Of these, thiosulfate is generally used, and ammonium thiosulfate are most widely used. Further, the combined use of thiosulfate with thiocyanate, thioether based compounds, thiourea and mesoionic compound is also preferred.

As a preservative for a fixing solution and a bleach-fixing solution, sulfite, bisulfite, bisulfite addition product of carbonyl or the sulfinic acid compounds disclosed in EP-A-294769 are preferred. Moreover, the addition of various aminopolycarboxylic acids, organic phosphonic acids (e.g., 1-hydroxyethylidene-1,1-diphosphonic acid, N,N,N',N'-ethylenediaminetetraphosphonic acid, 2-phosphonobutane-1,2,4-tricarboxylic acid), and sodium stannate to a fixing solution, bleaching solution and a bleach-fixing solution is preferred for stabilizing the solutions.

Further, it is possible to incorporate various kinds of whitening agents, defoaming agents, surfactants, polyvinyl pyrrolidone and methanol in a fixing solution and a bleach-fixing solution.

The processing temperature of desilvering process is from 20° to 50° C., preferably from 30° to 45° C. The processing time is from 5 seconds to 2 minutes, preferably from 10 seconds to 1 minute. Replenishment rate is preferably smaller, and from 15 to 600 ml, preferably from 25 to 200 ml, and more preferably from 35 to 100 ml, per $m^2$ of the photographic material. It is also preferred that the evaporated amount is replenished with water and processing is conducted without a replenisher The photographic material of the present invention is generally subjected to water washing process after desilvering process. The stabilizing process can be carried out instead of the washing process. Any of known methods, for example, those disclosed in JP-A-57-8543, JP-A-58-14834, JP-A-60-220345, JP-A-58-127926, JP-A-58-137837 and JP-A-58-140741 can be used in such a stabilizing process. Also, the combination of the washing process—the stabilizing process represented by the process of color photographic material for photographing may be carried out with a stabilizing bath containing a dye stabilizer and a surfactant as a final both.

The washing water and the stabilizing solution can contain sulfite; a water softener such as inorganic phosphoric acid, polyaminocarboxylic acid, and organic aminophosphonic acid; a metal salt such as Mg salt, Al salt, and Bi salt; a surfactant; a hardening agent; a pH buffer; a whitening agent; silver salt-forming agent such as a nitrogen-containing heterocyclic compound.

The stabilizing solution can contain a dye stabilizer, for example, aldehydes such as formalin and glutaraldehyde, N-methylol compounds, hexamethylenetetramine or sulfite addition products of aldehyde.

The pH of the washing water and the stabilizing solution is from 4 to 9 and preferably from 5 to 8. The processing temperature is from 15° to 45° C., preferably from 25° C. to 40° C. The processing time is from 5 seconds to 2 minutes, and preferably from 10 seconds to 40 seconds.

The overflow generated by the replenishment of the above described washing water and/or stabilizing solution can be reused in other processes such as a desilvering process, etc.

The amount of the washing water and/or the stabilizing solution can be selected from the wide range according to the various conditions, but the replenishment rate is preferably from 15 to 360 ml, more preferably from 25 to 120 ml, per $m^2$ of the photographic material. The washing and/or the stabilizing process are preferably carried out by a multistage countercurrent system comprising a plurality of tanks, particularly using 2 to 5 tanks is preferred for reduction of the replenishment rate. When the amount of the washing water is reduced, problems arise such that bacteria proliferate and suspended matters produced adhere to the photographic material. To prevent these problems, the isothiazolone compounds and the thiabendazoles as disclosed in JP-A-57-8542, the antibacterial agents such as chlorinated sodium isocyanurate, the benzotriazole, and the antibacterial agents disclosed in Hiroshi Horiguchi, *Bohkin Bohbaizai no Kagaku (Chemistry of Antibacterial and Antifungal Agents*, published by Sankyo Shuppan K.K. (1986), *Biseibutsu no Mekkin, Sakkin, Bohbai Gijutsu (Germicidal and Antifungal Techniques of Microorganisms)*, edited by Eisei Gijutsukai, published by Kogyo Gijutsukai (1982), and *Bohkin Bohbai Zai Jiten (Antibacterial and Antifungal Agents Thesaurus)*, edited by Nippon Bohkin Bohbai Gakkai (1986), can be used. The method of reducing the calcium ion and magnesium ion concentrations as disclosed in JP-A-62-288838 can be used as a very effective means for overcoming these problems.

In the present invention, overflow solution or the solution in tank processed by a reverse osmosis membrane can effectively be used for saving water. For example, the processing using a reverse osmosis membrane is preferably conducted to the water of the second tank or after of a multistage countercurrent washing system and/or stabilizing process. Specifically, in the case of a two-tank system, the water in the second tank, and in the case of a four-tank system, the water in the third or fourth tank is processed with a reverse osmosis membrane, and the permeated water is returned back to the same tank (the tank from which the water to be processed with a reverse osmosis membrane was drawn) or the washing tank and/or stabilizing tank positioned after that tank and reused. The concentrated solution is returned back to the upper tank of the above same tank, and this water may be returned to desilvering tank. The materials which can be used for a reverse osmosis membrane include cellulose acetate, crosslinked polyamide, polyether, polysulfone, polyacrylic acid, and polyvinylene carbonate.

The solution feeding pressure in the use of these membranes is preferably from 2 to 10 $kg/cm^2$, particularly preferably from 3 to 7 $kg/cm^2$.

In the present invention, stirring as vigorous as possible is preferred. Specific examples of the methods of forced stirring include the method in which a jet of the processing solution is impinged on the surface of the emulsion of the photographic material as disclosed in JP-A-62-183460 and JP-A-62-183461, the method in which the stirring effect is raised using a rotating means as disclosed in JP-A-62-183461, the method in which the photographic material is moved with bringing a wiper blade into contact with the surface of the emulsion thereof, which blade is installed in the solution, and the generated turbulent flow at the surface of the emulsion increases the stirring effect, and the method in which the circulating flow rate of the entire processing solution is increased. These means for increasing the stirring level are effective for any of the developing solution, the bleaching solution, the fixing solution, the bleach-fixing solution, the stabilizing solution and the washing water. These methods are effective from the point of accelerating the supply of useful components in the solution to the photographic material and also accelerating diffusion of unnecessary components in the photographic material.

The performance of the processing of the present invention is superior at any condition of the open ratio of the processing solution [contact area of the processing solution with air ($cm^2$)+volume of the processing solution ($cm^3$)], but the open ratio of the processing solution of from 0 to 0.1 $cm^{-1}$ is preferred considering the stability of the component of the processing solution. The range of from 0.001 $cm^{-1}$ to 0.05 $cm^{-1}$ is preferred practically in the continuous processing, and more preferably from 0.002 to 0.03 $cm^{-1}$.

The automatic processors which are used in the present invention preferably have the means of transporting photographic materials as disclosed in JP-A-60-191257, JP-A-60-191258, and JP-A-60-191259. Such a transporting means can greatly reduce the carryover of the processing solution from the previous bath to the next bath and is effective for preventing the deterioration of the performances of the processing solution. These effects are especially effective in reducing the processing time of each processing step and reducing the replenishment rate of each processing solution. Further, for reducing the processing time, it is preferred to shorten the crossover time (time in the air by transfer from one processing tank to another processing tank in the air), for example, a transporting means disclosed in JP-A-4-86659, FIGS. 4, 5 or 6, and JP-A-5-66540, FIG. 4 or 5 in which photographic materials are transported between tanks via a blade having a screening effect are preferred.

When each processing solution is concentrated due to evaporation by continuous processing, it is preferred to replenish an appropriate amount of water to compensate for the concentration.

The processing time in the present invention means the time required from the start of processing of photographic materials in one processing step until the start of processing in the next step. Practical processing time by an automatic processor is, in general, determined by the line speed and the capacity of the processing tank, and in the present invention the standard of the line speed is from 500 to 4,000 mm/min. In particular, in a compact type processor, from 500 to 2,500 mm/min is preferred.

The processing time required of the entire processing step, that is, from the development step to the drying step, is preferably 360 seconds or less, more preferably 120 seconds, and particularly preferably from 90 to 30 seconds. The processing time used herein is from the immersion of photographic materials in a developing solution until coming out from the drying zone of the processor.

The present invention will be described in detail with reference to Examples but the present invention is not limited thereto.

EXAMPLE 1

A surface of a paper support laminated on both sides with polyethylene was corona discharged. The support was provided with a gelatin undercoat layer containing sodium dodecylbenzenesulfonate, and further, two photographic constitutional layers described below were coated to prepare a photographic paper (100) having the two layer structure shown below. The coating solutions were prepared in the following manner.

Coating Solution for First Layer 17 g of a coupler (ExY), 20 g of a reducing agent for coloring (I-9), 80 g of a solvent (Solv-1) were dissolved in 100 ml of ethyl acetate, and this solution was dispersed in an emulsified condition into 270 g of a 10% aqueous solution of gelatin containing 16 ml of 10% sodium dodecylbenzenesulfonate and 0.4 g of citric acid to obtain an emulsified dispersion A (average grain size of lipophilic fine grains was adjusted to 0.2 μm). On the other hand, silver chlorobromide emulsion A was prepared (cubic form, a mixture in a ratio of 3/7 (silver mol ratio) of a large grain size emulsion having an average grain size of 0.88 μm and a small grain size emulsion having an average grain size of 0.70 μm, variation coefficients of the grain size distribution of the large grain size emulsion and the small grain size emulsion of 0.08 and 0.10, respectively, and both emulsions containing 0.3 mol % of silver bromide localized at a part of the grain surface with the substrate being silver chloride). The blue-sensitive Sensitizing Dyes A, B and C shown below were added in an amount of $1.4\times10^{-4}$ mol, respectively, per mol of silver, to the large grain size emulsion, and $1.7\times10^{-4}$ mol, respectively, per mol of silver, to the small grain size emulsion. Chemical ripening was conducted by addition of a sulfur sensitizer and a gold sensitizer. The foregoing emulsified dispersion A was mixed with this silver chlorobromide emulsion A and dissolved to obtain a coating solution for the first layer having the composition described below. The coating amount of the emulsion indicates the coating amount in terms of silver.

The coating solutions for the second layer was prepared in the same manner as the coating solution for the first layer. 1-Oxy-3,5-dichloro-s-triazine sodium salt was used as a gelatin hardening agent in each layer.

Further, Cpd-2, Cpd-3, Cpd-4 and Cpd-5 were added to each layer so as to provide the total coating amount of 15.0 mg/m$^2$, 60.0 mg/m$^2$, 50.0 mg/m$^2$ and 10.0 mg/m$^2$, respectively.

The spectral sensitizing dyes described below were used in the silver chlorobromide emulsion of the first layer.

Sensitizing Dye A

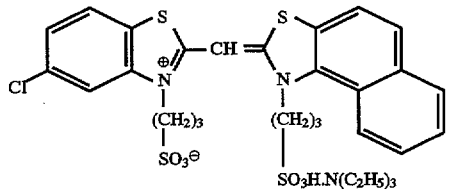

Sensitizing Dye B

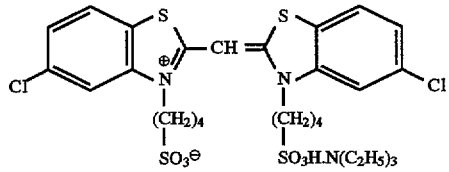

Sensitizing Dye C

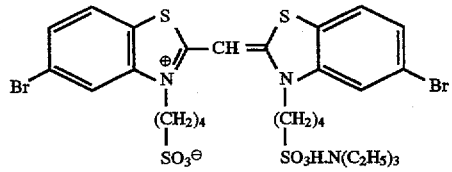

Further, 1-(5-methylureidophenyl)-5-mercaptotetrazole was added to the first layer in an amount of $3.0\times10^{-3}$ mol per mol of silver halide.

Layer Structure

The composition of each layer is described below. The numeral represents the coating amount g/m$^2$. The numeral for the silver halide emulsion represents the coating amount in terms of silver.

Support:

Polyethylene-laminated paper (a white pigment ($TiO_2$) and a blue dye (ultramarine) were added to the polyethylene of the first layer side).

| First Layer | |
|---|---|
| Silver Chlorobromide Emulsion A described above | 0.20 |
| Gelatin | 1.50 |
| Yellow Coupler (ExY-1) | 0.17 |
| Reducing Agent for Coloring (I-9) | 0.20 |
| Solvent (Solv-1) | 0.80 |
| Second Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surfactant (Cpd-1) | 0.01 |

Samples (101) to (167) were prepared in the same manner as the preparation of Sample (100) except that the yellow coupler and the reducing agent for coloring in the coating solution for the first layer were replaced with the yellow coupler and the reducing agent for coloring each in an equimolar amount as shown in Tables a-1 to a-4, and further a 1N—NaOH aqueous solution and a 1N—$H_2SO_4$ aqueous solution were added to the second layer and the film pH was adjusted to the value shown in Tables a-1 to a-4.

Further, Samples (200) to (259) were prepared in the same manner as the preparation of Sample (100) except that silver chlorobromide emulsion A in the coating solution for the first layer was replaced with silver chlorobromide emulsion B shown below in equal amount of silver, the coupler and the reducing agent for coloring were replaced with the magenta coupler and the reducing agent for coloring shown in Tables b-1 and b-2 each in an equimolar amount (average grain size of the lipophilic fine grains was adjusted to 0.2 μm), and further a 1N—NaOH aqueous solution and a 1N—$H_2SO_4$ aqueous solution were added to the second layer, and the film pH was adjusted to the values shown in Tables b-1 to b-4.

Silver Chlorobromide Emulsion B:

Cubic form, a mixture in a ratio of 1/3 (silver mol ratio) of a large grain size emulsion having an average grain size of 0.55 μm and a small grain size emulsion having an average grain size of 0.39 μm, variation coefficients of the grain size distribution of the large grain size emulsion and the small grain size emulsion of 0.10 and 0.08, respectively, and both emulsions containing 0.8 mol % of AgBr localized at a part of the grain surface with the substrate being silver chloride.

The following spectral sensitizing dyes were added to silver chlorobromide emulsion B.

Sensitizing Dye D

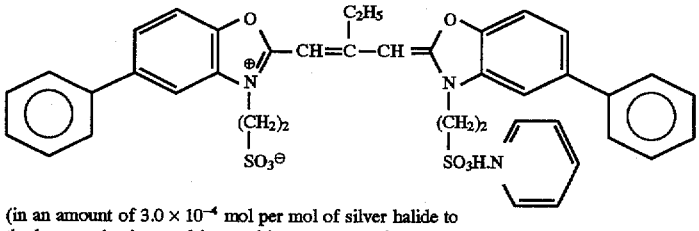

(in an amount of $3.0 \times 10^{-4}$ mol per mol of silver halide to the large grain size emulsion, and in an amount of $3.6 \times 10^{-4}$ mol per mol of silver halide to the small grain size emulsion)

Sensitizing Dye E

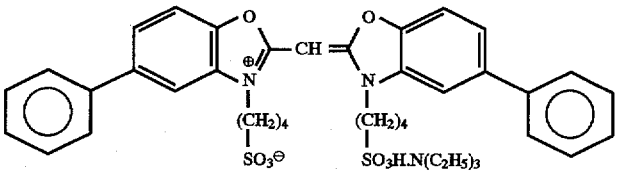

(in an amount of $4.0 \times 10^{-5}$ mol per mol of silver halide to the large grain size emulsion, and in an amount of $7.0 \times 10^{-5}$ mol per mol of silver halide to the small grain size emulsion)

Sensitizing Dye F

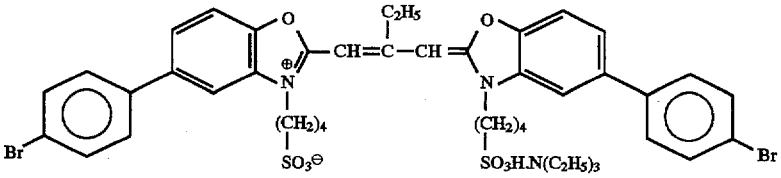

(in an amount of $2.0 \times 10^{-4}$ mol per mol of silver halide to the large grain size emulsion, and in an amount of $2.8 \times 10^{-4}$ mol per mol of silver halide to the small grain size emulsion)

Further, Samples (300) to (359) were prepared in the same manner as the preparation of Sample (100) except that silver chlorobromide emulsion A in the coating solution for the first layer was replaced with silver chlorobromide emulsion C shown below in equal amount of silver, the coupler and the reducing agent for coloring were replaced with the cyan coupler and the reducing agent for coloring shown in Tables c-1 to c-4 each in an equimolar amount (average grain size of the lipophilic fine grains was adjusted to 0.2 μm), and further a 1N—NaOH aqueous solution and a 1N—$H_2SO_4$ aqueous solution were added to the second layer, and the film pH was adjusted to the values shown in Tables c-1 to c-4.

Silver Chlorobromide Emulsion C:

Cubic form, a mixture in a ratio of 1/4 (silver mol ratio) of a large grain size emulsion having an average grain size of 0.5 μm and a small grain size emulsion having an average grain size of 0.41 μm, variation coefficients of the grain size distribution of the large grain size emulsion and the small grain size emulsion of 0.09 and 0.11, respectively, and both emulsions containing 0.8 mol % of AgBr localized at a part of the grain surface with the substrate being silver chloride.

The following spectral sensitizing dyes were added to silver chlorobromide emulsion C.

Sensitizing Dye G

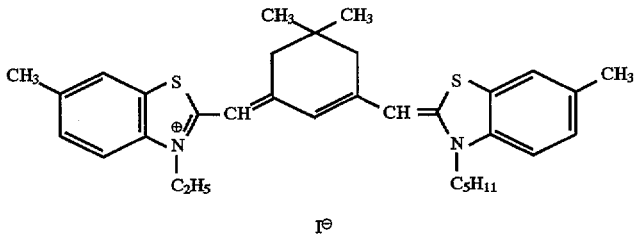

Sensitizing Dye H

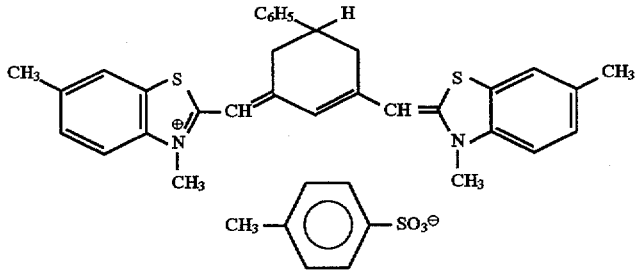

(each in an amount of $5.0 \times 10^{-5}$ mol per mol of silver halide to the large grain size emulsion, and each in an amount of $8.0 \times 10^{-5}$ mol per mol of silver halide to the small grain size emulsion)

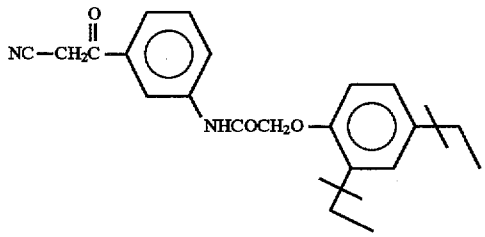

(ExY-1)

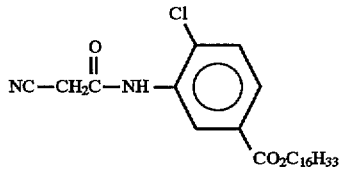

(ExY-2)

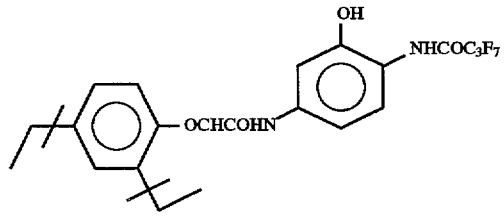

(ExM-1)

-continued
(ExM-2)
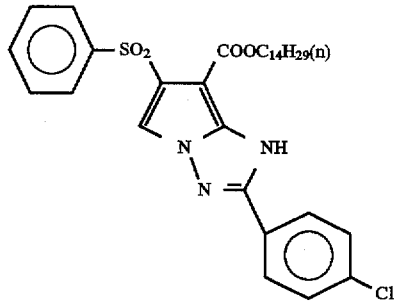
(ExC-1)
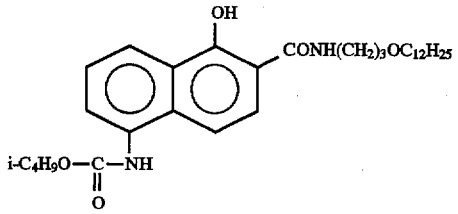
(ExC-2)
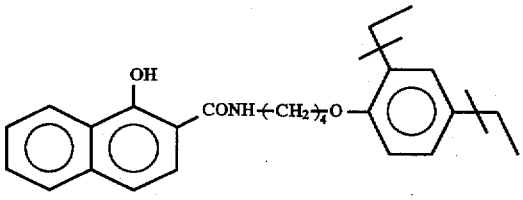
ExY 3
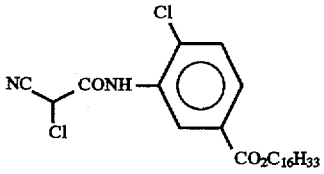
ExY 4
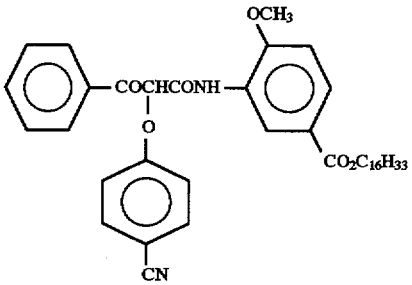
ExM 3
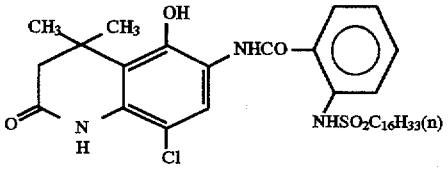

-continued
ExM 4
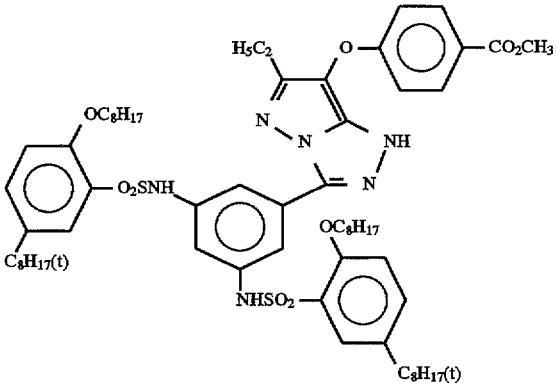
ExC 3
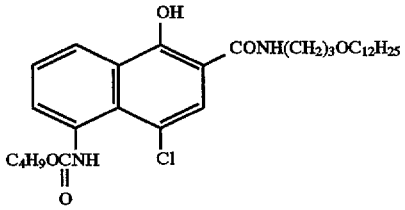
ExC 4
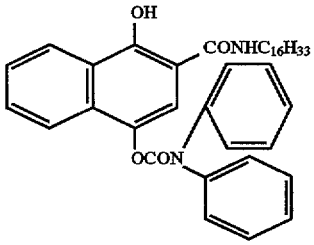
(Cpd-1) Surfactant
A 7:3 mixture (weight ratio) of
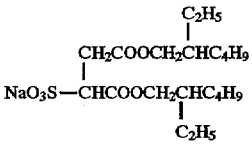
and
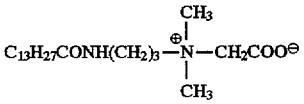
(Cpd-2) Preservative
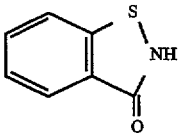
(Cpd-3) Preservative
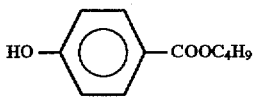

-continued (Cpd-4) Preservative

1:1:1:1 mixture (by weight ratio) of a:b:c:d

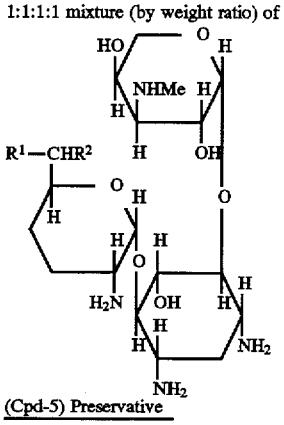

| | $R^1$ | $R^2$ |
|---|---|---|
| a | —Me | —NHMe |
| b | —Me | —$NH_2$ |
| c | —H | —$NH_2$ |
| d | —H | —NHMe |

(Cpd-5) Preservative

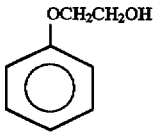

(Solv-1) Solvent

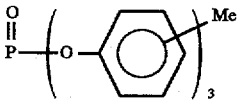

(Solv-2) Solvent

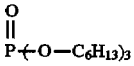

Each of the thus prepared samples was divided equally and one of which was forcedly thermo-tested at 50° C., 70% RH for one week, and the other one was stored in a freezer at the same time. Both samples after thermo-testing and being stored in a freezer were alkali processed as described below. Samples (100) to (167) were measured for difference in yellow density $\Delta D_B$ before and after thermo-testing, Samples (200) to (259) for difference in magenta density $\Delta D_G$ before and after thermo-testing, and Samples (300) to (359) for difference in cyan density $\Delta D_R$ before and after thermo-testing, respectively. The results obtained are shown in Tables a-1 to a-4, b-1 to b-4, and c-1 to c-4. The smaller the value, the smaller is the fog by aging.

The above prepared samples were gradation exposed using FWH-type sensitometer (color temperature of the light source: 3,200° K) manufactured by Fuji Photo Film Co., Ltd., Samples (100) to (167) through a blue filter for sensitometry, Samples (200) to (259) through a green filter for sensitometry, and Samples (300) to (359) through a red filter for sensitometry, respectively.

Exposed samples were processed according to the following processing step using the following processing solutions.

| Processing Step | Processing Temperature (°C.) | Processing Time (sec) |
|---|---|---|
| Development | 40 | 15 |
| Bleach-Fixing | 40 | 45 |
| Rinsing | room temperature | 45 |
| Alkali Processing | room temperature | 30 |

Developing Solution

| | |
|---|---|
| Water | 600 ml |
| Potassium Phosphate | 40 g |
| Disodium-N,N-bis(sulfonatoethyl)-hydroxylamine | 10 g |
| KCl | 5 g |
| Hydroxyethylidene-1,1-diphosphonic Acid (30%) | 4 ml |
| 1-Phenyl-4-methyl-4-hydroxymethyl-3-pyrazolidone | 1 g |
| Water to make | 1,000 ml |
| pH (25° C., adjusted with potassium hydroxide) | 12 |

Bleach-Fixing Solution

| | |
|---|---|
| Water | 600 ml |
| Ammonium Thiosulfate (700 g/liter) | 93 ml |
| Ammonium Sulfite | 40 g |
| Ammonium Ethylenediamine-tetraacetato Ferrate | 55 g |
| Ethylenediaminetetraacetic Acid | 2 g |

-continued

| | |
|---|---|
| Nitric Acid (67%) | 30 g |
| Water to make | 1,000 ml |
| pH (25° C., adjusted with acetic acid and aqueous ammonia) | 5.8 |
| Rinsing Solution | |
| Chlorinated Sodium Isocyanurate, | 0.02 g |
| Deionized Water (electric conductivity: 5 μS/cm or less) | 1,000 ml |
| pH | 6.5 |
| Alkali Processing Solution | |
| 0.1N Sodium Hydroxide | |

The maximum color density of each of the processed samples was measured, respectively, with Samples (100) to (167) by blue light, Samples (200) to (259) by green light and Samples (300) to (359) by red light. The results obtained are respectively shown in Tables a-1 to a-4, Tables b-1 to b-4, and Tables c-1 to c-4.

TABLE a-1

| Sample No. | Coupler | Reducing Agent for Coloring | Film pH | $\Delta D_B$ | Maximum Color Density | Remarks |
|---|---|---|---|---|---|---|
| 100 | ExY-1 | I-9 | 7.5 | 0.035 | 1.52 | Comparison |
| 101 | " | " | 7.0 | 0.030 | 1.54 | " |
| 102 | " | " | 6.5 | 0.022 | 1.53 | Invention |
| 103 | " | " | 5.5 | 0.018 | 1.54 | " |
| 104 | " | " | 3.0 | 0.016 | 1.50 | " |
| 105 | " | " | 2.5 | 0.016 | 1.42 | Comparison |
| 106 | " | I-5 | 7.5 | 0.038 | 1.34 | " |
| 107 | " | " | 7.0 | 0.032 | 1.32 | " |
| 108 | " | " | 6.5 | 0.022 | 1.32 | Invention |
| 109 | " | " | 5.5 | 0.019 | 1.30 | " |
| 110 | " | " | 3.0 | 0.019 | 1.26 | " |
| 111 | " | " | 2.5 | 0.018 | 1.12 | Comparison |
| 112 | " | I-38 | 7.5 | 0.028 | 0.46 | " |
| 113 | " | " | 7.0 | 0.024 | 0.44 | " |
| 114 | " | " | 6.5 | 0.018 | 0.44 | Invention |
| 115 | " | " | 5.5 | 0.016 | 0.42 | " |
| 116 | " | " | 3.0 | 0.016 | 0.38 | " |
| 117 | " | " | 2.5 | 0.015 | 0.30 | Comparison |
| 118 | ExY-2 | I-56 | 7.5 | 0.112 | 1.72 | " |
| 119 | " | " | 7.0 | 0.064 | 1.72 | " |
| 120 | " | " | 6.5 | 0.025 | 1.70 | Invention |

TABLE a-2

| Sample No. | Coupler | Reducing Agent for Coloring | Film pH | $\Delta D_B$ | Maximum Color Density | Remarks |
|---|---|---|---|---|---|---|
| 121 | ExY-2 | I-56 | 5.5 | 0.020 | 1.70 | Invention |
| 122 | " | " | 3.0 | 0.019 | 1.66 | " |
| 123 | " | " | 2.5 | 0.018 | 1.52 | Comparison |
| 124 | ExY-1 | I-11 | 7.5 | 0.032 | 1.46 | " |
| 125 | " | " | 5.5 | 0.019 | 1.44 | Invention |
| 126 | " | I-20 | 7.5 | 0.027 | 0.36 | Comparison |
| 127 | " | " | 5.5 | 0.017 | 0.34 | Invention |
| 128 | ExY-2 | I-54 | 7.5 | 0.109 | 1.65 | Comparison |
| 129 | " | " | 5.5 | 0.024 | 1.63 | Invention |
| 130 | " | I-55 | 7.5 | 0.101 | 1.59 | Comparison |
| 131 | " | " | 5.6 | 0.023 | 1.59 | Invention |

TABLE a-3

| Sample No. | Coupler | Reducing Agent for Coloring | Film pH | $\Delta D_B$ | Maximum Color Density | Remarks |
|---|---|---|---|---|---|---|
| 132 | ExY-3 | I-78 | 7.5 | 0.025 | 1.62 | Comparison |
| 133 | " | " | 7.0 | 0.021 | 1.65 | " |
| 134 | " | " | 6.5 | 0.015 | 1.63 | Invention |
| 135 | " | " | 5.5 | 0.012 | 1.62 | " |
| 136 | " | " | 3.0 | 0.011 | 1.60 | " |
| 137 | " | " | 2.5 | 0.011 | 1.52 | Comparison |
| 138 | " | I-81 | 7.5 | 0.028 | 1.32 | " |
| 139 | " | " | 7.0 | 0.022 | 1.33 | " |
| 140 | " | " | 6.5 | 0.015 | 1.32 | Invention |
| 141 | " | " | 5.5 | 0.012 | 1.31 | " |
| 142 | " | " | 3.0 | 0.011 | 1.28 | " |
| 143 | " | " | 2.5 | 0.011 | 1.21 | Comparison |
| 144 | " | I-86 | 7.5 | 0.024 | 1.66 | " |
| 145 | " | " | 7.0 | 0.019 | 1.65 | " |
| 146 | " | " | 6.5 | 0.013 | 1.64 | Invention |
| 147 | " | " | 5.5 | 0.012 | 1.64 | " |
| 148 | " | " | 3.0 | 0.012 | 1.62 | " |
| 149 | " | " | 2.5 | 0.011 | 1.53 | Comparison |
| 150 | " | I-104 | 7.5 | 0.030 | 1.43 | " |
| 151 | " | " | 7.0 | 0.026 | 1.43 | " |
| 152 | " | " | 6.5 | 0.016 | 1.43 | Invention |

TABLE a-4

| Sample No. | Coupler | Reducing Agent for Coloring | Film pH | $\Delta D_B$ | Maximum Color Density | Remarks |
|---|---|---|---|---|---|---|
| 153 | ExY-3 | I-104 | 5.5 | 0.013 | 1.41 | Invention |
| 154 | " | " | 3.0 | 0.012 | 1.40 | " |
| 155 | " | " | 2.5 | 0.011 | 1.30 | Comparison |
| 156 | ExY-4 | I-63 | 7.5 | 0.056 | 1.72 | " |
| 157 | " | " | 7.0 | 0.042 | 1.71 | " |
| 158 | " | " | 6.5 | 0.020 | 1.70 | Invention |
| 159 | " | " | 5.5 | 0.016 | 1.68 | " |
| 160 | " | " | 3.0 | 0.014 | 1.64 | " |
| 161 | " | " | 2.5 | 0.013 | 1.52 | Comparison |
| 162 | " | I-68 | 7.5 | 0.028 | 1.64 | " |
| 163 | " | " | 7.0 | 0.022 | 1.62 | " |
| 164 | " | " | 6.5 | 0.015 | 1.58 | Invention |
| 165 | " | " | 5.5 | 0.014 | 1.57 | " |
| 166 | " | " | 3.0 | 0.013 | 1.56 | " |
| 167 | " | " | 2.5 | 0.013 | 1.42 | Comparison |

TABLE b-1

| Sample No. | Coupler | Reducing Agent for Coloring | Film pH | $\Delta D_B$ | Maximum Color Density | Remarks |
|---|---|---|---|---|---|---|
| 200 | ExM-1 | I-9 | 7.5 | 0.038 | 1.46 | Comparison |
| 201 | " | " | 7.0 | 0.034 | 1.47 | " |
| 202 | " | " | 6.5 | 0.025 | 1.45 | Invention |
| 203 | " | " | 5.5 | 0.020 | 1.45 | " |
| 204 | " | " | 3.0 | 0.018 | 1.38 | " |
| 205 | " | " | 2.5 | 0.017 | 1.20 | Comparison |
| 206 | " | I-5 | 7.5 | 0.041 | 1.25 | " |
| 207 | " | " | 7.0 | 0.032 | 1.24 | " |
| 208 | " | " | 6.5 | 0.024 | 1.25 | Invention |
| 209 | " | " | 5.5 | 0.020 | 1.24 | " |
| 210 | " | " | 3.0 | 0.018 | 1.20 | " |
| 211 | " | " | 2.5 | 0.017 | 1.11 | Comparison |
| 212 | " | I-38 | 7.5 | 0.030 | 0.38 | " |
| 213 | " | " | 7.0 | 0.026 | 0.37 | " |
| 214 | " | " | 6.5 | 0.021 | 0.37 | Invention |
| 215 | " | " | 5.5 | 0.018 | 0.37 | " |
| 216 | " | " | 3.0 | 0.017 | 0.34 | " |
| 217 | " | " | 2.5 | 0.017 | 0.25 | Comparison |
| 218 | ExM-2 | I-56 | 7.5 | 0.116 | 1.62 | " |

TABLE b-1-continued

| Sample No. | Coupler | Reducing Agent for Coloring | Film pH | $\Delta D_B$ | Maximum Color Density | Remarks |
|---|---|---|---|---|---|---|
| 219 | " | " | 7.0 | 0.072 | 1.62 | " |
| 220 | " | " | 6.5 | 0.026 | 1.62 | Invention |

TABLE b-2

| Sample No. | Coupler | Reducing Agent for Coloring | Film pH | $\Delta D_B$ | Maximum Color Density | Remarks |
|---|---|---|---|---|---|---|
| 221 | ExM-2 | I-56 | 5.5 | 0.022 | 1.61 | Invention |
| 222 | " | " | 3.0 | 0.020 | 1.51 | " |
| 223 | " | " | 2.5 | 0.028 | 1.40 | Comparison |

TABLE b-3

| Sample No. | Coupler | Reducing Agent for Coloring | Film pH | $\Delta D_B$ | Maximum Color Density | Remarks |
|---|---|---|---|---|---|---|
| 224 | ExM-3 | I-78 | 7.5 | 0.028 | 1.84 | Comparison |
| 225 | " | " | 7.0 | 0.024 | 1.82 | " |
| 226 | " | " | 6.5 | 0.017 | 1.82 | Invention |
| 227 | " | " | 5.5 | 0.014 | 1.78 | " |
| 228 | " | " | 3.0 | 0.013 | 1.77 | " |
| 229 | " | " | 2.5 | 0.012 | 1.60 | Comparison |
| 230 | " | I-81 | 7.5 | 0.032 | 1.43 | " |
| 231 | " | " | 7.0 | 0.027 | 1.42 | " |
| 232 | " | " | 6.5 | 0.018 | 1.41 | Invention |
| 233 | " | " | 5.5 | 0.015 | 1.41 | " |
| 234 | " | " | 3.0 | 0.014 | 1.40 | " |
| 235 | " | " | 2.5 | 0.014 | 1.32 | Comparison |
| 236 | " | I-86 | 7.5 | 0.027 | 1.82 | " |
| 237 | " | " | 7.0 | 0.023 | 1.81 | " |
| 238 | " | " | 6.5 | 0.017 | 1.81 | Invention |
| 239 | " | " | 5.5 | 0.015 | 1.80 | " |
| 240 | " | " | 3.0 | 0.014 | 1.78 | " |
| 241 | " | " | 2.5 | 0.013 | 1.63 | Comparison |
| 242 | " | I-104 | 7.5 | 0.32 | 1.32 | " |
| 243 | " | " | 7.0 | 0.28 | 1.32 | " |
| 244 | " | " | 6.5 | 0.19 | 1.31 | Invention |

TABLE b-4

| Sample No. | Coupler | Reducing Agent for Coloring | Film pH | $\Delta D_B$ | Maximum Color Density | Remarks |
|---|---|---|---|---|---|---|
| 245 | ExM-3 | I-104 | 5.5 | 0.17 | 1.30 | Invention |
| 246 | " | " | 3.0 | 0.15 | 1.29 | " |
| 247 | " | " | 2.5 | 0.14 | 1.20 | Comparison |
| 248 | ExM-4 | I-63 | 7.5 | 0.58 | 2.24 | " |
| 249 | " | " | 7.0 | 0.43 | 2.23 | " |
| 250 | " | " | 6.5 | 0.20 | 2.23 | Invention |
| 251 | " | " | 5.5 | 0.19 | 2.22 | " |
| 252 | " | " | 3.0 | 0.15 | 2.20 | " |
| 253 | " | " | 2.5 | 0.13 | 2.05 | Comparison |
| 254 | " | I-68 | 7.5 | 0.52 | 1.96 | " |
| 255 | " | " | 7.0 | 0.40 | 1.94 | " |
| 256 | " | " | 6.5 | 0.19 | 1.93 | Invention |
| 257 | " | " | 5.5 | 0.17 | 1.91 | " |
| 258 | " | " | 3.0 | 0.15 | 1.90 | " |
| 259 | " | " | 2.5 | 0.13 | 1.40 | Comparison |

TABLE c-1

| Sample No. | Coupler | Reducing Agent for Coloring | Film pH | $\Delta D_B$ | Maximum Color Density | Remarks |
|---|---|---|---|---|---|---|
| 300 | ExC-1 | I-9 | 7.5 | 0.038 | 1.56 | Comparison |
| 301 | " | " | 7.0 | 0.034 | 1.54 | " |
| 302 | " | " | 6.5 | 0.022 | 1.55 | Invention |
| 303 | " | " | 5.5 | 0.018 | 1.53 | " |
| 304 | " | " | 3.0 | 0.018 | 1.48 | " |
| 305 | " | " | 2.5 | 0.016 | 1.32 | Comparison |
| 306 | " | I-5 | 7.5 | 0.039 | 1.56 | " |
| 307 | " | " | 7.0 | 0.035 | 1.56 | " |
| 308 | " | " | 6.5 | 0.023 | 1.54 | Invention |
| 309 | " | " | 5.5 | 0.019 | 1.55 | " |
| 310 | " | " | 3.0 | 0.018 | 1.50 | " |
| 311 | " | " | 2.5 | 0.017 | 1.38 | Comparison |
| 312 | " | I-38 | 7.5 | 0.027 | 0.42 | " |
| 313 | " | " | 7.0 | 0.024 | 0.42 | " |
| 314 | " | " | 6.5 | 0.018 | 0.41 | Invention |
| 315 | " | " | 5.5 | 0.016 | 0.42 | " |
| 316 | " | " | 3.0 | 0.014 | 0.37 | " |
| 317 | " | " | 2.5 | 0.014 | 0.29 | Comparison |
| 318 | ExC-2 | I-56 | 7.5 | 0.099 | 1.74 | " |
| 319 | " | " | 7.0 | 0.056 | 1.73 | " |
| 320 | " | " | 6.5 | 0.024 | 1.73 | Invention |

Grain Size: 0.2 μm

TABLE c-2

| Sample No. | Coupler | Reducing Agent for Coloring | Film pH | $\Delta D_B$ | Maximum Color Density | Remarks |
|---|---|---|---|---|---|---|
| 321 | ExC-2 | I-56 | 5.5 | 0.022 | 1.72 | Invention |
| 322 | " | " | 3.0 | 0.020 | 1.65 | " |
| 323 | " | " | 2.5 | 0.017 | 1.55 | Comparison |

Grain Size: 0.2 μm

TABLE c-3

| Sample No. | Coupler | Reducing Agent for Coloring | Film pH | $\Delta D_B$ | Maximum Color Density | Remarks |
|---|---|---|---|---|---|---|
| 324 | ExC-3 | I-78 | 7.5 | 0.024 | 1.63 | Comparison |
| 325 | " | " | 7.0 | 0.020 | 1.62 | " |
| 326 | " | " | 6.5 | 0.014 | 1.61 | Invention |
| 327 | " | " | 5.5 | 0.012 | 1.61 | " |
| 328 | " | " | 3.0 | 0.011 | 1.58 | " |
| 329 | " | " | 2.5 | 0.010 | 1.49 | Comparison |
| 330 | " | I-81 | 7.5 | 0.026 | 1.42 | " |
| 331 | " | " | 7.0 | 0.021 | 1.41 | " |
| 332 | " | " | 6.5 | 0.015 | 1.41 | Invention |
| 333 | " | " | 5.5 | 0.014 | 1.40 | " |
| 334 | " | " | 3.0 | 0.012 | 1.38 | " |
| 335 | " | " | 2.5 | 0.012 | 1.30 | Comparison |
| 336 | " | I-86 | 7.5 | 0.024 | 1.61 | " |
| 337 | " | " | 7.0 | 0.021 | 1.60 | " |
| 338 | " | " | 6.5 | 0.014 | 1.60 | Invention |
| 339 | " | " | 5.5 | 0.013 | 1.60 | " |
| 340 | " | " | 3.0 | 0.011 | 1.59 | " |
| 341 | " | " | 2.5 | 0.011 | 1.49 | Comparison |
| 342 | " | I-104 | 7.5 | 0.028 | 1.32 | " |
| 343 | " | " | 7.0 | 0.024 | 1.30 | " |
| 344 | " | " | 6.5 | 0.018 | 1.30 | Invention |

Grain Size: 0.2 μm

TABLE c-4

| Sample No. | Coupler | Reducing Agent for Coloring | Film pH | $\Delta D_B$ | Maximum Color Density | Remarks |
|---|---|---|---|---|---|---|
| 345 | ExC-3 | I-104 | 5.5 | 0.015 | 1.29 | Invention |
| 346 | " | " | 3.0 | 0.013 | 1.28 | " |
| 347 | " | " | 2.5 | 0.012 | 1.20 | Comparison |
| 348 | ExC-4 | I-63 | 7.5 | 0.052 | 1.82 | " |
| 349 | " | " | 7.0 | 0.046 | 1.81 | " |
| 350 | " | " | 6.5 | 0.018 | 1.80 | Invention |
| 351 | " | " | 5.5 | 0.014 | 1.80 | " |
| 352 | " | " | 3.0 | 0.013 | 1.79 | " |
| 353 | " | " | 2.5 | 0.012 | 1.70 | Comparison |
| 354 | " | I-68 | 7.5 | 0.047 | 1.72 | " |
| 355 | " | " | 7.0 | 0.039 | 1.70 | " |
| 356 | " | " | 6.5 | 0.019 | 1.70 | Invention |
| 357 | " | " | 5.5 | 0.014 | 1.70 | " |
| 358 | " | " | 3.0 | 0.013 | 1.68 | " |
| 359 | " | " | 2.5 | 0.012 | 1.61 | Comparison |

Grain Size: 0.2 μm

As is apparent from Tables a-1 to c-4, stain after thermo-testing was reduced by suppressing film pH 6.5 or less. Stain after thermo-testing is further reduced by maintaining pH 5.5 or less. Further, if film pH is within the range of the present invention, the reduction of the maximum color density is less. When using the reducing agent for coloring (I-9) represented by formula (II), higher coloring even among the samples of the present invention can be obtained, from which it can be seen that more effective improvement of stain can be obtained by lowering the film pH. Further, when using the reducing agent for coloring (I-56) represented by formula (III), still higher coloring ability can be obtained, from which it can be seen that the more effective improvement can be obtained by lowering the film pH. On the contrary, if the film pH is less than 3, the maximum color density is extremely deteriorated and not good. On the other hand, in a case using a reducing agent for coloring represented by formula (IV) such as a compound (I-78), high coloring ability is obtained and generation of stain is further reduced, even when a two-equivalent coupler such as ExY-3, ExM-3 and ExC-3 is used.

EXAMPLE 2

A multilayer color photographic paper (400) having the layer structure shown below was prepared same as in Example 1 by coating various photographic constitutional layers on a polyethylene laminate paper support having been provided the surface treatment and undercoat layer.

The coating solution for the first layer was the same as Sample (100) used in Example 1.

The coating solutions for the second to seventh layers were prepared in the same manner as the preparation of the coating solution for the first layer. 1-Oxy-3,5-dichloro-s-triazine sodium salt was used as a gelatin hardening agent in each layer.

Further, Cpd-2, Cpd-3, Cpd-4 and Cpd-5, the same preservatives as used in Example 1, were added to each layer so as to provide the total coating amount of 15.0 mg/m$^2$, 60.0 mg/m$^2$, 50.0 mg/m$^2$ and 10.0 mg/m$^2$, respectively.

The average grain size of the lipophilic fine grains of the first layer, third layer and fifth layer containing the coupler and the reducing agent for coloring was adjusted to 0.2 μm.

To the silver chlorobromide emulsion of each light-sensitive emulsion layer, the same spectral sensitizing dyes were added in the same amount as in Example 1.

Further, to the fifth layer (red-sensitive layer), the following compound was added in an amount of $2.6\times10^{-2}$ mol per mol of silver halide.

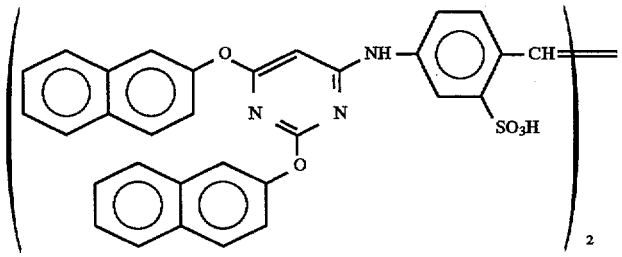

Further, 1-(5-methylureidophenyl)-5-mercaptotetrazole was added to the blue-sensitive, 9teen-sensitive and red-sensitive emulsion layers respectively in an amount of $3.5\times10^{-4}$ mol, $3.0\times10^{-3}$ mol, and $2.5\times10^{-4}$ mol, per mol of silver halide.

Moreover, to the blue-sensitive and green-sensitive emulsion layers, 4-hydroxy-6-methyl-1,3,3a,7-tetraazaindene was added respectively in an amount of $1\times10^{-4}$ mol and $2\times10^{-4}$ mol, per mol of silver halide.

Further, for the purpose of irradiation prevention, the following dyes (numerals in the parentheses indicate coating amount) were added to emulsion layers.

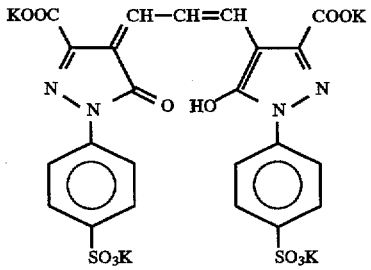

(10mg/m$^2$)

-continued

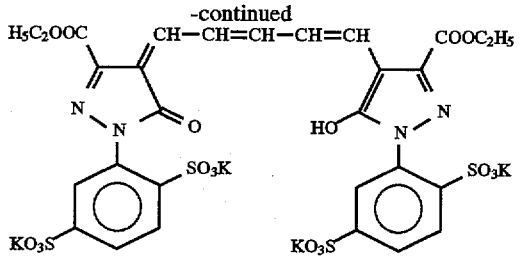

(40mg/m²)

Layer Structure

The composition of each layer is described below. The numeral represents the coating amount g/m². The numeral for the silver halide emulsion represents the coating amount in terms of silver.

Support:

Polyethylene-laminated paper (a white pigment ($TiO_2$) and a blue dye (ultramarine) were added to the polyethylene of the first layer side).

| | |
|---|---|
| First Layer (blue-sensitive emulsion layer) | |
| Silver Chlorobromide Emulsion A in Example 1 | 0.20 |
| Gelatin | 1.50 |
| Yellow Coupler (ExY-1) | 0.17 |
| Reducing Agent for Coloring (I-9) | 0.20 |
| Solvent (Solv-1) | 0.80 |
| Second Layer (color mixing Preventing layer) | |
| Gelatin | 1.09 |
| Color Mixing Preventive (Cpd-6) | 0.11 |
| Solvent (Solv-1) | 0.19 |
| Solvent (Soly-3) | 0.07 |
| Solvent (Solv-4) | 0.25 |
| Solvent (Solv-5) | 0.09 |
| Third Layer (green-sensitive emulsion layer) | |
| Silver Chlorobromide Emulsion B in Example 1 | 0.20 |
| Gelatin | 1.50 |
| Magenta Coupler (Exm-1) | 0.24 |
| Reducing Agent for Coloring (I-9) | 0.20 |
| Solvent (Solv-2) | 0.80 |
| Fourth Layer (color mixing preventing layer) | |
| Gelatin | 0.77 |
| Color MIxing Preventive (Cpd-6) | 0.08 |
| Solvent (Solv-1) | 0.14 |
| Solvent (Solv-3) | 0.05 |
| Solvent (Solv-4) | 0.14 |
| Solvent (Solv-5) | 0.06 |
| Fifth Layer (red-sensitive emulsion layer) | |
| Silver Chlorobromide Emulsion C in Example 1 | 0.20 |
| Gelatin | 0.15 |
| Cyan Coupler (ExC-1) | 0.20 |
| Reducing Agent for Coloring (I-9) | 0.20 |
| Solvent (Solv-1) | 0.18 |
| Sixth Lyaer (ultraviolet absorbing layer) | |
| Gelatin | 0.64 |
| Ultraviolet Absorbing Agent (UV-1) | 0.39 |
| Color Image Stabilizer (Cpd-7) | 0.05 |
| Solvent (Solv-6) | 0.05 |
| Seventh Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surfactant (Cpd-1) | 0.01 |

(Cpd-6) Color mixting Preventive

1:1:1 mixture (by weight ratio) of (1):(2):(3)

(1)

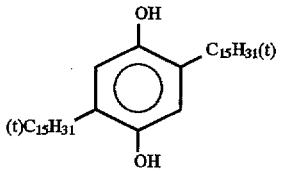

(2)

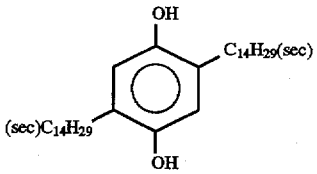

(3)

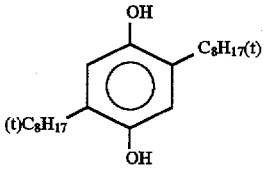

(Cpd-7) Color Image Stabilizer

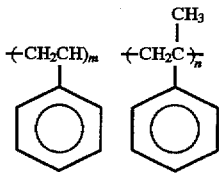

number average molecular weight: 600
m/n = 9/1

(Solv-3) Solvent

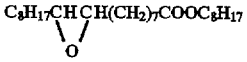

(Solv-4) Solvent

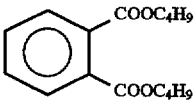

(Solv-5) Solvent

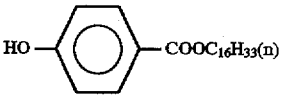

(Solv-6) Solvent

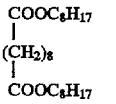

(UV-1) UV Absorbing Agent

1:2:2:3:1 mixture (by weight ratio) of (1):(2):(3):(4):(5)

-continued (1)

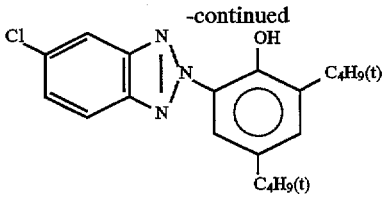

(2)

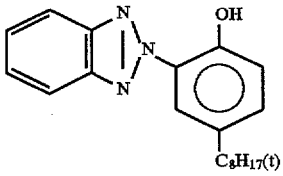

(3)

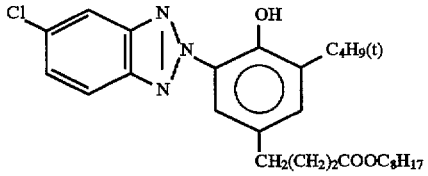

(4)

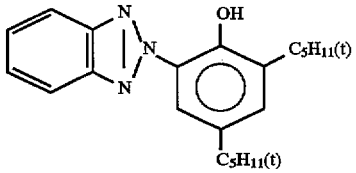

(5)

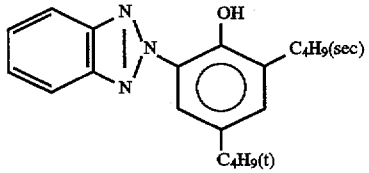

Samples (401) to (405) were prepared in the same manner as the preparation of Sample (400) except that a 1N—NaOH aqueous solution and a 1N—$H_2SO_4$ aqueous solution were added to the second, fourth, sixth and seventh layers and the film pH of each sample was adjusted to the value shown in Table d.

Each of the thus prepared samples was divided equally and one of which was forcedly thermo-tested at 50° C., 70% RH for one week, and the other one was stored in a freezer at the same time. Samples after thermo-testing and being stored in a freezer were alkali processed as described below. The difference in yellow density $\Delta D_B$, difference in magenta density $\Delta D_G$ and difference in cyan density $\Delta D_R$ between the thermo-tested sample and the sample stored in a freezer were measured respectively. The results obtained are shown in Table d. The smaller the value, the smaller is the stain by aging.

Each of the above prepared samples was gradation exposed using FWH-type sensitometer (color temperature of the light source: 3,200° K) manufactured by Fuji Photo Film Co., Ltd. through a three color separation filter for sensitometry.

Exposed samples were processed according to the following processing step using the following processing solutions.

| Processing Step | Processing Temperature (°C.) | Processing Time (sec) |
|---|---|---|
| Development | 40 | 15 |
| Bleach-Fixing | 40 | 45 |
| Rinsing | room temperature | 45 |
| Alkali Processing | room temperature | 30 |

| | |
|---|---|
| Developing Solution | |
| Water | 600 ml |
| Potassium Phosphate | 40 g |
| Disodium-N,N-bis(sulfonatoethyl)-hydroxylamine | 10 g |
| KCl | 5 g |
| Hydroxyethylidene-1,1-diphosphonic acid | 4 ml |
| 1-Phenyl-4-methyl-4-hydroxymethyl-3-pyrazolidone | 1 g |
| Water to make | 1,000 ml |
| pH (25° C., adjusted with potassium hydroxide) | 12 |
| Bleach-Fixing Solution | |
| Water | 600 ml |
| Ammonium Thiosulfate (700 g/liter) | 93 ml |
| Ammonium Sulfite | 40 g |
| Ammonium Ethylenediamine-tetraacetato Ferrate | 55 g |
| Ethylenediaminetetraacetic Acid | 2 g |
| Nitric Acid (67%) | 30 g |
| Water to make | 1,000 ml |
| pH (25° C., adjusted with acetic acid and aqueous ammonia) | 5.8 |
| Rinsing Solution | |
| Chlorinated Sodium Isocyanurate, | 0.02 g |
| Deionized Water (electric conductivity: 5 μS/cm or less) | 1,000 ml |
| pH | 6.5 |
| Alkali Processing Solution | |
| 0.1N Sodium Hydroxide | |

The maximum color density of each of the processed samples was measured, respectively, with blue light, green light and red light.

The results obtained are shown in Table d.

TABLE d

| Sample No. | Film pH | $\Delta D_B$ | $D_{Bmax}$ | $\Delta D_G$ | $D_{Gmax}$ | $\Delta D_R$ | $D_{Rmax}$ | Remarks |
|---|---|---|---|---|---|---|---|---|
| 400 | 7.5 | 0.042 | 1.74 | 0.053 | 1.66 | 0.045 | 1.72 | Comparison |
| 401 | 7.0 | 0.038 | 1.70 | 0.046 | 1.65 | 0.036 | 1.72 | " |
| 402 | 6.5 | 0.026 | 1.72 | 0.028 | 1.62 | 0.027 | 1.73 | Invention |
| 403 | 5.5 | 0.022 | 1.72 | 0.023 | 1.61 | 0.023 | 1.74 | " |

TABLE d-continued

| Sample No. | Film pH | $\Delta D_B$ | $D_{Bmax}$ | $\Delta D_G$ | $D_{Gmax}$ | $\Delta D_R$ | $D_{Rmax}$ | Remarks |
|---|---|---|---|---|---|---|---|---|
| 404 | 3.0 | 0.020 | 1.62 | 0.020 | 1.58 | 0.022 | 1.70 | " |
| 405 | 2.5 | 0.020 | 1.41 | 0.020 | 1.42 | 0.021 | 1.52 | Comparison |

Grain Size: 0.2 μm

As is apparently known from Table d, in the case of a multilayer photographic material, the same results with a single layer photographic material in Example 1 were obtained.

EXAMPLE 3

Samples (500) to (531) were prepared in the same manner with the preparation of Sample (100) except that the coupler and the reducing agent for coloring were replaced with the coupler and the reducing agent for coloring as shown in Table e each in an equimolar amount, and the grain size of the lipophilic fine grains in the emulsion dispersion was adjusted to the size indicated in Table e by regulating the revolving speed of the stirring blades during emulsifying dispersion, and further a 1N—NaOH aqueous solution and a 1N—$H_2SO_4$ aqueous solution were added to the second layer and the film pH was adjusted to the value shown in Tables e-1 and e-2.

The thus prepared every sample was measured for ΔD and the maximum density in the same testing method as in Example 1. The results obtained are shown in Tables e-1 and 2.

TABLE e-1

| Sample No. | Coupler | Reducing Agent for Coloring | Film pH | Grain Size | ΔD | Maximum Color Density |
|---|---|---|---|---|---|---|
| 500 | ExY-1 | I-9 | 7.5 | 0.35 | 0.037 | 1.44 |
| 501 | " | " | " | 0.30 | 0.036 | 1.48 |
| 502 | " | " | " | 0.20 | 0.035 | 1.52 |
| 503 | " | " | " | 0.10 | 0.036 | 1.53 |
| 504 | " | " | 5.5 | 0.35 | 0.026 | 1.46 |
| 505 | " | " | " | 0.30 | 0.021 | 1.50 |
| 506 | " | " | " | 0.20 | 0.018 | 1.54 |
| 507 | " | " | " | 0.10 | 0.018 | 1.55 |
| 508 | ExY-2 | I-56 | 7.5 | 0.35 | 0.114 | 1.62 |
| 509 | " | " | " | 0.30 | 0.112 | 1.68 |
| 510 | " | " | " | 0.20 | 0.112 | 1.72 |
| 511 | " | " | " | 0.10 | 0.111 | 1.74 |
| 512 | " | " | 5.5 | 0.35 | 0.032 | 1.62 |
| 513 | " | " | " | 0.30 | 0.024 | 1.67 |
| 514 | " | " | " | 0.20 | 0.020 | 1.70 |
| 515 | " | " | " | 0.10 | 0.018 | 1.71 |

TABLE e-2

| Sample No. | Coupler | Reducing Agent for Coloring | Film pH | Grain Size | ΔD | Maximum Color Density |
|---|---|---|---|---|---|---|
| 516 | ExY-3 | I-36 | 7.5 | 0.35 | 0.028 | 1.55 |
| 517 | " | " | " | 0.30 | 0.026 | 1.60 |
| 518 | " | " | " | 0.20 | 0.025 | 1.62 |
| 519 | " | " | " | 0.10 | 0.026 | 1.63 |
| 520 | " | " | 5.5 | 0.35 | 0.020 | 1.57 |
| 521 | " | " | " | 0.30 | 0.015 | 1.61 |
| 522 | " | " | " | 0.20 | 0.012 | 1.62 |
| 523 | " | " | " | 0.10 | 0.012 | 1.64 |
| 524 | ExY-4 | I-1 | 7.5 | 0.35 | 0.057 | 1.68 |

TABLE e-2-continued

| Sample No. | Coupler | Reducing Agent for Coloring | Film pH | Grain Size | ΔD | Maximum Color Density |
|---|---|---|---|---|---|---|
| 525 | " | " | " | 0.30 | 0.056 | 1.70 |
| 526 | " | " | " | 0.20 | 0.056 | 1.72 |
| 527 | " | " | " | 0.10 | 0.054 | 1.73 |
| 528 | " | " | 5.5 | 0.35 | 0.028 | 1.65 |
| 529 | " | " | " | 0.30 | 0.018 | 1.67 |
| 530 | " | " | " | 0.20 | 0.016 | 1.68 |
| 531 | " | " | " | 0.10 | 0.015 | 1.71 |

As is apparent from Tables e-1 and e-2, when the film pH is beyond the present invention, the improvement of the increase of stain due to the forced thermo-test is small even the grain size of the lipophilic fine grain is lessened. On the contrary, when the film pH is within the range of the present invention, stain can be conspicuously improved unexpectedly by reducing the grain size of the lipophilic fine grain.

EXAMPLE 4

Samples (600) to (605) were prepared in the same manner with the preparation of Samples (400) to (405) in Example 2 except for changing the coating amount of silver of the first, third and fifth layers of Samples (400) to (405) to 0.01 g/m$^2$, respectively.

Each sample was subjected to exposure in the same manner as in Example 2, then processed according to the following processing step omitting the desilvering step and including the development intensification using the following processing solutions.

| Processing Step | Processing Temperature (°C.) | Processing Time (sec) |
|---|---|---|
| Development Intensification | 40 | 40 |
| Stabilization | 30 | 15 |
| Alkali Processing | room temperature | 10 |

Developing Solution

| | |
|---|---|
| Water | 800 ml |
| Potassium Phosphate | 40 g |
| 5-Nitrobenzotriazole | 20 mg |
| Disodium-N,N-bis(sulfonatoethyl)-hydroxylamine | 3.3 g |
| KCl | 2.5 g |
| Hydroxyethylidene-1,1-diphosphonic Acid (30%) | 4 ml |
| 1-Phenyl-4-methyl-4-hydroxymethyl-3-pyrazolidone | 1 g |
| Water to make | 1,000 ml |
| pH (25° C., adjusted with potassium hydroxide) | 11.7 |

Before processing, 10 ml of hydrogen

-continued

| | |
|---|---|
| peroxide (30%) was added. (pH after the addition of hydrogen peroxide was 11.5.) | |
| Stabilizing Solution | |
| Sodium Hydrogensulfite | 9.0 g |
| Sodium Sulfite | 7.8 g |
| Tripotassium Citrate Monohydrate | 30.0 g |
| Sodium Thiosulfate | 7.5 g |
| Water to make | 1,000 ml |
| pH (25° C., adjusted with potassium hydroxide) | 6.0 |
| Alkali Processing Solution | |
| Water | 800 ml |
| Potassium Carbonate | 30 g |
| Water to make | 1,000 ml |
| pH | 10.0 |

Samples after being processed were evaluated in the same manner as in Example 2. Almost the same results as in Example 2 were obtained even when the desilvering process was omitted.

EXAMPLE 5

Samples (700) to (705) were prepared in the same manner as the preparation of Samples (400) to (405) as in Example 2, except that reducing agent for coloring (I-78), and Couplers ExY-3, ExM-3 and ExC-3 were used instead of reducing agent for coloring (I-9), and Couplers ExY-1, ExM-1 and ExC-1 used in Example 2 to prepare Samples (400) to (405).

The same samples thus prepared were exposed and evaluated in the same method as in Example 2.

The results thus obtained are shown in the following Table f.

TABLE f

| Sample No. | Film pH | $\Delta D_B$ | $D_{Bmax}$ | $\Delta D_G$ | $D_{Gmax}$ | $\Delta D_R$ | $D_{Rmax}$ |
|---|---|---|---|---|---|---|---|
| 700 | 7.5 | 0.032 | 1.75 | 0.038 | 1.94 | 0.034 | 1.72 |
| 701 | 7.0 | 0.028 | 1.72 | 0.031 | 1.92 | 0.029 | 1.71 |
| 702 | 6.5 | 0.020 | 1.70 | 0.020 | 1.90 | 0.018 | 1.71 |
| 703 | 5.5 | 0.018 | 1.69 | 0.018 | 1.90 | 0.016 | 1.69 |
| 704 | 3.0 | 0.017 | 1.68 | 0.017 | 1.88 | 0.015 | 1.67 |
| 705 | 2.5 | 0.015 | 1.60 | 0.016 | 1.79 | 0.014 | 1.58 |

As is apparent from the results of Table f, in a case of a multilayer photographic material using a reducing agent for coloring represented by formula (IV), such as (I-78) in the same manner as in Example 2, stain generation is more remarkably reduced by adjusting the pH of the film being 6.5 or less.

The present invention provides a silver halide color photographic material which generates less stain and is excellent in coloring ability even after the unprocessed material is stored for a long period of time, and can undergo color processing of less waste solution load.

While the invention has been described in detail and with reference to specific examples thereof, it will be apparent to one skilled in the art that various changes and modifications can be made therein without departing from the spirit and scope thereof.

What is claimed is:

1. A silver halide color photographic material comprising a support having thereon at least one silver halide emulsion layer, wherein said emulsion layer contains at least one dye-forming coupler and at least one reducing agent for coloring represented by the following formula (I), and further the film pH of said silver halide color photographic material is 6.5 or less:

$$R^{11}—NH—NH—X—R^{12} \quad (I)$$

wherein $R^{11}$ represents an aryl group, or a heterocyclic group; $R^{12}$ represents an alkyl group, an alkenyl group, an alkynyl group, an aryl group or a heterocyclic group; X represents $—SO_2—$, —CO—, —COCO—, —CO—O—, $—CO—N(R^{13})—$, —COCO—O—, $—COCO—N(R^{13})—$ or $—SO_2—N(R^{13})—$; wherein $R^{13}$ represents a hydrogen atom or a group described for $R^{12}$.

2. The silver halide color photographic material as claimed in claim 1, wherein the reducing agent for coloring represented by formula (I) is contained in lipophilic fine particles and the average particle size is 0.3 μm or less.

3. The silver halide color photographic material as claimed in claim 1, wherein said silver halide color photographic material has at least three silver halide emulsion layers having different color sensitivities on a support and the total coating amount of silver is from 0.003 $g/m^2$ to 0.3 $g/m^2$.

4. The silver halide color photographic material as claimed in claim 2, wherein said silver halide color photographic material has at least three silver halide emulsion layers having different color sensitivities on a support and the total coating amount of silver is from 0.003 $g/m^2$ to 0.3 $g/m^2$.

5. The silver halide color photographic material as claimed in claim 1, wherein the reducing agent for coloring represented by formula (I) is represented by the following formula (II):

$$R^{11}—NH—NH—X'—R^{12} \quad (II)$$

wherein $R^{11}$ represents an aryl or a heterocyclic group; $R^{12}$ represents an alkyl group, an alkenyl group, an alkynyl group, an aryl group or a heterocyclic group; wherein X' represents —CO— or $—CON(R^{13})—$, wherein $R^{13}$ represents a hydrogen atom or a group represented by $R^{12}$.

6. The silver halide color photographic material as claimed in claim 5, wherein the reducing agent for coloring represented by formula (II) is contained in lipophilic fine particles and the average particle size is 0.3 μm or less.

7. The silver halide color photographic material as claimed in claim 5, wherein said silver halide color photographic material has at least three silver halide emulsion layers having different color sensitivities on a support and the total coating amount of silver is from 0.003 $g/m^2$ to 0.3 $g/m^2$.

8. The silver halide color photographic material as claimed in claim 4, wherein the reducing agent for coloring represented by formula (II) is represented by the following formula (III):

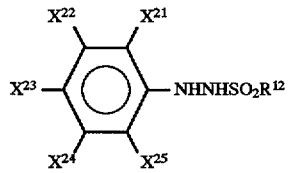

(III)

wherein $R^{12}$ represents an alkyl group or a heterocyclic group; $X^{21}$, $X^{23}$ and $X^{25}$ each represent a hydrogen atom, or a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, or a trifluoromethyl group; $X^{22}$ and $X^{24}$ each represent a hydrogen atom, or a nitro group, a cyano group, an alkylsulfonyl group, an arylsulfonyl group, an alkylsulfinyl group, an arylsulfinyl group, a sulfamoyl group, a carbamoyl group, an alkoxycarbonyl group, an aryloxycarbonyl group, an acyl group, a trifluoromethyl group, a halogen atom, an acyloxy group or an acylthio group, provided that the sum of Hammett's $\sigma_p$ value of $X^{21}$, $X^{23}$ and $X^{25}$ and Hammett's $\sigma^m$ value of $X^{22}$ and $X^{24}$ should be 1.5 or more.

9. The silver halide color photographic material as claimed in claim 1, wherein the reducing agent for coloring represented by formula (I) is represented by the following formula (IV):

$$R^{11}—NH—NH—CO—R^{12} \quad (IV)$$

wherein $R^{11}$ represents an aryl group or a heterocyclic group; $R^{12}$ represents an alkyl group, an alkenyl group, an alkynyl group, an aryl group, or a heterocyclic group.

10. The silver halide color photographic material as claimed in claim 9, wherein the reducing agent for coloring represented by formula (IV) is contained in lipophilic fine particles and the average particle size is 0.3 μm or less.

11. The silver halide color photographic material as claimed in claim 9, wherein said silver halide color photographic material has at least three silver halide emulsion layers having different color sensitivities on a support and the total coating amount of silver is from 0.003 $g/m^2$ to 0.3 $g/m^2$.

12. The silver halide color photographic material as claimed in claim 1, wherein said dye-forming coupler is an active methylene based coupler, a pyrazolone based coupler, a pyrazoloazole based coupler, a phenol based coupler, a naphthol based coupler or a pyrrolotriazole based coupler.

13. The silver halide color photographic material as claimed in claim 1, wherein said reducing agent for coloring is used in an amount of 0.01 $mmol/m^2$ to 10 $mmol/m^2$ to one coloring layer.

14. The silver halide color photographic material as claimed in claim 1, wherein said dye-forming coupler is used in an amount of from 0.05 times to 20 times of the reducing agent for coloring in terms of mol.

15. The silver halide color photographic material as claimed in claim 1, wherein the film pH of said silver halide color photographic material is 4 to 5.5.

16. The silver halide color photographic material as claimed in claim 1, wherein silver halide emulsion contained in said silver halide emulsion layer comprises silver chloride or silver chlorobromide containing high silver chloride which comprises 95 mol % or more of silver chloride and 1 mol % or less of silver iodide.

* * * * *